US006601427B2

(12) United States Patent
Kondou et al.

(10) Patent No.: US 6,601,427 B2
(45) Date of Patent: Aug. 5, 2003

(54) METHOD OF MANUFACTURING PIPE BODY AND PIPE BODY MANUFACTURED BY THE METHOD

(75) Inventors: Takafumi Kondou, Tokyo (JP); Keiji Ishino, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/776,119

(22) Filed: Feb. 2, 2001

(65) Prior Publication Data

US 2001/0013242 A1 Aug. 16, 2001

(30) Foreign Application Priority Data

| | | |
|---|---|---|
| Feb. 4, 2000 | (JP) | 2000-027843 |
| Feb. 4, 2000 | (JP) | 2000-027844 |
| Dec. 21, 2000 | (JP) | 2000-388916 |

(51) Int. Cl.[7] ..... B21D 51/06
(52) U.S. Cl. ..... 72/368; 72/51
(58) Field of Search ..... 72/51, 368, 52, 72/370.26

(56) References Cited

U.S. PATENT DOCUMENTS

| | | | | | |
|---|---|---|---|---|---|
| 786,923 | A | * | 4/1905 | Smith | 72/368 |
| 1,019,485 | A | * | 3/1912 | Koenig | 72/368 |
| 1,344,105 | A | | 6/1920 | Vance | |
| 1,894,054 | A | | 1/1933 | Noble | |
| 1,897,077 | A | | 2/1933 | Shuttleworth | |
| 2,115,441 | A | * | 4/1938 | Black | 72/368 |
| 4,135,633 | A | | 1/1979 | Lockwood et al. | |
| 4,310,740 | A | * | 1/1982 | Nakazima | 72/52 |
| 5,239,888 | A | * | 8/1993 | Sevault et al. | 72/368 |

FOREIGN PATENT DOCUMENTS

| | | | | |
|---|---|---|---|---|
| DE | 4420070 | | 2/1995 | |
| EP | 0395626 | | 10/1990 | |
| FR | 1378692 | | 11/1964 | |
| JP | 01-162522 | * | 6/1989 | 72/51 |
| JP | 11290940 | | 10/1999 | |
| WO | 9007392 | | 7/1990 | |

OTHER PUBLICATIONS

U.S. patent application Ser. No. 09/776,118, filed Feb. 2, 2001.
European Search Report in appln No. 01300945.1—2302—(Search report dated Mar. 6, 2002).
Translation of summary of Japanese patent publ'n 01–162522 (Nakaoi of record).

* cited by examiner

*Primary Examiner*—Lowell A. Larson
(74) *Attorney, Agent, or Firm*—Cooper & Dunham LLP

(57) ABSTRACT

A method of manufacturing pipe body by which pipe body with precise quality and closely contacted seam can be made stably by pressing process, and pipe body manufactured by the method are provided. To manufacture a pipe body 1 made of metal with circular or polygonal cross section comprising a seam 5*e* and a wall 2 or plurality of walls 2, 3 and 4, a pipe-like intermediate product 14 is made by bending a metal plate 6 of which edges to be seam 5*e* have not yet contacted together. In case for prism pipe, the intermediate product comprises walls 5*a*, 5*b* to be contacted and be a wall including seam, and other walls, and both angles of both ends of one specified wall 15 of the intermediate product are larger than those of completed pipe. External forces are applied to adjoining walls 16, 16 of the one specified wall 15 so as for the one specified wall 15 to include convex portion 32 to outer side and for the seam 5*e* to be closely contacted together, then another external force is applied to the one specified wall 15 so as to be flat and to be the completed pipe 1. A spring back force tending the one specified wall to be back as original convex form is induced and it maintains the seam 5*e* in close contacted condition. In case for cylindrical pipe, the intermediate product has an oval cross section with its seam contacted together, and an external force is applied in long axis direction of the oval so as for the oval to be circular and to be a completed pipe 1. A spring back force tends the pipe to be back as original oval form is induced and it maintains the seam 5*e* in close contacted condition.

9 Claims, 86 Drawing Sheets

FIG. 1
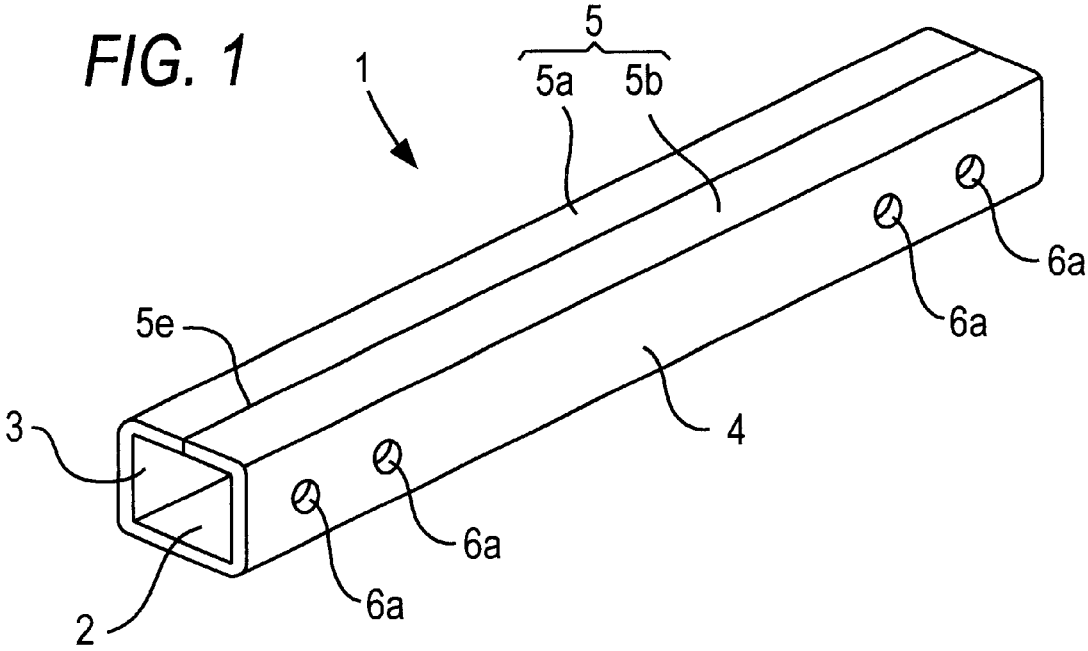
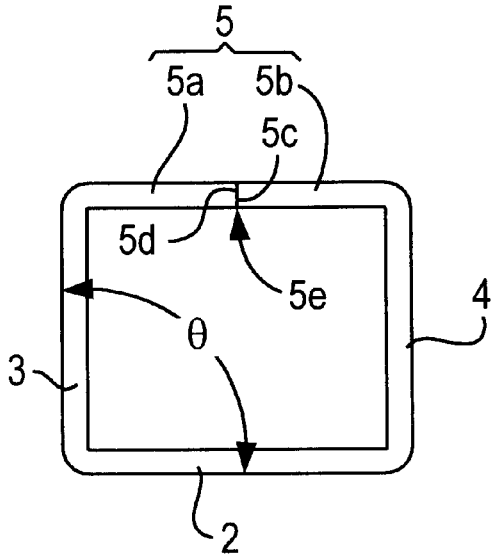
FIG. 2

FIG. 6(a)
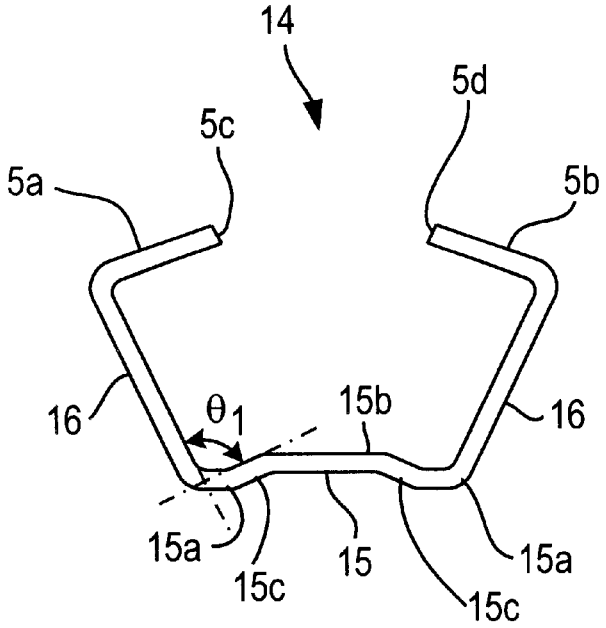
FIG. 6(b)
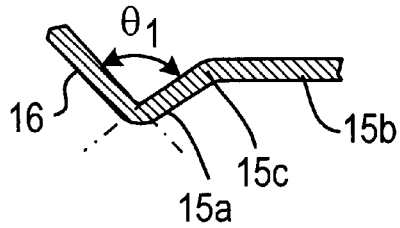
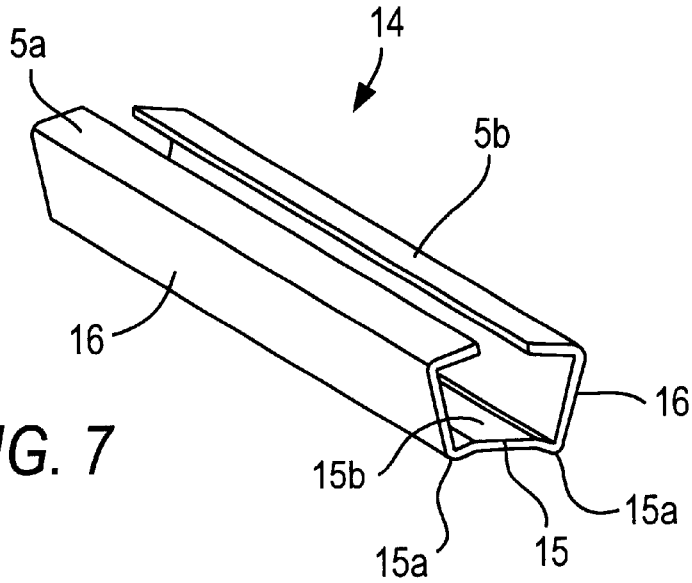
FIG. 7

FIG. 29
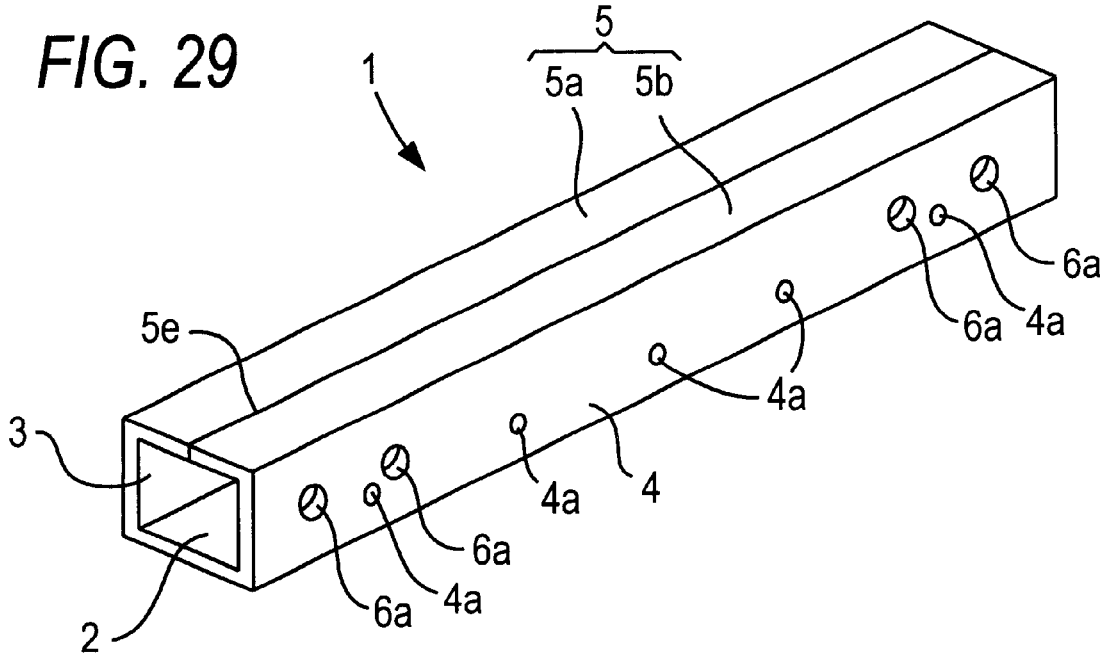
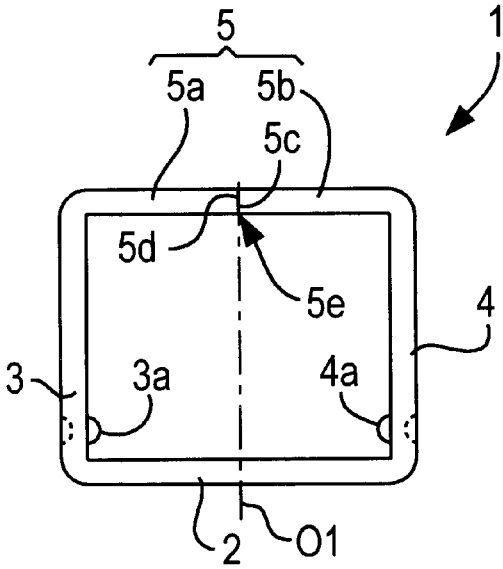
FIG. 30
FIG. 31
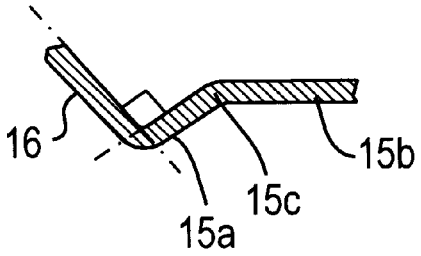

METHOD OF MANUFACTURING PIPE BODY AND PIPE BODY MANUFACTURED BY THE METHOD

TECHNICAL FIELD

The present invention relates to manufacture a pipe body by performing a bending operation on a metal plate.

BACKGROUND OF THE INVENTION

Conventionally, there is disclosed a technique by which a pipe body, for example, a prism pipe body is made by bending a metal plate, such as in Japanese Patent Laid-Open No. Hei 11-290940.

In Japanese Patent Laid-Open No. Hei 11-290940, a prism pipe body is manufactured by using a rectangular metal plate as a material by means of pressing.

The method of manufacturing prism pipe body includes a first bending step, a second bending step, and a re-striking step. In the first bending step, a primary intermediate product is formed of a metal plate. In the second bending step, the primary intermediate product is processed to form a secondary intermediate product. In the re-striking step, the secondary intermediate product is processed to form a prism pipe body as a final product.

In the first bending step, both width direction sides of the metal plate are bent at the right angle in length direction. Accordingly, the primary intermediate product which includes flanges and a bottom plate is formed. The flanges face to each other. The bottom plate connects the flanges to each other.

In the second bending step, a concave surface having a predetermined width is formed on the bottom plate of the primary intermediate product lengthwise, and at the same time, both ends of the concave surface is bent at the right angle to inside. Accordingly, the second intermediate product is formed. The secondary intermediate product includes a pair of side walls which facing to each other. The cross section of the secondary intermediate product is U shape.

In the re-striking step, edges of a pair of flanges (seam) are contacted together by pressing a pair of side walls of the secondary intermediate product inside. Accordingly, a prism pipe body as a final product is formed.

According to this method of manufacturing the prism pipe body, the concave surface which is formed on bottom plate of secondary intermediate product, has a function to restrict a spring back force generated by pressing the pair of side walls together to inside. Accordingly a prism pipe body with square cross section, in which edges of the flanges closely contact together, can be manufactured only by pressing without welding edges of the flanges.

PROBLEMS TO BE SOLVED

However, in this conventional method of manufacturing prism pipe body, even though the concave surface of secondary intermediate product has a function to restrict spring back force, spring back force which tends to open to outside still remains at the pair of side walls. Accordingly, it is difficult to stably manufacture without deflection the prism pipe body whose edges of flange (wall including the seam) closely contacts for mass production.

When testing a prism pipe body manufactured by the conventional working method, if edges of flanges are contacted each other or not, some are closely contacted each other, but many of them have gaps in the seam due to the spring back force appearing at the pair of side walls.

It is an object of the present invention to solve the above mentioned problems and to provide an method of manufacturing pipe body and pipe body manufactured by the method having capability of manufacturing pipe body stably without deflection in which a seam tightly contacted by pressing when mass production the pipe body.

SUMMARY OF THE INVENTION

In order to achieve the above objects, according to one aspect of the present invention, a method of manufacturing a metal pipe body by bending a flat metal plate at predetermined angles, comprising the steps of bending a portion near at least one end of the plate along an axis of the completed metal pipe body so as to have a predetermined angle of a corner of the completed metal pipe body; bending the same side as said bent portion of said metal plate at points which correspond to some integer times of one side of the completed metal pipe body in the same bending direction as said bent portion along the axis of completed metal pipe with an angle more than said predetermined angle; making one of the portion made by said second bending, concave toward the center of completed metal pipe body; pressing portions including edges of the plate towards the center of completed metal pipe body along the bottom surface of said portions including edges so as for said edges to get close contact and at the same time modifying said angles more than the predetermined angle into said predetermined angle; generating a modifying operation of said concave portion into convex form toward outside against center of the completed metal pipe accompanied with said angle modifying operation; accumulating inner stress for said concave portions tending back to said convex form through said modifying operation by making said concave portion flat thereby making a close contacting operation of said portion including edges by operation for all sides other than said convex portion and portions including edges enforcing towards the center of completed metal pipe; and maintaining said edges contacting together and said originally concave portion flat, is provided.

According to another aspect of the present invention, a method of manufacturing a metal pipe body by bending a flat metal plate at an angle, comprising the steps of bending a portion of the flat metal plate near at least one end of the flat metal plate along an axis of the completed metal pipe body so as to have a predetermined angle of a corner of the completed metal pipe body; bending the same side as said bent portion of said metal plate at points which correspond to some integer times of one side of the completed metal pipe body in the same bending direction as said bent portion along the axis to be completed metal pipe with an obtuse angle more than said predetermined angle; making one of the portion made by said second bending, concave toward the center portion of completed metal pipe body; pressing portions including edges of the plate towards center of the completed metal pipe body along the bottom surface of said portions including edges so as to get close contact of said edges and at the same time modifying said angles more than predetermined angle into said predetermined angle; modifying said concave portion into convex form toward outside against center of the completed metal pipe accompanied with said angle modifying operation; modifying said convex portion into flat by pressing said bottom surface and the surface facing to said surface with convex form towards center of completed metal pipe body with said portions including edges contacting together; accumulating inner stress for said concave portions tending back to said convex form through said modifying operation by making said concave portions flat thereby making close contacting operation of said portions including edges; and maintaining said edges contacting together and said originally concave portion flat, is provided.

According to other aspect of the present invention, a method of manufacturing pipe body having a seam and circular shaped cross section made of a rectangular metal plate, comprising the steps of: by bending said metal plate, forming a curved pipe-like intermediate product of oval-like cross section in which a pair of edges of said metal plate to be a seam of said pipe is still not contacted and located at one end of longer axis of said oval and extending along the axis of the completed pipe; and modifying the curved intermediate product by applying a force along the longer axis of said oval so as to force said edges contacted tightly with spring back force tending to return to the original oval shape, is provided.

According to still other aspect of the present invention, a method for manufacturing pipe body having a seam and polygonal cross section made of a rectangular metal plate, comprising the steps of: by bending said plate at plurality of points along its edge direction, forming a pipe-like intermediate product in which a pair of edges of said metal plate to be a seam of said pipe are still not contacted together and both and angles of one specified wall are greater than the predetermined value for angle of the completed pipe; making said pair of edges close contact by forcing said one specified wall convex to outside; and modifying convex said one specified wall flat so as to force said edges contacted tightly with spring back force tending to return to the convex shape, is provided.

The above stated methods makes possible to manufacture either a prism or cylindrical pipe body made of metal plate with the polygonal or circular cross section in which the seam of plate edges is closely contacted by aggressively utilizing a force which the convex and concave surface tend to return to the original shapes.

According to still other aspect of the present invention, a method for manufacturing pipe body having a seam and polygonal cross section made of a rectangular metal plate, comprising the steps of: a first processing step of forming a seam including wall by standing at least one portion of a pair of edges of said metal plate along its edge direction; a second processing step of forming remaining walls other than said seam including wall and making a pipe-like intermediate product in which a pair of edges of said metal plate to be a seam of said pipe are still not contacted and both end angles of one specified wall are greater than the predetermined value for angle of the completed pipe; a third processing step of making said pair of edges close contact by forcing said one specified wall convex to outside; and a fourth processing step of modifying convex said one specified wall flat so as to force said edges contacted rightly with spring back force tending to return to the convex shape, is provided.

The method makes it possible that a primary intermediate product having a wall including seam is formed at the first processing step, and a secondary intermediate product having remaining walls other than the wall including seam is formed at the second processing step, and by using the secondary intermediate product, pipe bodies having various shapes are formed.

According to still other aspect of the present invention, a pipe body having a seam and polygonal cross section made of rectangular metal plate, characterized by: being made through a pipe-like intermediate product prepared by bending said plate at plurality of points along its edge direction, in which a pair of edges of said metal plate to be a seam of said pipe is still not contacted and both end angles of one specified wall are greater than the predetermined value for angle of the completed pipe; and said pair of edges are closely contacted by forcing said one specified wall convex to outside and convex said one specified wall are flat so as to force said edges contacted tightly with spring back force tending to return to the convex shape, is provided.

By the above stated pipe body according to present invention, it is possible to make the seam closely contacted together without welding.

The seam may be located at the center of the wall including seam. And, the seam may be located between the wall including seam and adjoining wall. Further, the seam may be located at the center of three walls.

Moreover, according to the method, it is possible to manufacture a pipe body whose shape of cross section is triangle, pentagonal, hexagon, or octagon shape.

Preferably, the one specified wall comprises a flat portion and a curved portion. When the curved portion is formed between the adjoining wall and the flat portion and the curved convex surface is modified to be flat, flatness of it can be ensured.

In the method of manufacturing pipe body, it is more preferable to use the pipe body having a cross section of a rectangle shape, and it is also preferable that an angle between the one specified wall and the adjoining wall of the intermediate product is an obtuse angle when forming a curved convex surface.

When the cross section of the pipe body is rectangular, it is preferable that defining each of the walls of the pipe body as a bottom wall, a pair of side walls adjacent to the bottom wall and a upper wall facing to the bottom wall, and the seam is formed on the upper wall.

Preferably, the metal plate includes engaging concave portion such as tapped holes or notch for installation previously formed on the wall in order to use the pipe body as a supporting member for, image forming apparatus, such as copy machine, for example, without further work after assembling.

Preferably, a forming process of the pipe body is performed under consideration of extension when bending the metal plate.

According to still other aspect of the present invention, a pipe body having a seam and circular cross section made of rectangular metal plate, characterized by: being made through a curved pipe-like intermediate product of oval-like cross section made by bending said metal plate in which a pair of edges of said metal plate to be a seam of said pipe is still not contacted and located at one end of longer axis of said oval and extending along the axis of the completed pipe; and formed by modifying the curved intermediate product by applying a force along the longer axis of said oval so as to force said edges contacted tightly with spring back force tending to return to the original oval shape, is provided.

According to still other aspect of the present invention, a pipe body having a seam and polygonal cross section made of a rectangular metal plate, characterized by: being made through a pipe-like intermediate product prepared by bending said plate at plurality of points along its edge direction, in which a pair of edges of said metal plate to be a seam of said pipe are still not contacted together and both end angles of one specified wall are greater than the predetermined value for angle of the completed pipe; said pair of edges are closely contacted by forcing said one specified wall convex to outside; and convex said one specified wall is modified flat so as to force said edges contacted together tightly with spring back force tending to return to the convex shape, is provided.

According to the above described pipe body, it is possible to closely contact the seam together without welding.

According to still other aspect of the present invention, a prism pipe body having a seam extending along axis direction of said pipe body made of a rectangular metal plate, characterized by pair of edges of said plate consisting said seam are closely contacted by spring back force and having a fastening plate formed on a surface to be tied with other materials, is provided.

According to still other aspect of the present invention, a prism pipe body made of a rectangular metal plate, comprising a bottom wall, a pair of adjoining walls to said bottom wall and upper walls one of which includes a seam confronting with said bottom wall, wherein: said seam is closely contacted by spring back force; said walls are extending along the direction of axis of the pipe body; and a fastening plate is formed on a surface to be tied with other materials, is provided.

In the above described pipe bodies, because the fastening plate is formed integrally, fastening strength can be improved more than any prism pipe bodies of prior art fastened with other materials using a bracket.

According to still other aspect of the present invention, a prism pipe body made of a rectangular metal plate, comprising a bottom wall, a pair of adjoining walls to said bottom wall and upper walls including seam which is confronting with said bottom wall, characterized by a first residual stress distortion appeared at corners portion between said pair of adjoining walls and said bottom wall which makes said seam open, a second residual stress distortion appeared at center portion of said bottom wall induced by plastic deformation which has counter direction of said first residual distortion, wherein said seam is closely contacted by said second residual stress distortion which makes said bottom wall convex to outside, and an area exists between said corner and said center of bottom wall which has a low residual stress distortion, is provided.

According to still other aspect of the present invention, a prism pipe body characterized by: being made through a pipe-like intermediate product comprising one specified wall, a pair of side walls adjoining to said specified wall and other walls, wherein: the angles between said specified wall and said a adjoining walls are obtuse, and said specified wall concave into inside; a stress distortion toward inside generated on said intermediate product through making said specified wall convex to outside by deforming said pair of walls of said intermediate product toward inside; forcing the angle between said specified wall and said pair of walls square by making plastic distortion so as for said specified wall to be deformed flat with making center portion of said specified wall as fulcrum, through forcing top wall including seam which is confronted to said bottom wall with restricting said pair of walls and making said intermediate product completed pipe body of which bottom wall corresponds to said specified wall and a pair of side walls adjoining said bottom wall correspond to said pair of side walls; wherein said bottom wall deforms convex to outside by a residual stress distortion generated at center of said specified wall which has counter direction of another residual stress distortion generated at corners between said pair of adjoining walls and said bottom wall making said seam open; said seam is closely contacted by said another residual stress distortion; and an area exists between said corner and said center of bottom wall having a low residual stress distortion, is provided.

BRIEF DESCRIPTION OF THE DRAWINGS

The present invention will be better understood and its various objects and advantages will be more fully appreciated from the following description taken in conjunction with the accompanying drawings, in which:

FIG. 1 is a perspective view showing an external shape of a prism pipe body according to the present invention;

FIG. 2 is a side view of the prism pipe body depicted in FIG. 1;

FIG. 6 is a side view of a secondary intermediate product, wherein FIG. 6(*a*) shows the whole shape of the secondary intermediate product, and FIG. 6(*b*) is a partial enlarged view of the secondary intermediate product;

FIG. 7 is a perspective view showing one external shape of the secondary intermediate product according to the present invention;

FIG. 29 is a perspective view of the prism pipe body manufactured by the apparatus depicted in FIG. 28;

FIG. 30 is a front view of the prism pipe body manufactured by the apparatus depicted in FIG. 28;

FIG. 31 is a partial sectional view of the secondary intermediate product depicted in FIG. 28;

FIG. 72(*d*) shows an example of forming the guide portion at the inner side of the front end of the fork type protrusion; FIG. 72(*e*) shows an example of forming a half circular notch at the base portion of the fork type protrusion; and FIG. 72(*f*) shows an example of forming a circular notch at the base portion of the fork type protrusion;

DETAILED DESCRIPTION OF THE INVENTION

Figure 3:
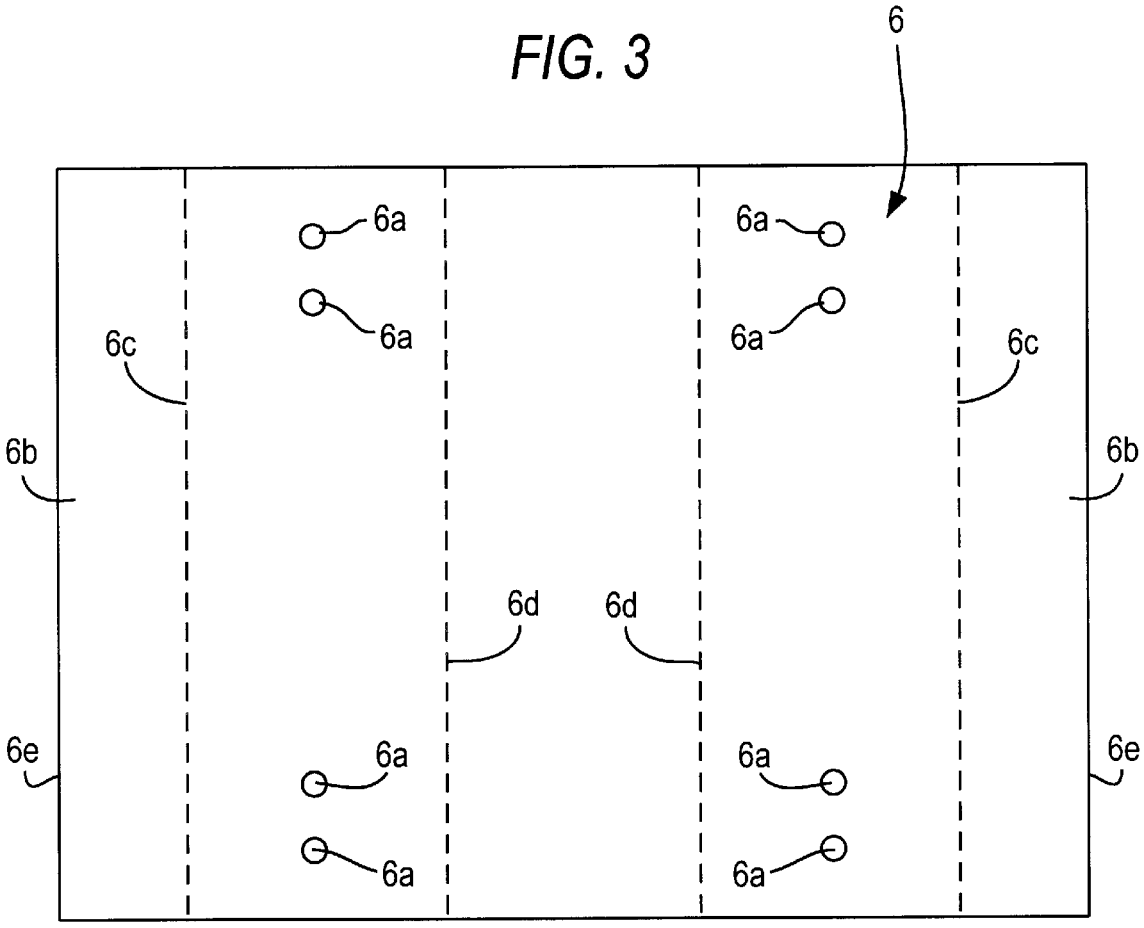
FIG. 3 is a plane view of a metal plate used for forming the pipe body depicted in FIGS. 1 and 2.

Preferred embodiments of the present invention will be illustrated as follows:

(1) [Prism pipe body]

(2) [Method of manufacturing the prim pipe body of item (1)]

(The primary intermediate product used for manufacturing of the prism pipe body)

(The secondary intermediate product used for manufacturing the prism pipe body)

[Example 1 of apparatus for manufacturing the prism pipe body]

(Stress distribution analysis of the prism pipe body 1)

[Example 2 of apparatus for manufacturing the prism pipe body]

[Example 3 of apparatus for manufacturing the prism pipe body]

(3) [Example 1 of a prism pipe body having a fastening plate]

[Method of manufacturing the prism pipe body of item (3)]

(4) [Example 2 of a prism pipe body having a fastening plate]

[Method of manufacturing the prism pipe body of item (4)]

(5) [Prism pipe body having a portion for tolerance]

[Method of manufacturing the prism pipe body having a portion for tolerance]

(6) [Prism pipe body having a cock]

(7) [Other prism pipe bodies]

(Deformation example of the prism pipe body shown in FIG. 1)

(Prism pipe body having a polygon shaped section)

(Cylindrical pipe body)

(8) [Example of using a prism pipe body]

(Example 1 of using the prism pipe body)

(Example 2 of using the prism pipe body)

(1) [Prism Pipe Body]

FIG. 1 is a perspective view showing a prism pipe body having a closed section with the square pillar shape, and FIG. 2 is a side view of the prism pipe body.

In FIGS. 1 and 2, the numeral 1 is the prism pipe body. A closed section of the prism pipe body 1 is geometrically square shaped (e.g., such as a shape of a perfect square). The prism pipe body 1 includes a bottom wall 2, a pair of side walls 3 and 4 which neighbor to the bottom wall 2, and an upper wall 5 which faces the bottom wall 2.

The upper wall 5 includes a pair of wall including seams 5*a* and 5*b*.

Two end surfaces 5*c* and 5*d* of each of the pair of wall including seams 5*a* and 5*b* contact to each other, such that a seam 5*e* is formed on the center of upper wall 5.

(2) [Method of Manufacturing Prism Pipe Body of Item (1)]

As a material for manufacturing the prism pipe body 1, a rectangular shaped metal plate (sheet metal) 6 depicted in FIG. 3 is used. And, the prism pipe body 1 is formed by pressing. Tapped holes 6*a* and 6*a* for installation have been formed in advance at suitable portions of the metal plate 6. The tapped holes 6*a* and 6*a* are used as supporting means which will be described below when attaching the prism pipe body 1 to a copy machine (not depicted).

(Primary Intermediate Product Used for Manufacturing Prism Pipe Body)

First, in the second processing step, the pair of wall including seams 5*a* and 5*b* including a seam 5*e* are formed by using the metal plate 6.

In order to form the wall including seams, the pair of side portions 6*b* and 6*b* are bent at the right angle (90 degree) of lengthwise along the bending lines 6*c* and 6*c* extended along the sides of them to be stood up. And, numeral 6*e* denotes a pair of sides of the metal plate.

Figure 4:
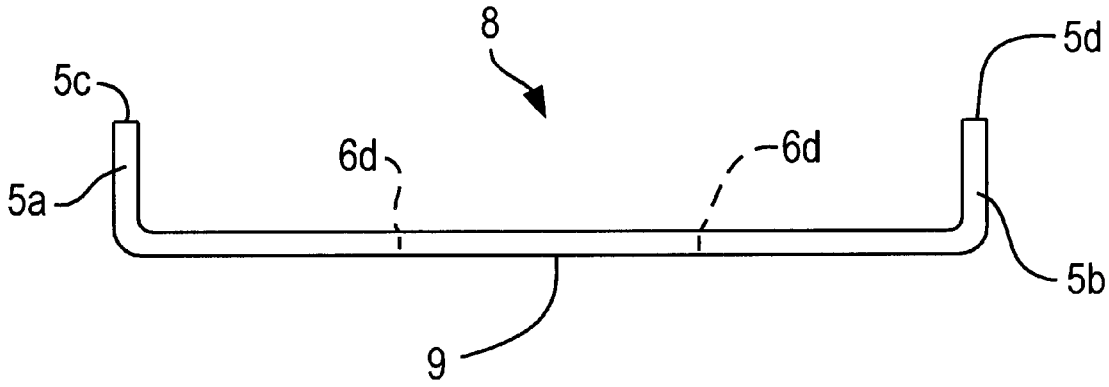
FIG. 4 is a side view of a primary intermediate product.

That is, as shown in FIG. 4, the primary intermediate product 8 is extended in the direction which the sides 6*b* and 6*b* of the wall including seams 5*a* and 5*b* are extended and faced with each other. In FIG. 4, numeral 9 is an end-bent portion.

Figure 5A:
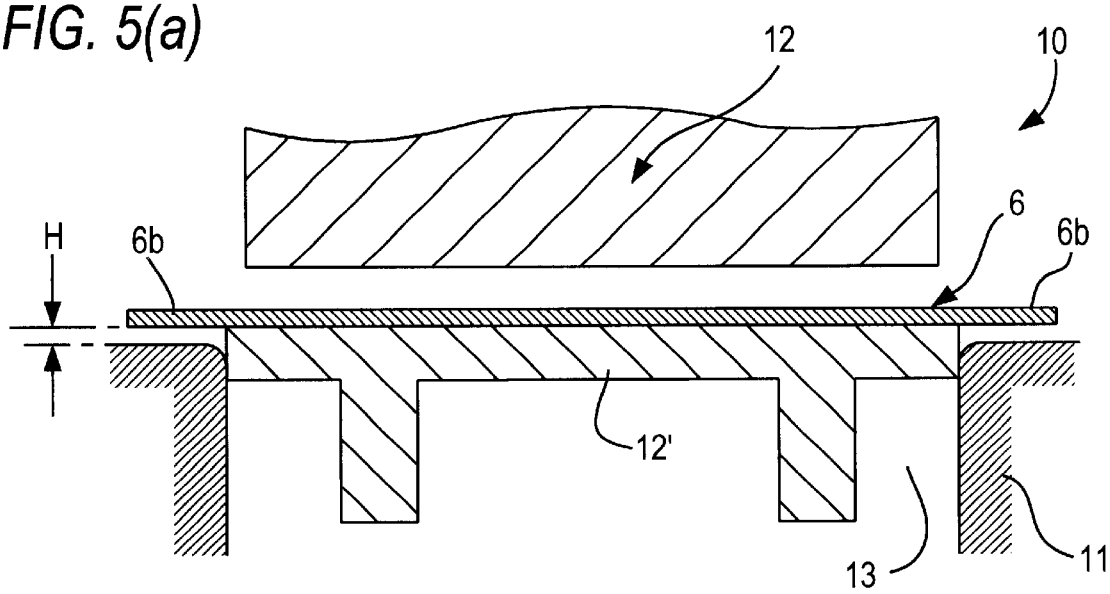
FIG. 5 is a schematic diagram showing one example of pressing apparatus used for pressing of the primary intermediate product according to the present invention, wherein FIG. 5(*a*) shows a state of mounting the metal plate on a driving plate, and FIG. 5(*b*) shows a state that the primary intermediate product is manufacturing by pressing the metal plate.
Figure 5B:
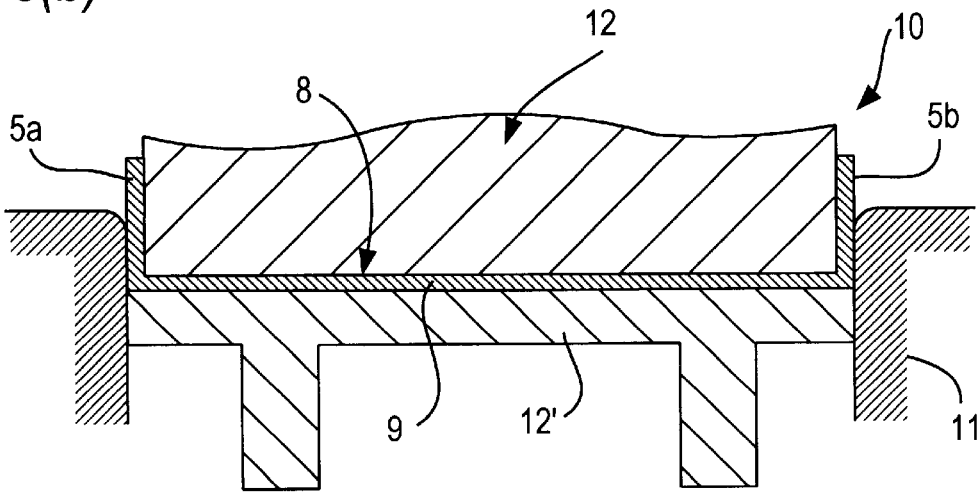

For pressing operation the primary intermediate product 8, for example, a presser 10 is used, as shown in FIG. 5(*a*). The presser 10 substantially includes a fixed plate 11, a press punching member 12 and a movable plate 12'. The movable plate 12' is slidably installed into a concave portion 13 of a fixed plate 11.

Side movable plate 12' is elastically and upwardly supported by a hydraulic pressure of a presser body (not depicted). The metal plate 6 is mounted on the movable plate 12'. Said metal plate 6 is apart from the fixed plate 11 at a distance H to be in a floating state. The press punching member 12 is placed over the movable plate 12'.

The primary intermediate product 8 makes the movement of the press punching member 12 downwardly, then the metal plate 6, between the press punching member 12 and the movable plate 12', is contacted and supported and pressed, as shown in FIG. 5(*b*).

(Secondary Intermediate Product of Using for Manufacturing the Prism Pipe Body)

Then, in the second processing step, an end-bent portion 9, of the primary intermediate product 8, is bent along the bending lines 6*d* and 6*d* depicted in FIG. 4. Therefore, the second intermediate product 14 in FIG. 6(*a*) and FIG. 7 is formed. The size of said metal plate 6 and the place of bending line are designed by estimating the degree of extension of the metal plate 6 in pressing operation.

Thus, as residual walls other than the wall including seams 5*a* and 5*b*, one specified wall 15 corresponding to the bottom wall 2 and a pair of adjoining walls 16 and 16 corresponding to the pair of side walls 3 and 4 neighboring with the bottom wall 2 are formed. The seam 5*e* of said secondary intermediate product 14 is in non-contacted state plate.

As shown and enlarged in FIG. 6(*b*), said one specified wall 15 includes flat plate 15*a* and 15*b* and a curved portion 15*c*. The curved portion 15*c* is placed between the two flat plate 15*a* and 15*b*, and the flat plate 15*a* is next to the adjoining wall 16.

The angle θ1, between said flat plate 15*a* and the adjoining wall 16, is larger than that θ (see FIG. 2) between the bottom wall 2 and a pair of side walls 3 and 4, when the prism pipe body 1 shown in FIG. 1 is completed. The angle θ is the right angle and the angle θ1 is an obtuse angle.

Figure 8:
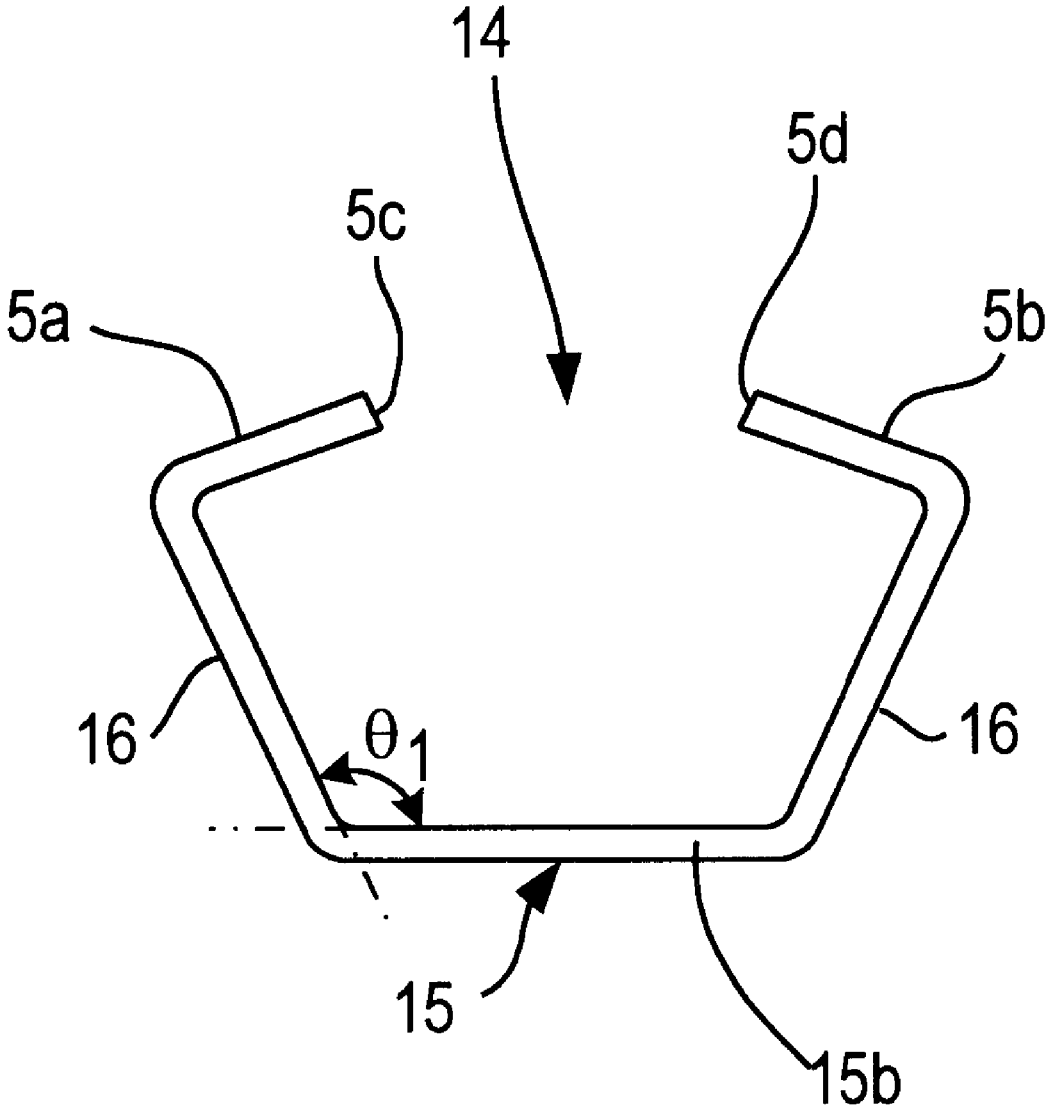
FIG. 8 is a side view showing another shape of the secondary intermediate product according to the present invention.

As shown in FIGS. 6 and 7, the curved portion 15*c* is formed on the one specified wall 15 of the secondary intermediate product 14. However, as shown in FIG. 8, the secondary intermediate product 14, in which the curved portion 15*c* is not formed, may be used to form the prism pipe body 1.

However, to establish a plane nature when forming the bottom wall 2 using a manufacture apparatus which will be illustrated below, it is rather preferable to form the curved portion 15*c* into the secondary intermediate assembling product 14. Further, when the angle θ1 is the same, the widened degree between the wall including seams 5*a* and 5*b* may be increased by forming the curved portion 15*c*.

Figure 9A:
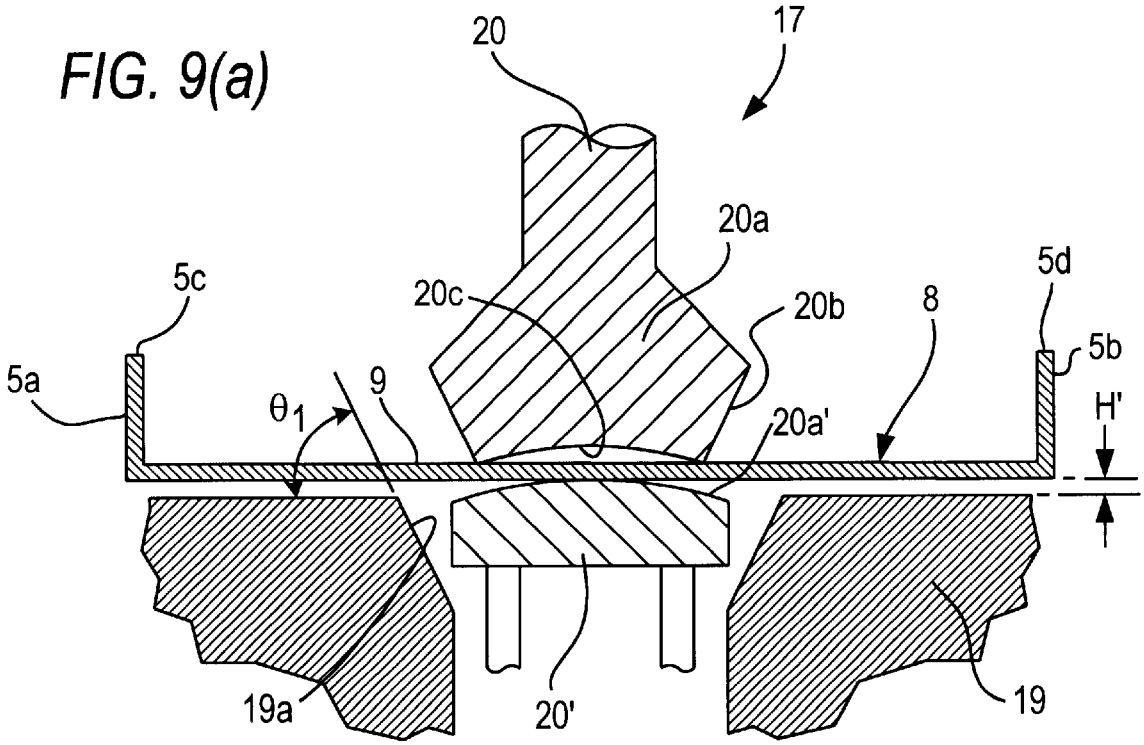
FIG. 9 is a schematic view showing one example of pressing apparatus used for pressing operation of the secondary intermediate product depicted in FIGS. 6 and 7, wherein FIG. 9(*a*) shows mounting the primary intermediate product on a driving plate, and FIG. 9(*b*) shows manufacturing of the secondary intermediate product by pressing the primary intermediate product.
Figure 9B:
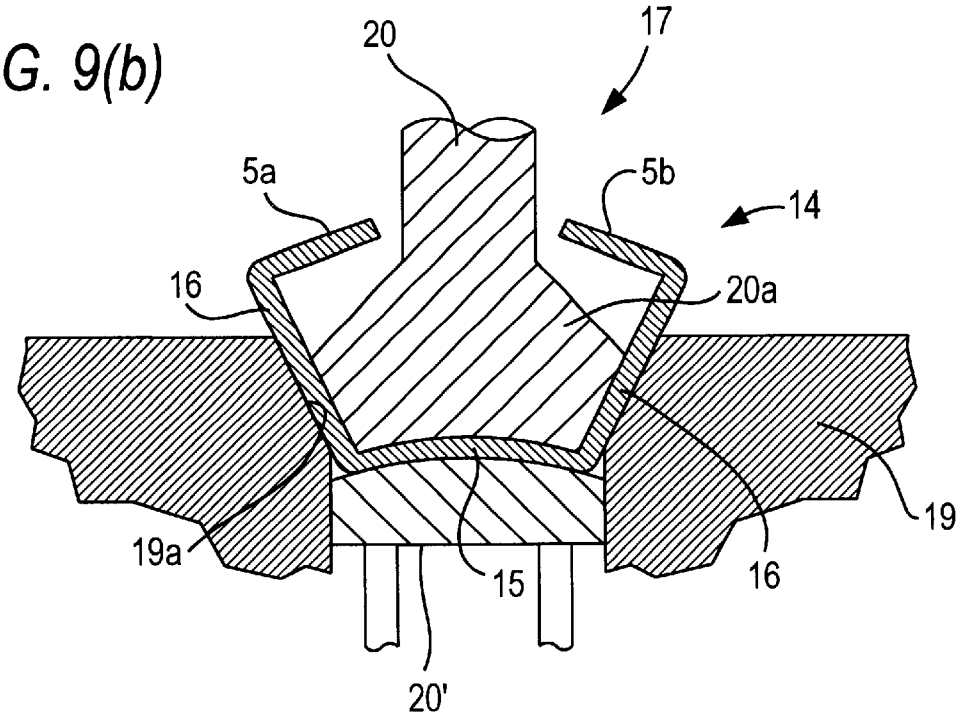

As shown in FIGS. 6 and 7, for example, the presser 17 depicted in FIG. 9(*a*) is used for pressing operation the secondary intermediate product 14. The presser 17 substantially includes a fixed plate 19, press punching member 20 and a movable plate 20'. The movable plate 20' is slidably installed into an concave portion of the fixed plate 19 and is elastically and upwardly supported by a hydraulic pressure of a presser (not depicted).

A circumferential wall 19*a* of the concave portion of said fixed plate 19 is tapered shaped. The angle between the circumferential wall 19*a* of the concave portion and the upper surface of the fixed plate 19 is almost the same angle θ1. The press punching member 20 has a punching portion 20*a*. A circumferential wall 20*b* of the punching portion 20*a* has a shape corresponding to the circumferential wall 19*a* of the concave portion.

A bottom surface of the punching portion 20*a* is upwardly concave shaped to form a shape of the one specified wall 15 of the secondary intermediate product 14. An upper surface 20*a'* of the movable plate 20' is upwardly convex shaped corresponding to the bottom surface of the punching portion 20*a*.

The primary intermediate product 8 is mounted on the movable plate 20' and is apart from the fixed plate 19 at a distance H' to be in a floating state. By downwardly moving the press punching member 20, the one specified wall of the primary intermediate product 14 is contacted and supported and then pressed between and by the movable plate 20', and the press punching member 20, as shown in FIG. 9(*b*), such that the secondary intermediate product 14 is formed.

After upwardly raising the press punching member 20, the secondary intermediate product 14 is taken out of the concave portion 16. Then, the secondary intermediate product 14 is drawn out the press punching member 20 lengthwise right angle to the ground, and is separated from the press punching member 20. When the secondary intermediate product 14 depicted in FIG. 8 is manufactured, a presser 17, having the bottom surface 20*c* of the punching portion 20*a* and the upper surface 20*a'* of the movable plate 20' which are flat, is used as shown in FIG. 10.

Figure 10:
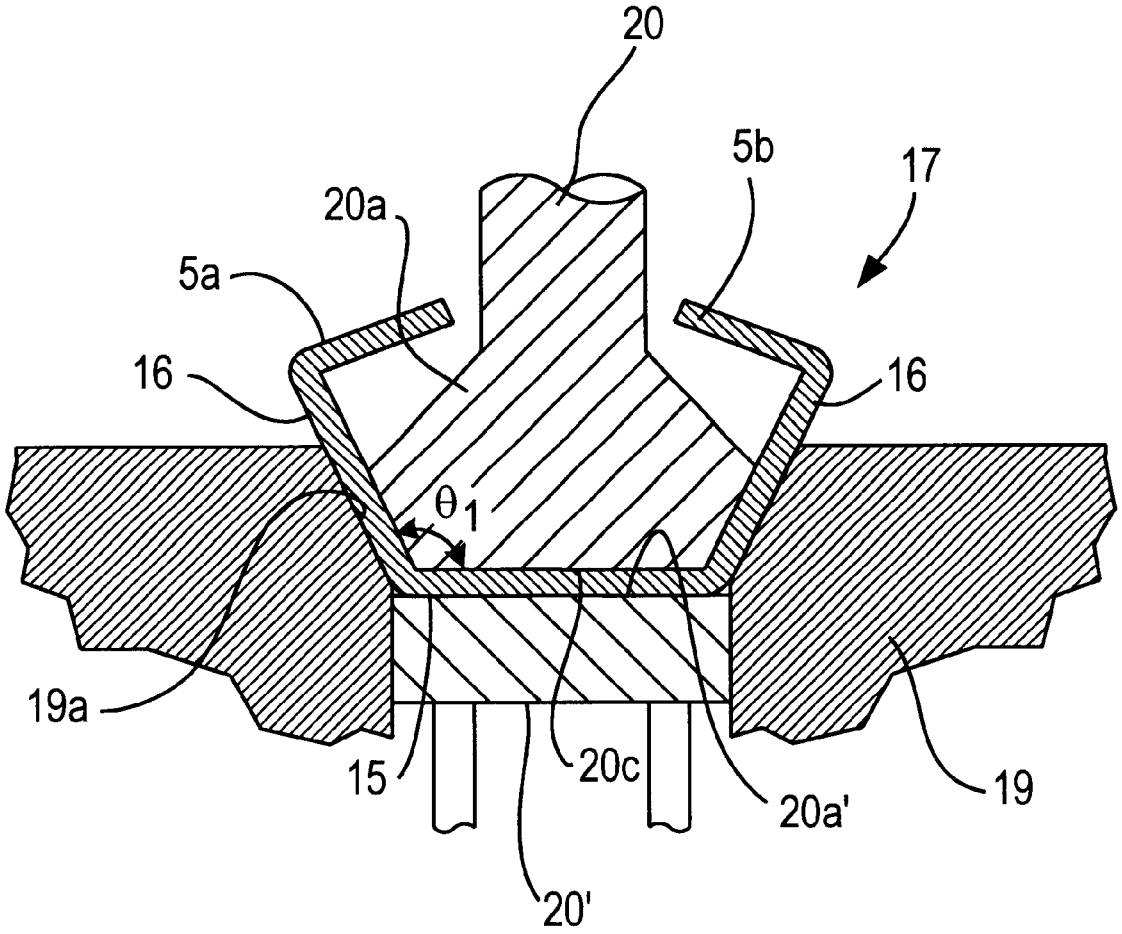
FIG. 10 is a schematic view showing one example of pressing apparatus for pressing operation of the secondary intermediate product depicted in FIG. 8.

In the presser 17 depicted in FIGS. 9 and 10, it is impossible to separate the secondary intermediate product 14 from the press punching member 20 without taking the secondary intermediate product 14 out of the press punching member 20.

Figure 11A:
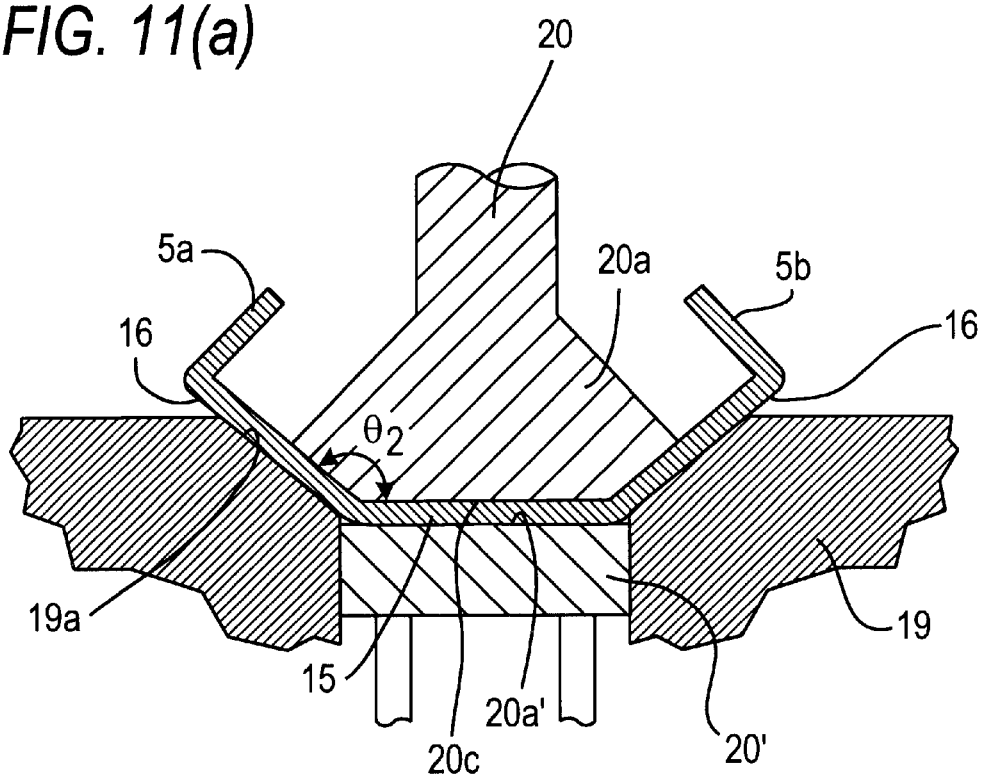
FIG. 11(*a*) is a schematic view showing another example of the pressing apparatus depicted in FIG. 10, and FIG. 11(*b*) is a schematic view showing another example of the pressing apparatus depicted in FIG. 9.
Figure 11B:
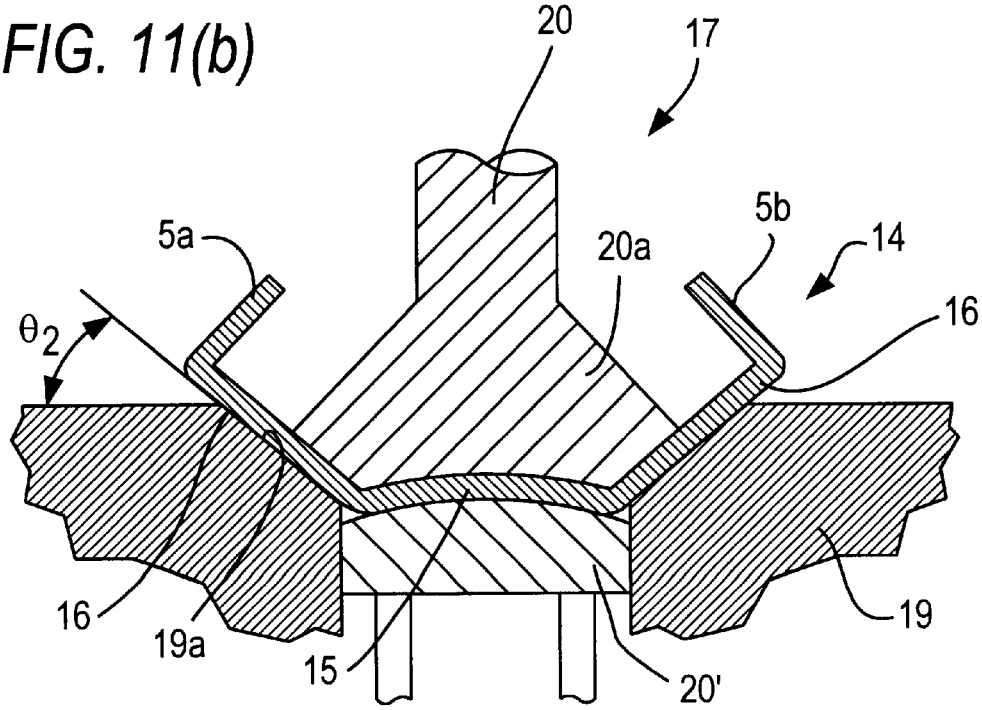

However, as shown in FIGS. 11(*a*) and 11(*b*), if the angle θ2, between the adjoining wall 16 of the secondary intermediate product 14 and the one specified wall 15, is greater than that angle θ1, between the adjoining wall 16 of the secondary intermediate product 14 and the one specified wall 15 depicted in FIGS. 6 and 7, by only raising the press punching member 20, the secondary intermediate product 14 can be separated from the press punching member 20.

Therefore, in case of the secondary intermediate product 14 depicted in FIG. 11, it is possible to omit the process of taking the secondary intermediate product 14 out of the press punching member 20 lengthwise thereof. According to the secondary intermediate product 14 depicted in FIG. 11, the improvement in efficiency of pressing is accomplished.

Figure 12:
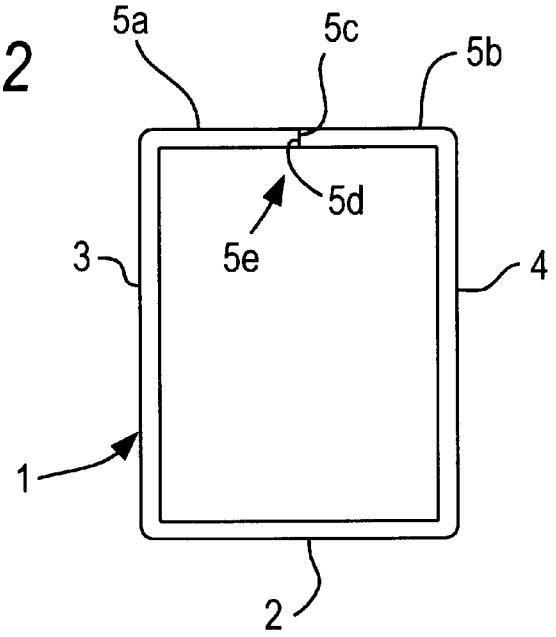
FIG. 12 is a explanatory view illustrating a pipe body according to the present invention whose cross section is rectangular.

Hereinafter, the cross second of the pipe body 1 which has a shape of perfect square will be described. However, when the cross section has a shape of rectangle, as depicted in FIG. 12, the length of the adjoining wall 16 corresponding to the lengthwise side of rectangle is increased, and the widened degree of a pair of wall including seams 5*a* and 5*b* of the upper wall 5 corresponding to the short side of rectangle is increased. Therefore, the secondary intermediate product 14 may be separated from the press punching member 20 by only raising the press punching member 20 when the angle between the adjoining wall 16 of the secondary intermediate product 14 and the one specified wall 15 is even at the angle of θ1.

[Example 1 of Apparatus for Manufacturing the Prism Pipe Body]

Figure 13:
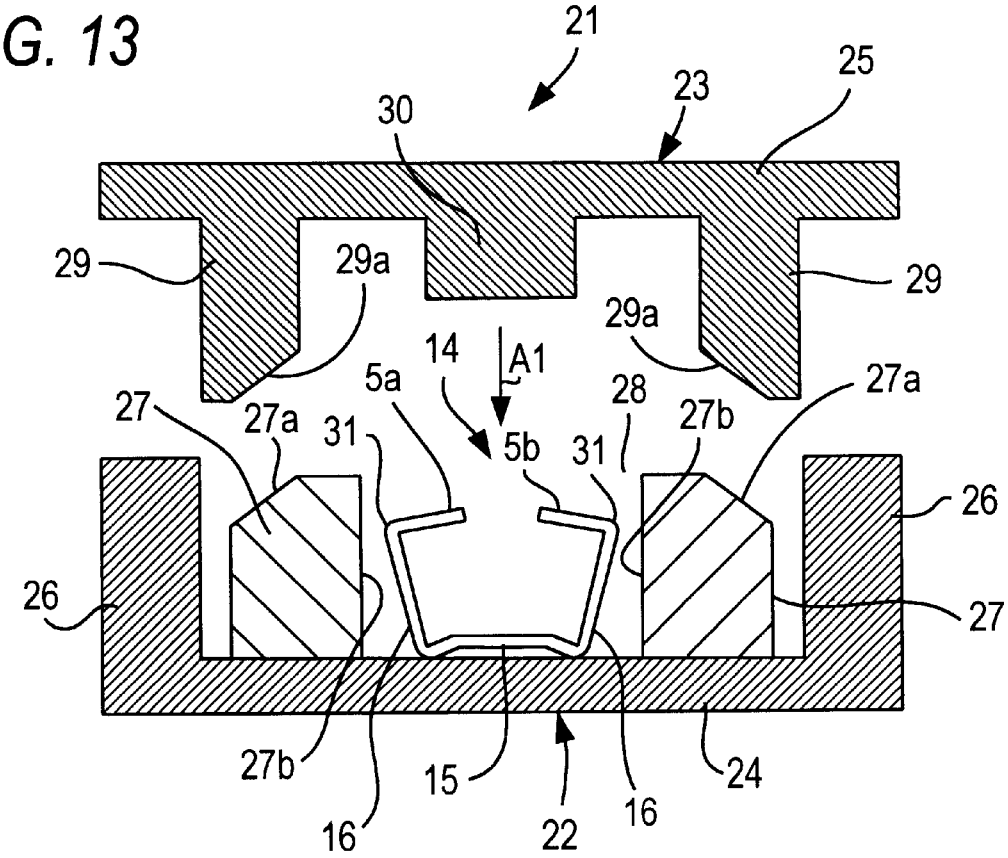
FIG. 13 is a schematic diagram showing example 1 of the apparatus applied to a method of manufacturing pipe body according to the present invention and shows the secondary intermediate product set at the apparatus depicted in FIG. 6.

Then, said secondary intermediate product 14 is set at the press forming apparatus (a body of apparatus) 21 depicted in FIG. 13 to form the prism pipe body 1 as a finished product.

Said press forming apparatus 21 includes a lower mold (fixed mold) 22 and an upper mold (movable mold) 23. The lower mold 22 has a fixed plate 24, and the upper mold 23 has a movable mold 25. A pair of stopper members 26 and 26 and a pair of press punching members 27 and 27 are installed at the fixed plate 24, respectively.

The press punching members 27 and 27 are slidably mounted on a sliding rail (not shown), and is elastically supported by a spring member not depicted in a direction away from each other. The press punching members 27 and 27 are moved on the sliding rail being away from or approaching each other. The secondary intermediate product 14 depicted in FIG. 7 is set at an opposite space 28 of the press punching members 27 and 27 to allow the one specified wall 15 to look downward.

Driving members 29 and 29 for driving the press punching members 27 and 27 and a press punching member 30 for pressing the pair of wall including seams 5*a* and 5*b* are attached to the movable plate 25, respectively.

Taper portions 29*a* and 29*a* are formed at a lower end portion of said driving members 29 and 29. Taper portions 27*a* and 27*a* are formed at an upper end portion of driving the press punching members 27 and 27 and engaging into the taper portions 29*a* and 29*a*.

Figure 14:
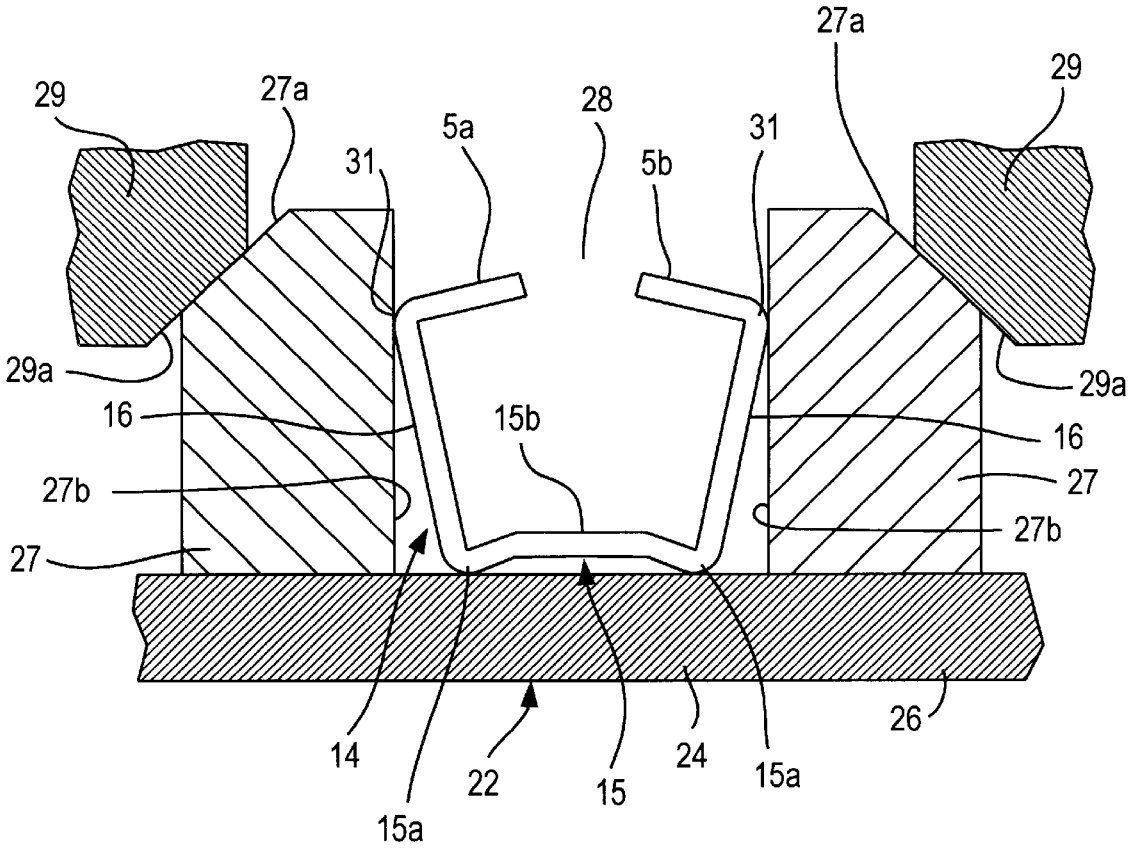
FIG. 14 is a partial enlarged view showing a punching member of side wall former contacting at a bent portion of the secondary intermediate product depicted in FIG. 6.

The state of the secondary intermediate product 14 is set in the faced space 28 with the lower mold 24 and the upper mold 25 being away from each other is shown in FIG. 13. When the upper mold 23 moves down along the direction of an arrow A1, the taper portions 29*a* and 29*a* of the driving members 29 and 29 are engaging into the taper portions 27*a* and 27*a* of the press punching members 27 and 27, as shown in FIG. 14. Thus, the press punching members 27 and 27 are moved in a close direction to each other.

Then, punching surfaces 27*b* and 27*b* of the press punching members 27 and 27 come in contact with a curved portion 31 of the wall including seams 5*a* and 5*b* and the adjoining wall 16 and 16, such that a pair of adjoining walls 16 and 16 is pressed by an external force in a close direction to each other. That is, the press punching members 27 and 27 take part of side walls forming punching member forming side walls by contacting with the adjoining walls 16 and 16.

Figure 15:
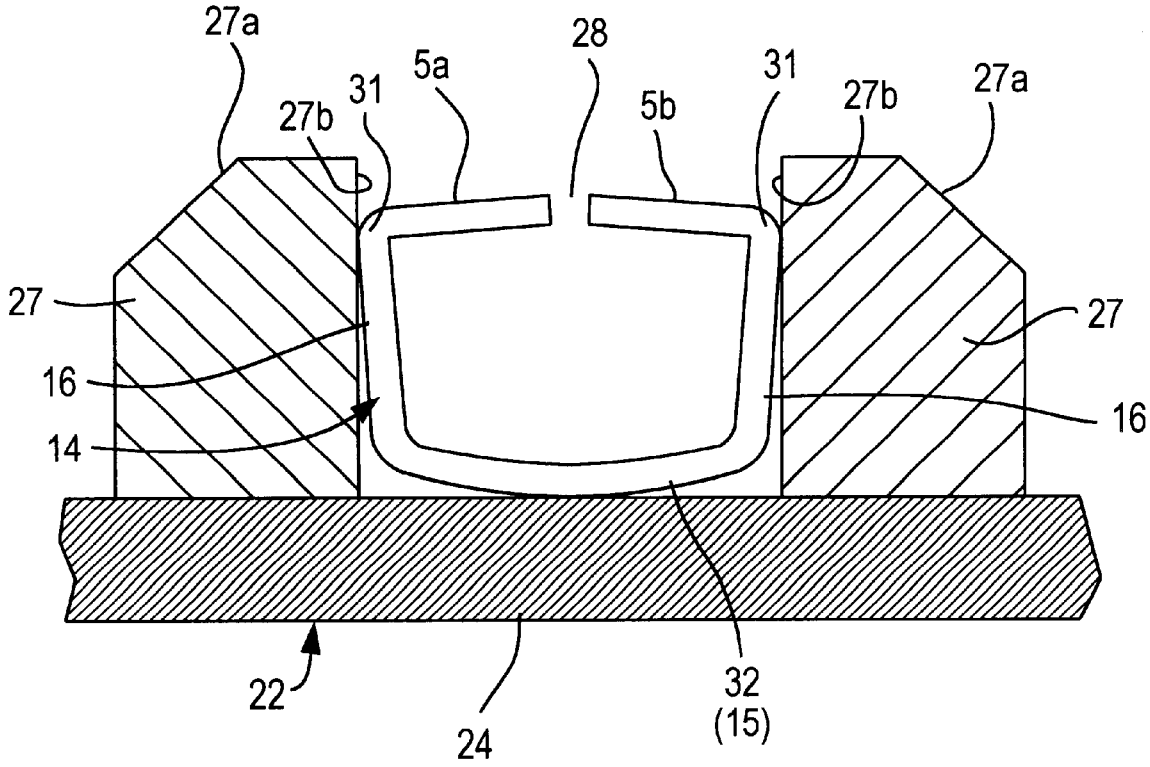
FIG. 15 is a partial enlarged view showing convex portion formed on one specified wall of the secondary intermediate product depicted in FIG. 6.

The press punching members 27 and 27 are moved in the near direction to each other. Thus, the curved portion 31 depicted in FIG. 15 is slid into an upper side of the punching surfaces 27*b* and 27*b*. A pair of walls 16 stands up, and at the same time, the one specified wall 15 downwardly swells up toward an outside to have convex curved surface 32.

Figure 16:
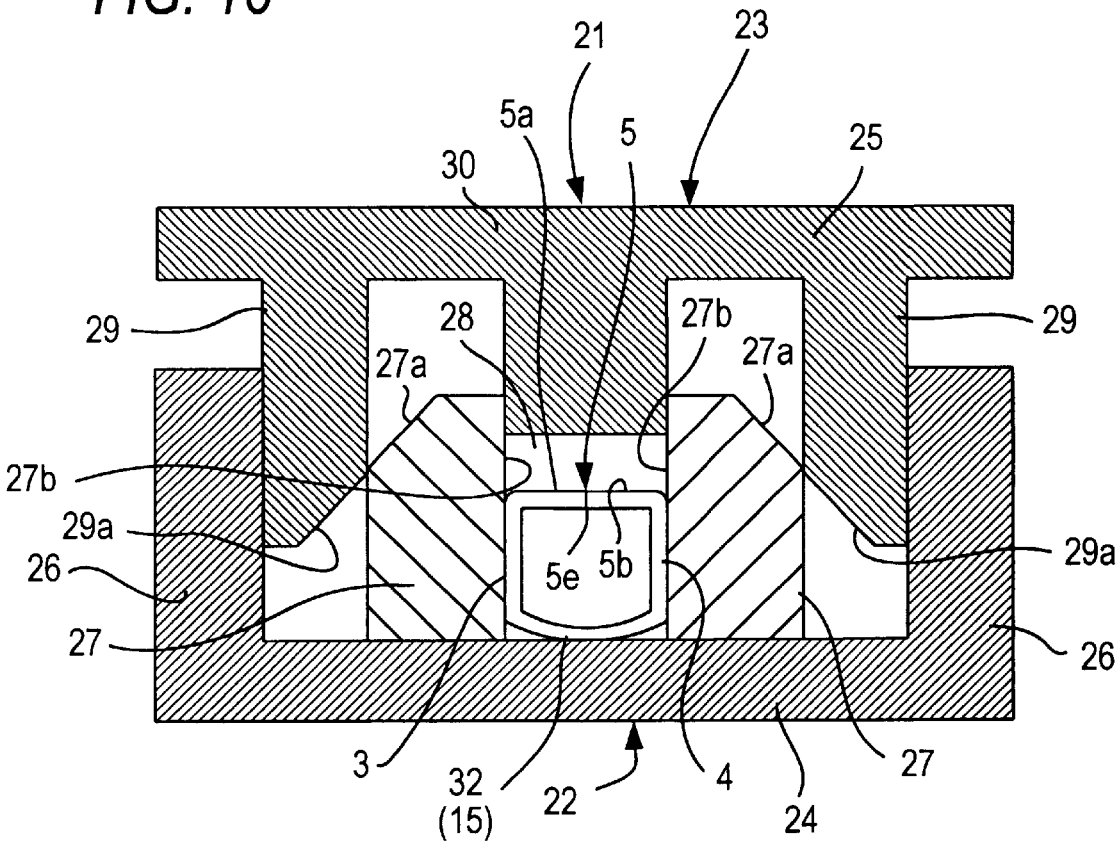
FIG. 16 is a view showing a pair of side walls with an adjoining wall standing to form the secondary intermediate product depicted in FIG. 6.

When the upper mold 23 has fallen down more, the state of the taper portions 27*a* and 27*a* of the press punching members 27 and 27 and the taper portions 29*a* and 29*a* of the driving members 29 and 29 which are engaging into each other is released. As a result, as shown in FIG. 16, the driving of the press punching members 27 and 27 is interrupted. Thus, the ends of the wall including seams 5*a* and 5*b* are close to each other to form the upper wall 5 to which the seam 5*e* is close, and at the same time, a pair of side walls 3 and 4 are formed.

Figure 17A:
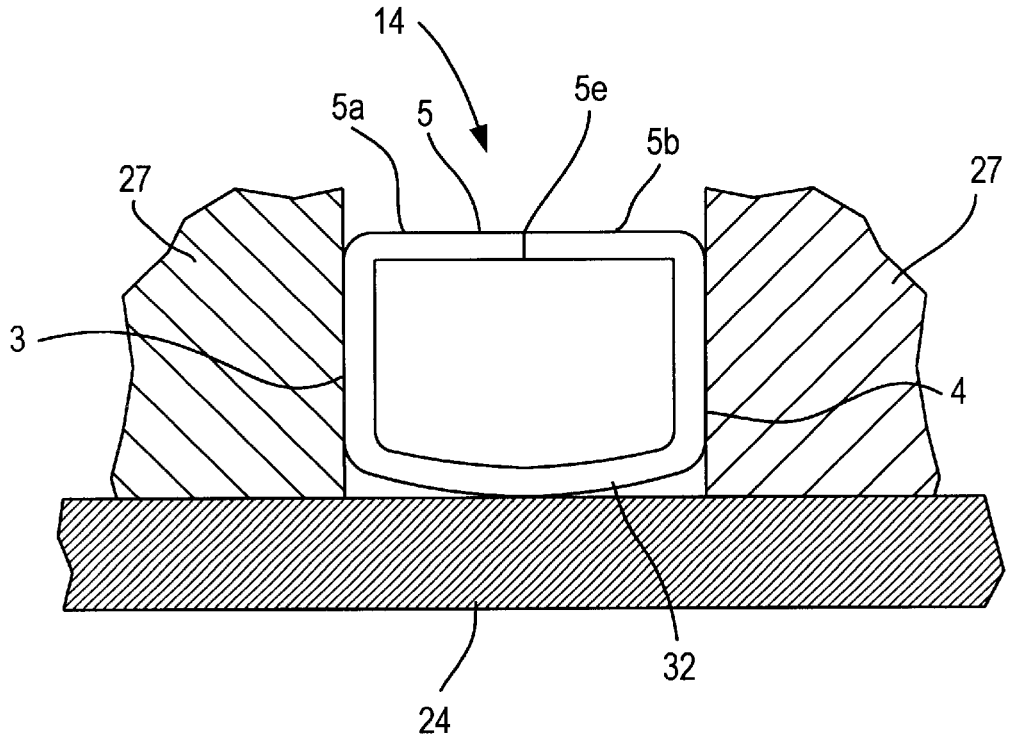
FIG. 17 is views illustrating a degree of opening of the seam of the secondary intermediate product by a spring back force generated at a pair of side walls, wherein FIG. 17(*a*) shows the secondary intermediate product with close contacted seam, and FIG. 17(*b*) shows that with open seam by the spring back force generated at the pair of side walls.
Figure 17B:
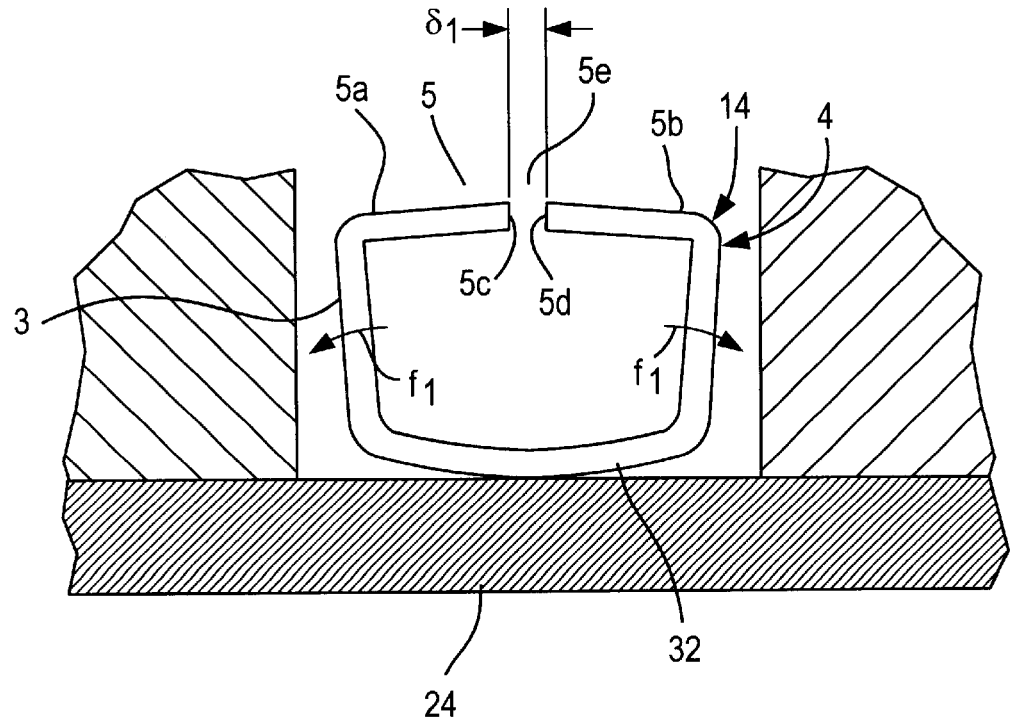

This is the third processing step. In the third processing step, the press punching member 30 is not yet in contact with the pair of side walls 5*a* and 5*b*. The secondary intermediate product 14, having the upper wall 5 in which a pair of side walls 3 and 4 and the seam 5*e* are close to each other, is shown in FIG. 17*a*. In the above state, when the press punching members 27 and 27 are moved in the direction away from each other, as shown FIG. 17(*b*), the end surfaces 5*c* and 5*d* of the wall including seams 5*a* and 5*b* are separated from a pair of side walls (a pair of adjoining walls) 3 and 4 by a spring back force f1 and f1 which is generated by a pair of side walls 3 and 4. Thus the seam 5*e* is opened. An degree of opening of the seam 5*e* is called δ1.

Figure 18:
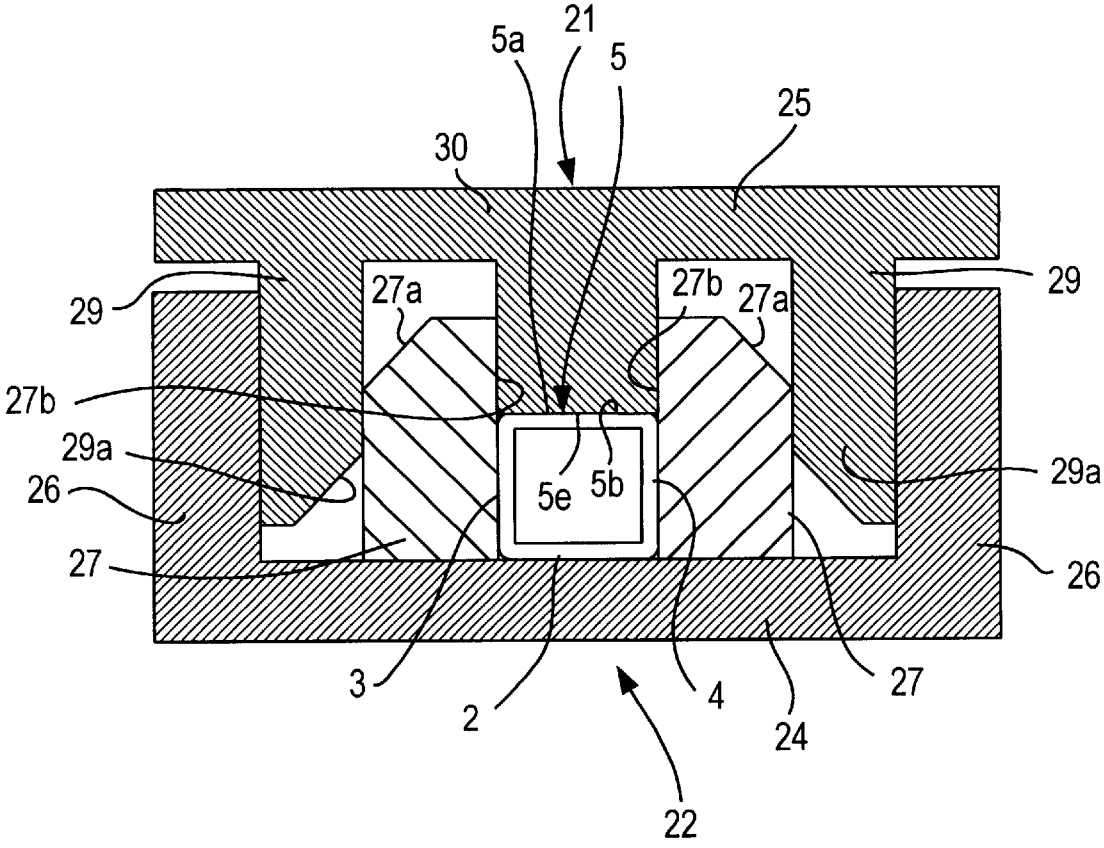
FIG. 18 shows a pipe body formed by the apparatus depicted in FIG. 13.

Then, as shown in FIG. 18, after interrupting the driving of the pair of press punching members 27 and 27, the upper mold 23 is caused to be continuously dropped down to a state of maintaining the pressure applied to the side walls 3 and 4. Then, the press punching member 30 comes in contact with a pair of wall including seams 5*a* and 5*b*, such that the wall including seams 5*a* and 5*b* are pressed. The convex-curved surface 32 is modified and planed by the fixed plate 24 to which a repelling power developed by the pressure of the press punching member 30 is applied, so the bottom wall 2 is formed. This pressing step is the fourth processing step.

The press punching member 30 fulfills a function of pressing the wall including seams 5*a* and 5*b* and one specified wall 15 as the press punching member of the wall including seam.

Then, when the upper mold 23 is raised, the press punching member 30 becomes more distant from a pair of wall including seams 5*a* and 5*b*. At the same time, the fitting and fastening between the driving members 29 and 29 and the press punching members 27 and 27 are released. The press punching members 27 and 27 are moved in the direction away from each other, so the prism pipe body 1 is formed, as shown in FIGS. 1 and 2.

Figure 19:
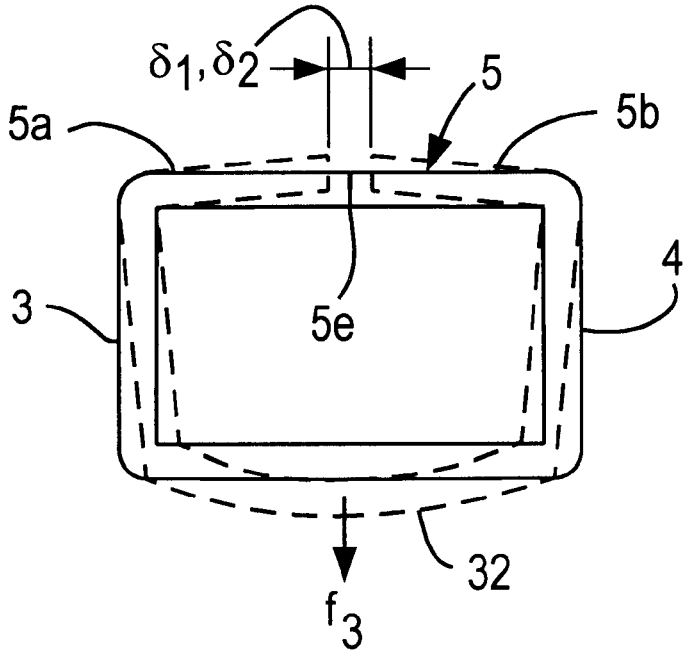
FIG. 19 is a view illustrating an operation of the pipe body depicted in FIG. 18.

FIG. 10 illustrates the operation of the prism pipe body 1 formed as above. As shown in FIG. 19, a spring back force f3 is applied to the lower assembling member 2 of the prism pipe body 1 to be restored to the convex-curved surface 32 denoted by broken lines.

Thus, a force is applied to the wall including seams 5*a* and 5*b* in a direction (closing direction) of approaching each other. When a degree of closing δ2 of the seams 5*e* of the spring back force f3 is set greater than the degree of opening δ1 of the seams 5*e* of the spring back force f1, an external force applied to the side walls 3 and 4 by the press punching members 27 and 27 is removed. The state of the seams 5*e* adhering closely to each other maintained.

Figure 20:
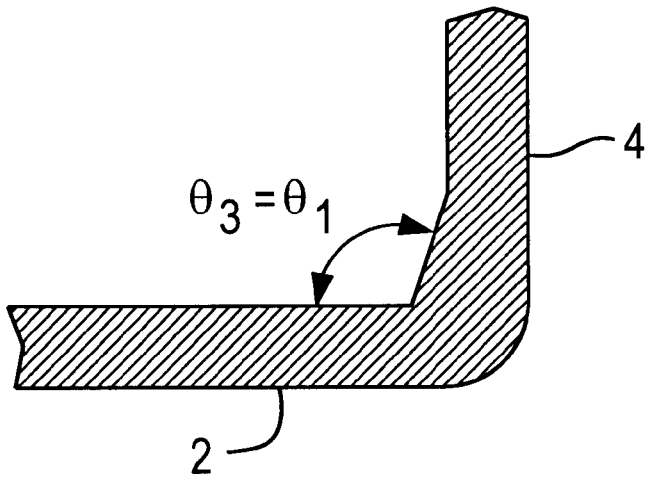
FIG. 20 is a partial enlarged view illustrating an angle of corner portion of the pipe body formed by the pressing apparatus depicted in FIG. 18.

The angle θ3, between an inner surface of an corner of the bottom wall 2 and each inner surface of corner of the side walls 3 and 4 of the prism pipe body 1 (the angle between the flat part 15*a* and each of the side walls 3 and 4) is maintained in the angle θ1, between the one specified wall 15 and the adjoining wall 16 of the secondary intermediate product 14, as depicted and enlarged in FIG. 20, by hardening the form of the secondary intermediate product 14.

(Stress Distribution Analysis of the Prism Pipe Body)

Figure 95:
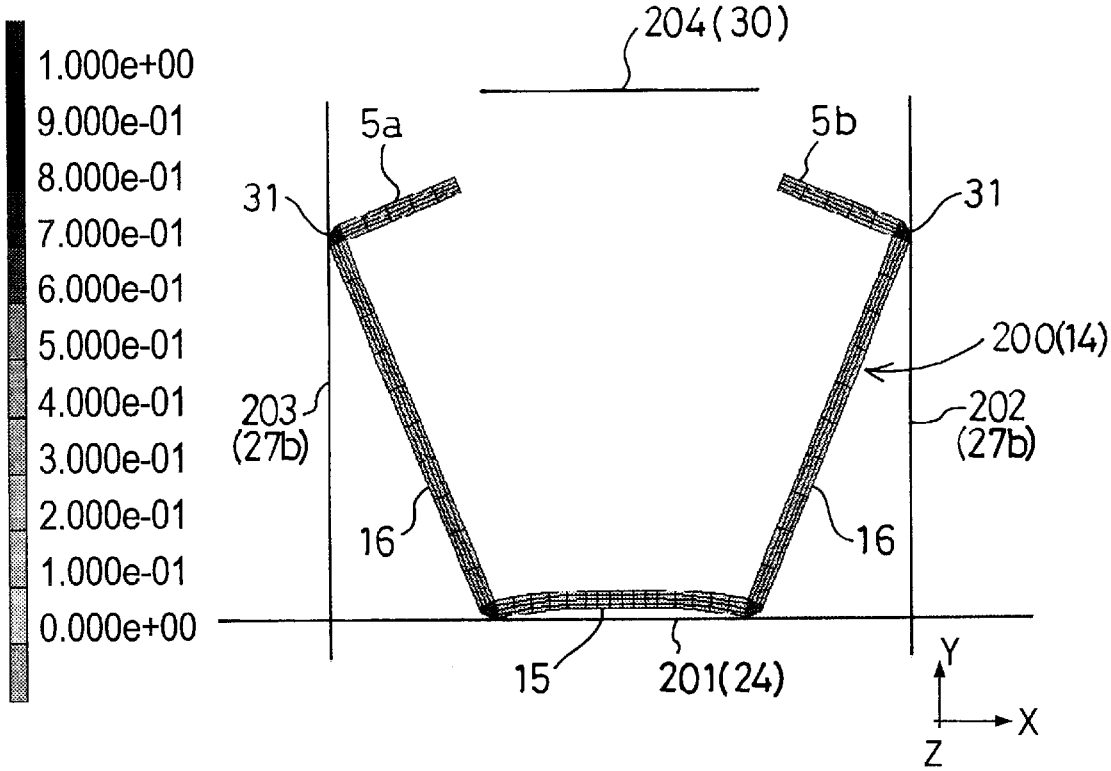
FIG. 95 is a view showing a shell element used for stress distortion analysis with a pair of rigid bodies contacting the bent portion of it.

FIG. 95 shows a shell element 200 used in an analysis model of a stress distortion. The shell element 200 corresponds to the shape of an end of the secondary intermediate product 14. The thickness of metal plate for using the secondary intermediate product 14 is 1.2 mm, and after completion, the external dimension of the prism pipe body 1 is 30 mm×20 mm.

Reference numeral 201 is a rigid body corresponding to the fixed plate 24, reference numerals 202 and 203 are rigid bodies corresponding to the punching surfaces 27*b* and 27*b*, and reference numeral 204 is a rigid body corresponding to the press punching member 30. Regarding to each portion of the composed the shell element 200, the same reference numerals regarding them for each portions of the secondary intermediate product 14 are used.

For the stress distribution analysis of the prism pipe body 1, a limited mediocre element program (MARC K6.3) for non-linear structure analysis has been used.

The physical properties of the shell element 200 are as follows:

Young's modulus: 2.068×1011 (N/mm)

Poisson's ratio: 0.29

Density: 7.82×103 (kg/m3)

Yield ratio: 2.48×108 (Pa).

Further, a residual stress remains in the secondary intermediate product 14, but the residual stress is not considered in the present description.

FIG. 95 shows a state just after causing the rigid bodies 202 and 203 to come in contact with curved part 31 and 31. Assuming that the axis X is horizontal, the axis Y is vertical and the transport quantity of the rigid bodies 202 and 203 is "0".

Figure 96:
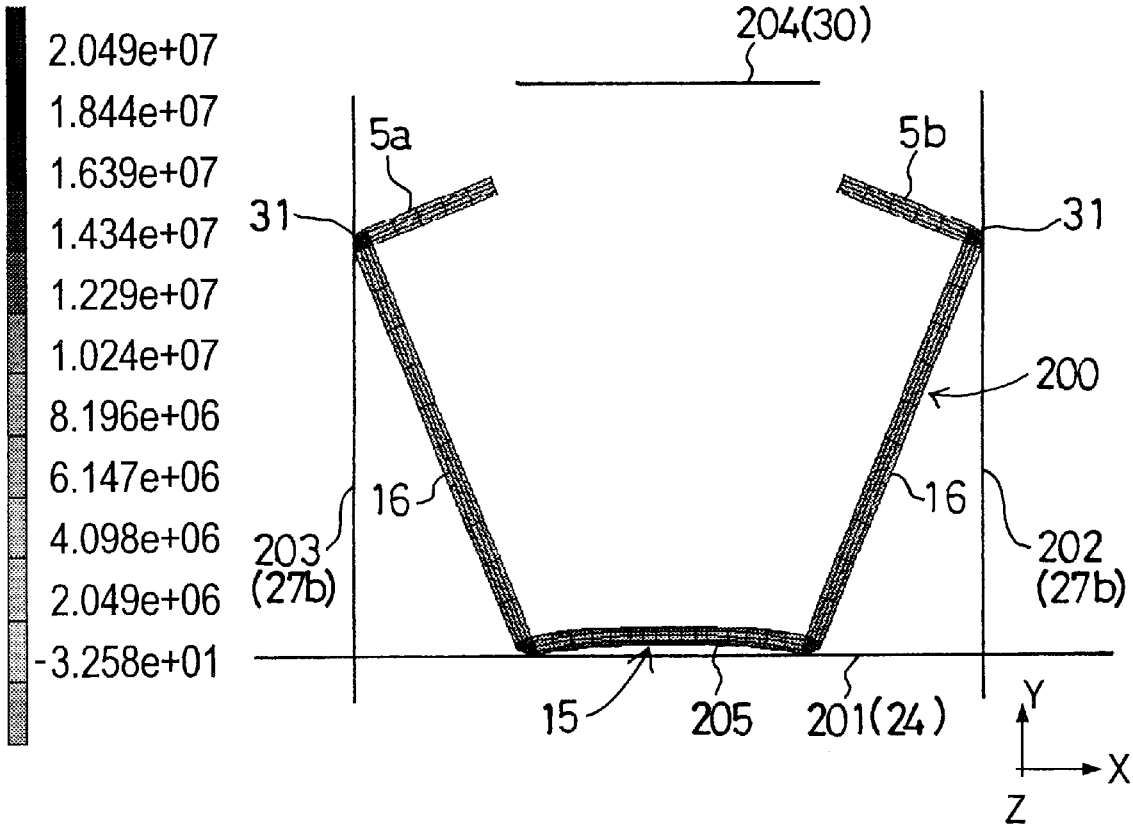
FIG. 96 is an explanatory view of stress distortion generated on one specified wall corresponding to the bottom wall by slight movement of a pair of rigid bodies in approaching direction.

The state of causing the rigid bodies 202 and 203 to approach each other within 0.05 mm respectively is shown in FIG. 96. A stress distortion is concentrated into an area of the one specified wall 15 of the secondary intermediate product 14, and the range thereof is about 6.147×10 [6]–1.434×10 [7] (Pa). The stress distortion is low at the upper side, the curved parts 31 and 31, a pair of wall including seams 5*a* and 5*b* of a pair of adjoining walls 16.

Figure 97:
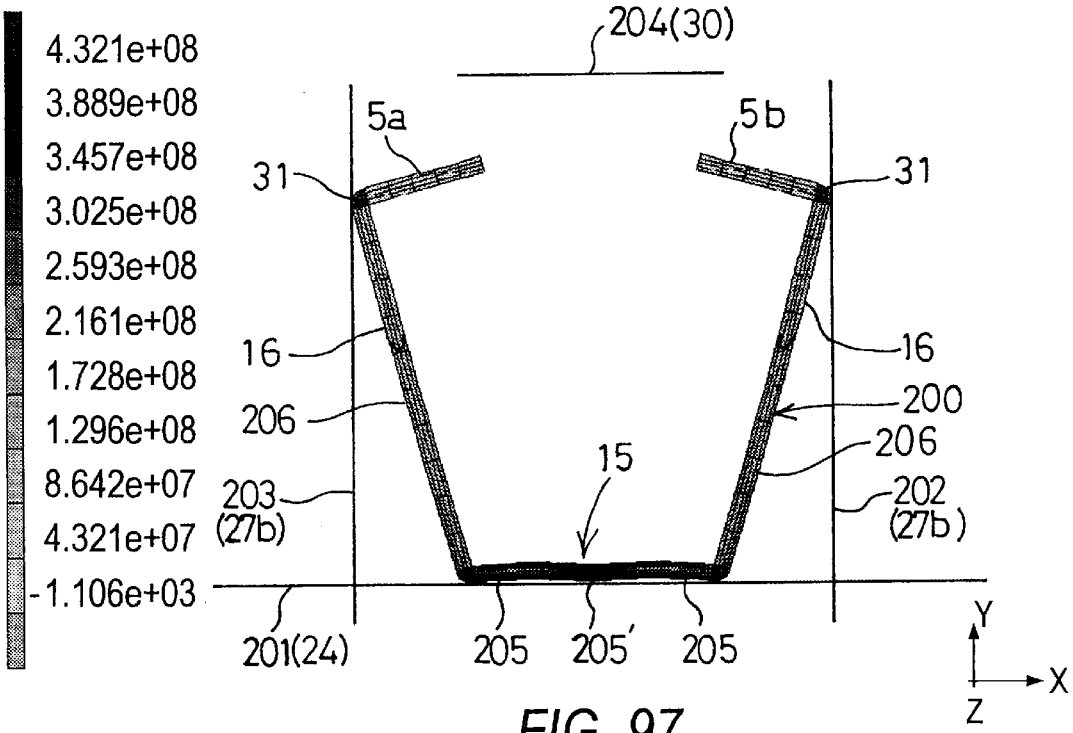
FIG. 97 is an explanatory view of one specified wall corresponding to the bottom wall deformed almost flat by further movement of the pair of rigid bodies in approaching direction.

Further, when the rigid bodies 202 and 203 are caused to approach each other within 3 mm respectively, the one specified wall 15 is modified to be planed by the stress distortion, as shown in FIG. 97. At this time, the stress distortion being generated at the area 205 of the one specified wall 15 is about 3.025×10 [8]–4.321×10 [8] (Pa). The greatest stress distortion is generated at the central portion of the one specified wall 15 and is about 3.899×10 [8]–4.32110 [8] (Pa). The stress distribution, about 4.321×10 [8]–2.593×10 [8] (Pa), has been upwardly generated at a lower area 206 of the pair of adjoining wall 16 which forms a lower portion.

Figure 98:
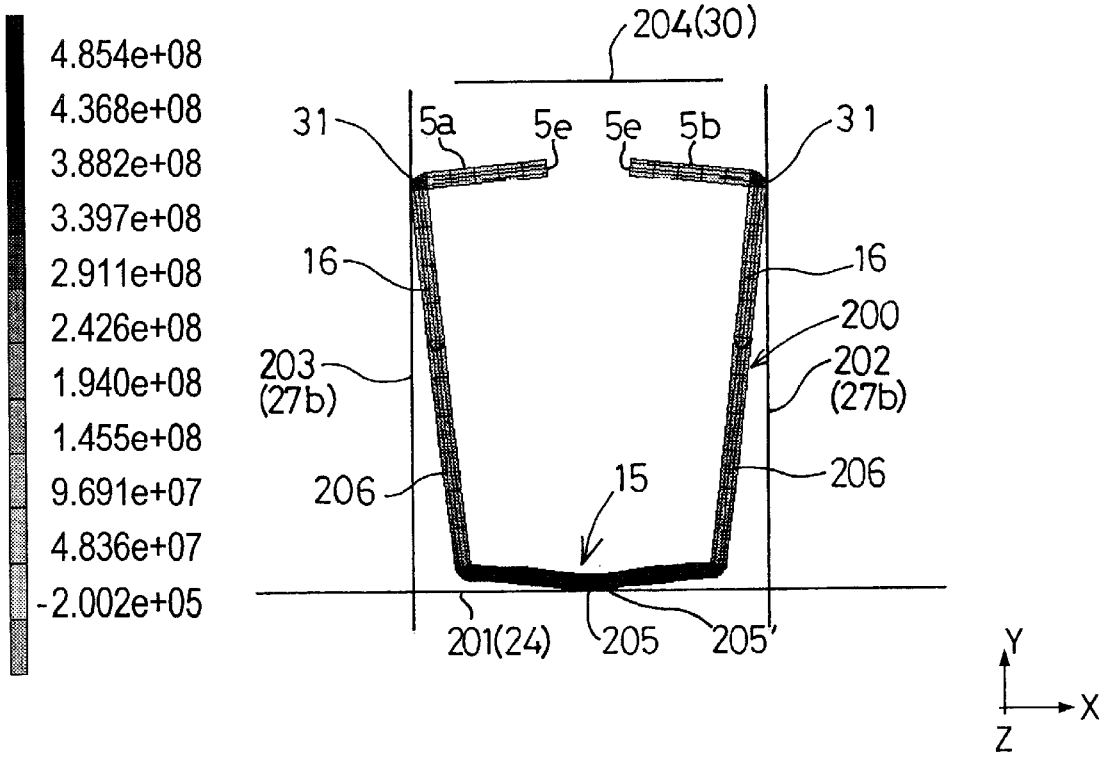
FIG. 98 is an explanatory view of one specified wall corresponding to the bottom wall deformed convex outside by still further movement of the pair of rigid bodies in approaching direction.

Further, when the rigid bodies 202 and 203 are caused to approach within 7.5 mm, respectively, the one specified wall 15 becomes convex toward outer direction, as shown in FIG. 98. At this time, the stress distortion of about 3.882×10 [8]–4.854×10 [8] (Pa) is generated substantially and equally at the area 205, but, the greatest stress distortions are generated at inner and outer sides of the central area 205'. The value of stress distortion at the area 206 shown in FIG. 98 is almost equal to that at the area 205 of the secondary intermediate product 14 which is at the state shown in FIG. 97.

Figure 99:
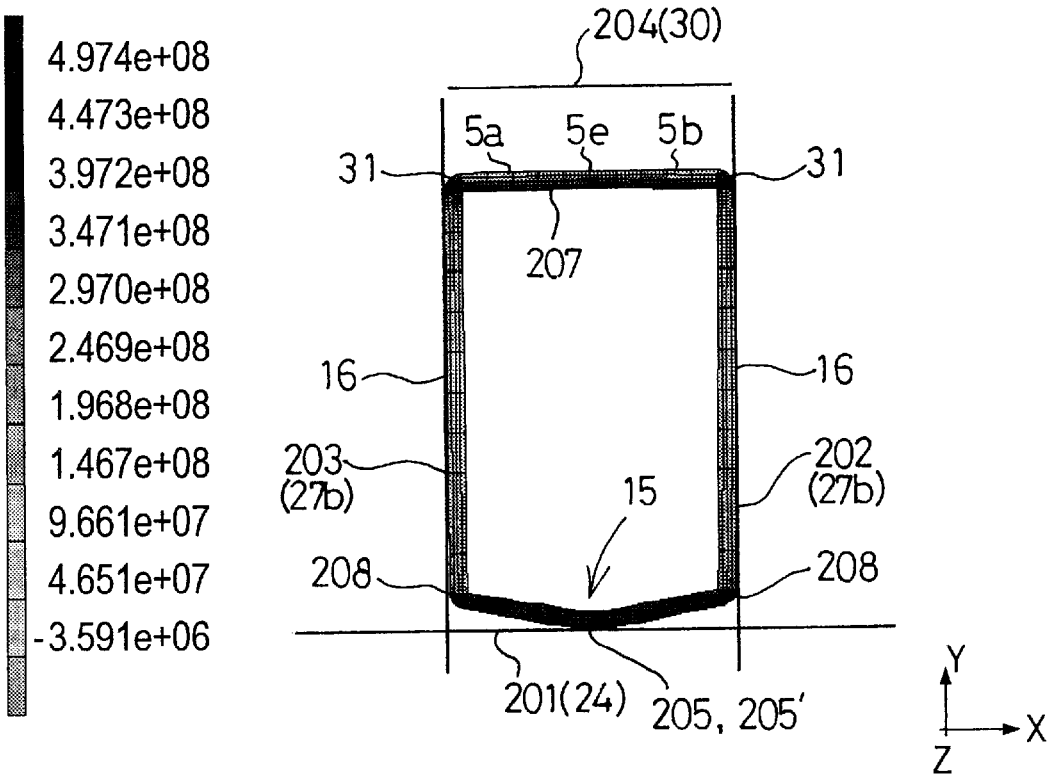
FIG. 99 is a view showing a wall including seam closed by still further movement of the pair of rigid in approaching direction.

When the rigid bodies 202 and 203 are caused to approach by both 10.45 mm respectively, the rigid bodies 202 and 203 come in contact with the seam 5*e* of a pair of wall including seams 5*a* and 5*b,* as shown in FIG. 99. At this time, the stress distortion, 3.974×10 [8]–4.974×10 [8] (Pa), is equally generated at the area 205. The stress distortion at the inner and outer sides of the area 205' is greater than that of the range at the area 205. Also, the stress distortion at the area of the pair of wall including seams 5*a* and 5*b* is in a range of 1.968×10 [8]–4.473×10 [8] (Pa). At this time, the movement of rigid bodies 202 and 203 is stopped.

Figure 100:
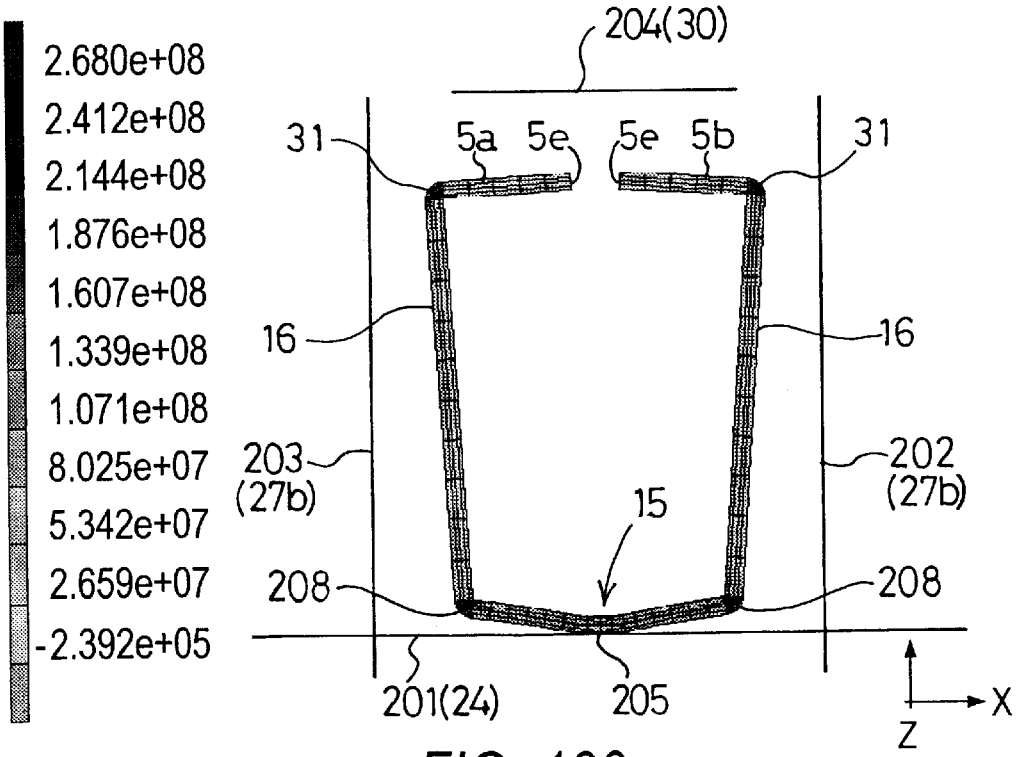
FIG. 100 is a view showing the wall including seam tending to open when the pair of rigid bodies of FIG. 99 moves in separating direction.

At a point in time shown in FIG. 99, FIG. 100 shows a state that the rigid bodies 202 and 203 are transferred in a direction to be apart from each other at 5 mm. Thus, the seam 5*e* is open. This is the reason that the stress distortion generated at the area 205 is reduced.

Comparing FIG. 99 with FIG. 100, the convex shape, of the one specified wall 15 which is formed by plastic deformation of the one specified wall 15 corresponding to the bottom wall 2, is maintained. Therefore, it is estimated that the seam 5*e* is opened by the stress distortion which remains at the corner 208 between the adjoining wall 16 and the one specified wall 15.

A residual stress distortion remaining at the area 205 is about 8.025×10 [7]–1.607×10 [8] (Pa).

Figure 101:
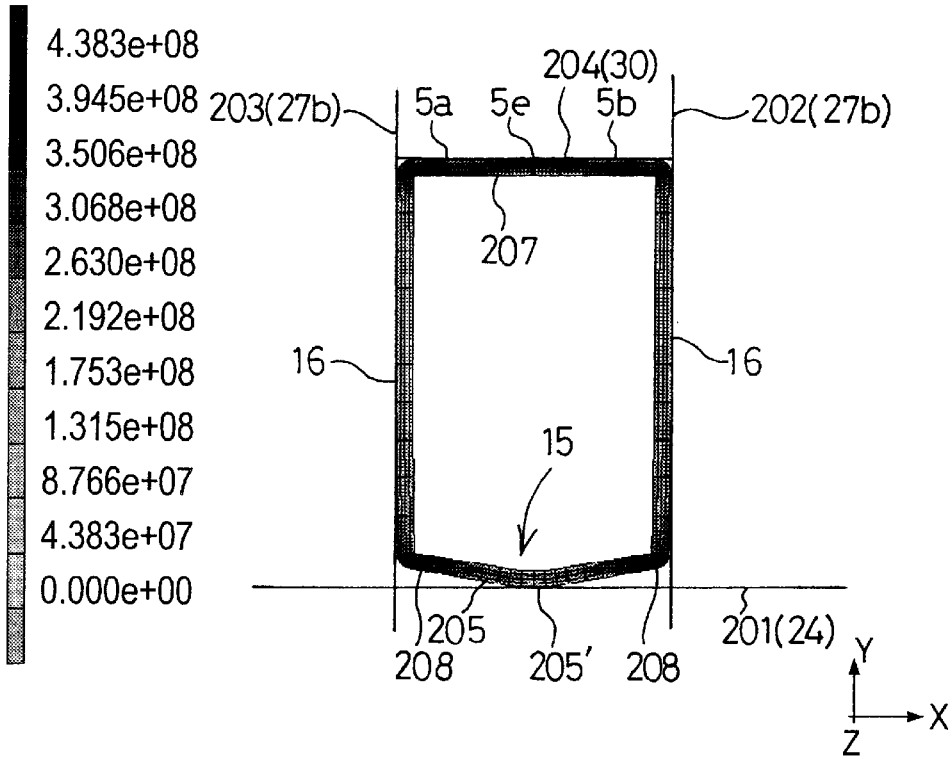
FIG. 101 is a view showing a wall including seam when it is pressed down when the rigid body is moved down.

FIG. 101 shows the state that the wall including seams 5*a* and 5*b* is pressed by the rigid body 204 which is in contact with a pair of wall including seams 5*a* and 5*b*. A stress distortion, 3.945×10 [8]–4.383×10 [8] (Pa) is generated at the each corner 208, 208 of the area 205. A stress distortion which is generated at the each corner 208 and 208 of the area 205' is lower than that of the each corners 208 and 208 and that is 4.383×10 [7]–3.068×10 [8] (Pa). It is estimated that this resulted by the start of plastic deformation at the central portion of the one specified wall 15. Since the stress distortion of the area 207 is increased by receiving the pressure of the rigid body 204, the value is 3.945×10 [8]–4.383×10 [8] (Pa) at the area 207.

Figure 102:
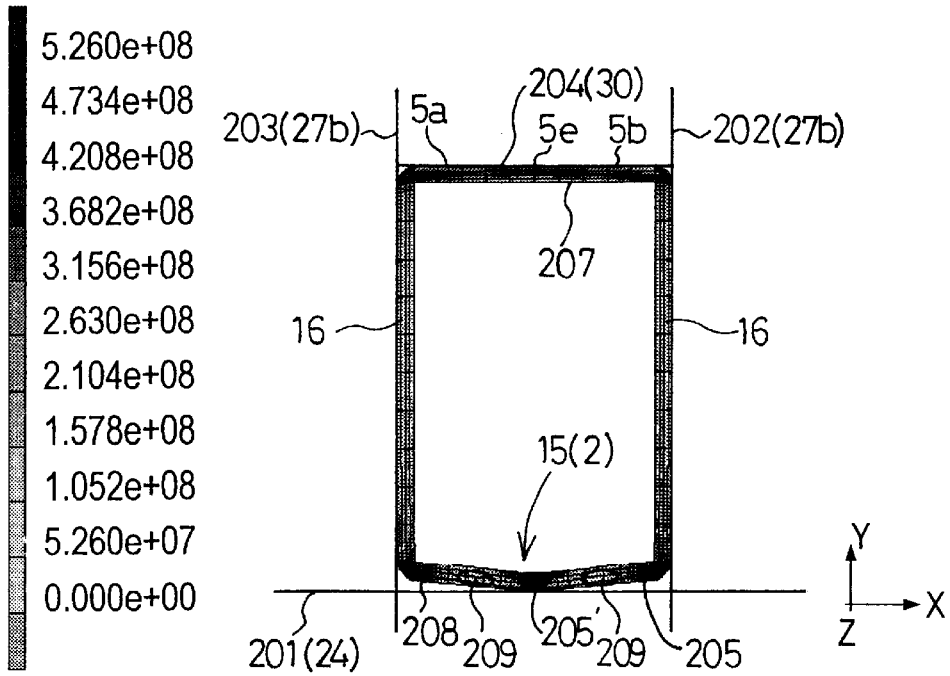
FIG. 102 is a view showing the one specified wall corresponding to the bottom wall getting a plastic deformation when the rigid body further moves down from the state depicted in FIG. 101.

At the state shown in FIG. 101, and as shown in FIG. 102, when the rigid body 204 is caused to be drawn down about 0.65 mm, the plastic deformation of the one specified wall (the bottom wall 2) 15 is progressed, and the bottom wall 2 is plastically deformed to be planed from the central portion thereof. An area of the plastic deformation is transferred from the central portion toward the sides of one specified walls 16 and 16 and is denoted by numeral 209 and 209. Also, the area 205' of the central portion is increased under the influence of pressure. The stress distortion of the area 205' is the degree of 4.734×10 [8]–5.260×10 [8] (Pa). The stress distortion at the corners 208 and 208 of the area 205 is the same degree, and the stress distortion at the areas 209 and 209 is the degree of 5.260×10 [7]–2.630×10 [8] (Pa). The stress distortion of area 207 is about 3.682×10 [8]–5.260×10 [8] (Pa).

Figure 103:
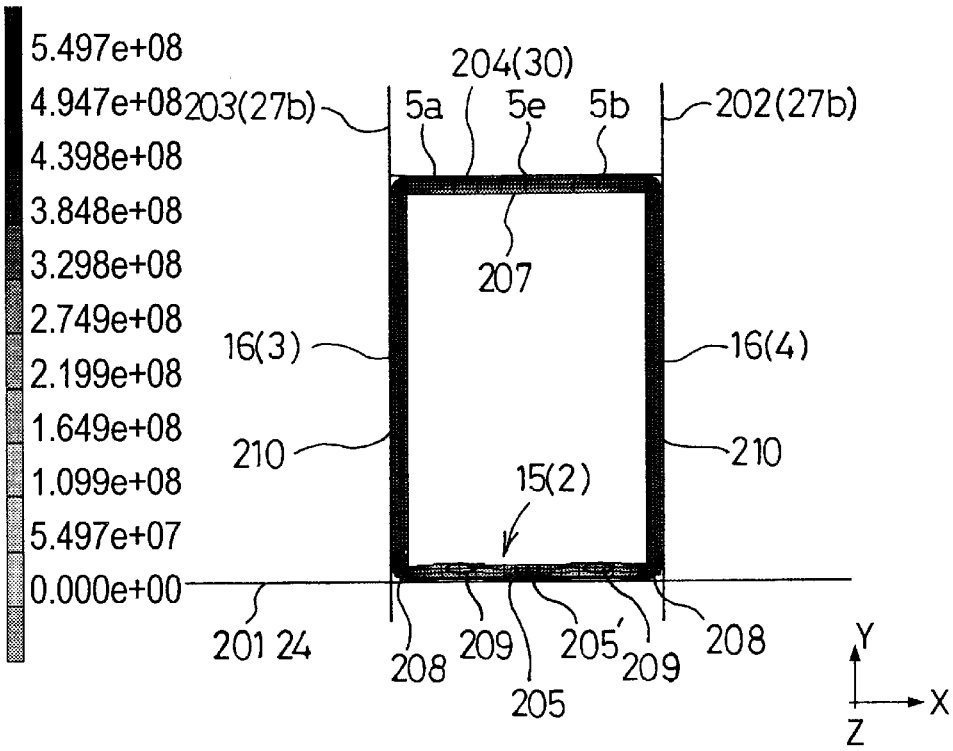
FIG. 103 is a view showing the one specified wall corresponding to the bottom wall getting flat by the plastic deformation when the rigid body further moves down from the state depicted in FIG. 102.

At the state shown in FIG. 102, when the rigid body 204 is caused to be more drawn down about 1.65 mm, a pair of side walls 3 and 4 are retrained and the upper wall 5 having the seam 5*e* is pressed to be faced with the bottom wall 2, such that the bottom wall 2 is plastically deformed from the central portion thereof, as shown in FIG. 103.

Thus, the bottom wall 2 is right angle to the side walls 3 and 4. Also, residual stress distortion remains in the central portion area 205' of the bottom wall 2 in the direction against the stress distortion which is at the each corners 208 and 208 between a pair of side walls 3 and 4 and the bottom wall 2 to cause the seam 5*e* to be open.

The lower residual stress distortion remains in the area 209 between the corner 208 of the bottom wall 2 and the central portion area 205'.

Further, with a pair of side walls 3 and 4 restrained, since the bottom wall 2 is plastically deformed to be planed, the stress distortions at the areas 210 and 210 of the pair of side walls 3 and 4 are increased. The stress distortion at the area 205' is about 4.398×10 [8]–5.497×10 [8] (Pa), the stress distortion at the area 207 is about 4.398×10 [8]–4.947×10 [8] (Pa), the stress distortion at the each corners 208 and 208 is about 5.497×10 [7]–1.649×10 [8] (Pa), and the stress distortion at the areas 210 and 210 is about 3.848×10 [8]–4.947×10 [8] (Pa).

Figure 104:
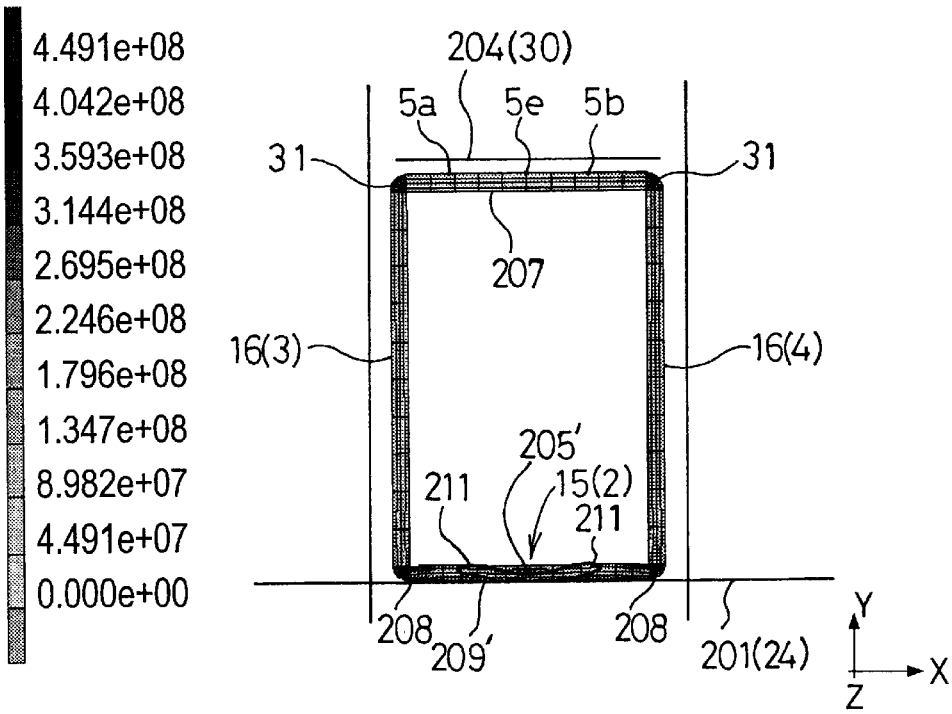
FIG. 104 is a view showing one specified wall corresponding to the bottom wall getting flat by the plastic deformation when each rigid bodies are removed.

At the state shown in FIG. 103, the rigid bodies 202 and 203 part from each other in separate directions and are stopped at the position 8.75 mm, and at the same time, as shown in FIG. 104 the rigid body 204 is raised to the position 0.855 mm.

At the state that the rigid bodies 202 through 204 are separated from one another, the prism pipe body 1 maintains the shape that the seam 5*e* is attached thereto. This is a reason that the bottom wall 2 has plastically been deformed.

The stress distortions are reduced on the whole as a result of drawing back the rigid bodies 202 through 204, and the stress distortion at the areas 207 and 209 are reduced to the range 4.491×10 [7]–1.347×10 [8] (Pa). Since only a pair of wall including seams 5*c* and 5*e* is collided with the curved part 31 of the areas 207 through 210, the residual stress distortion of 1.347×10 [8]–2.695×10 [8] (Pa) is generated.

Further, a residual stress distortion remains at the central portion 205' of the bottom wall 2 to outer direction that the bottom wall 2 becomes convex, and the value is about 1.796×10 [8]–3.144×10 [8] (Pa). Further, a residual stress distortion of about 3.593×10 [8]–4.042×10 [8] (Pa) is generated by both the residual stress distortions of which one is generated by colliding the conjunction walls 5*a* and 5*b* at the corner 208 of the area 205 and the other remains at the central area 205'. Further, a residual stress distortion area 209' which is lower than that of the central area 205' is created at the bottom wall 2 toward an outer direction.

Further, since the outside of the bottom wall 2 is restricted by the rigid body 201, a prominent shape 211 resulting from a plastic deformation is generated at inside.

As shown in FIGS. 101 through 104, since a pair of side walls 2 and 3 are restricted and the bottom wall 2 is plastically deformed from the central portion of the bottom wall 2 to be planed, the stress becomes concentrated at a corner 208 between a pair of side walls 3 and 4 and the bottom wall 2, and the bottom wall 2 is modified to be right angle to the pair of side walls 3 and 4.

Therefore, without contacting a core bar jig into the secondary intermediate product 14 for pressing a bending portion for the right angle modifying, by right angle bending the secondary intermediate product 14, the prism pipe body 1 can be formed.

Though the above description is illustrated with the stress distortion, the values of the stress distortions are not absolute, but relative.

Further, at the left side of FIGS. 95 through 104, a bar graph in which the range of stress distortion values is classified by dividing them into ten equal parts is illustrated. In the second intermediate product 14 (shell elements) in FIGS. 95 through 104 indicated the stress distortion in color by classification of bar graph. In this regard, the color views corresponding to FIGS. 95 through 104 follow by a further matter submission document.

[Example 2 of Apparatus for Manufacturing the Prism Pipe Body]

Figure 21:
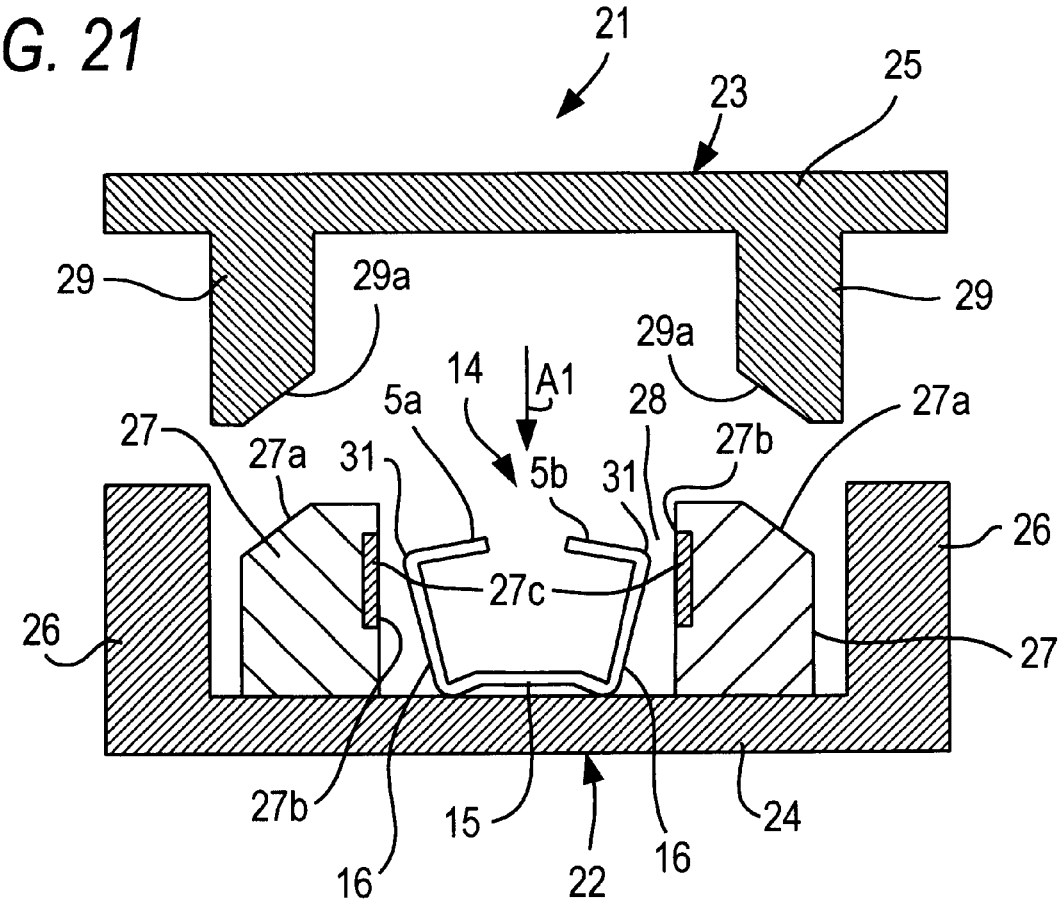
FIG. 21 is a schematic diagram of example 2 of an apparatus using the method of manufacturing prism pipe body according to the present invention, wherein the secondary intermediate product depicted in FIG. 6 is set at an apparatus.

FIG. 21 shows another example of an apparatus for manufacturing the prism pipe body 1 depicted in FIG. 1. The manufacturing apparatus depicted in FIG. 21 includes a driving plate 26 not having a press punching member 30 for pressing the pair of wall including seams 5*a* and 5*b*. Instead, frictional contact members 27*c* and 27*c* are formed at the punching surfaces 27*b* and 27*b* of the press punching member 27 and 27.

Figure 22:
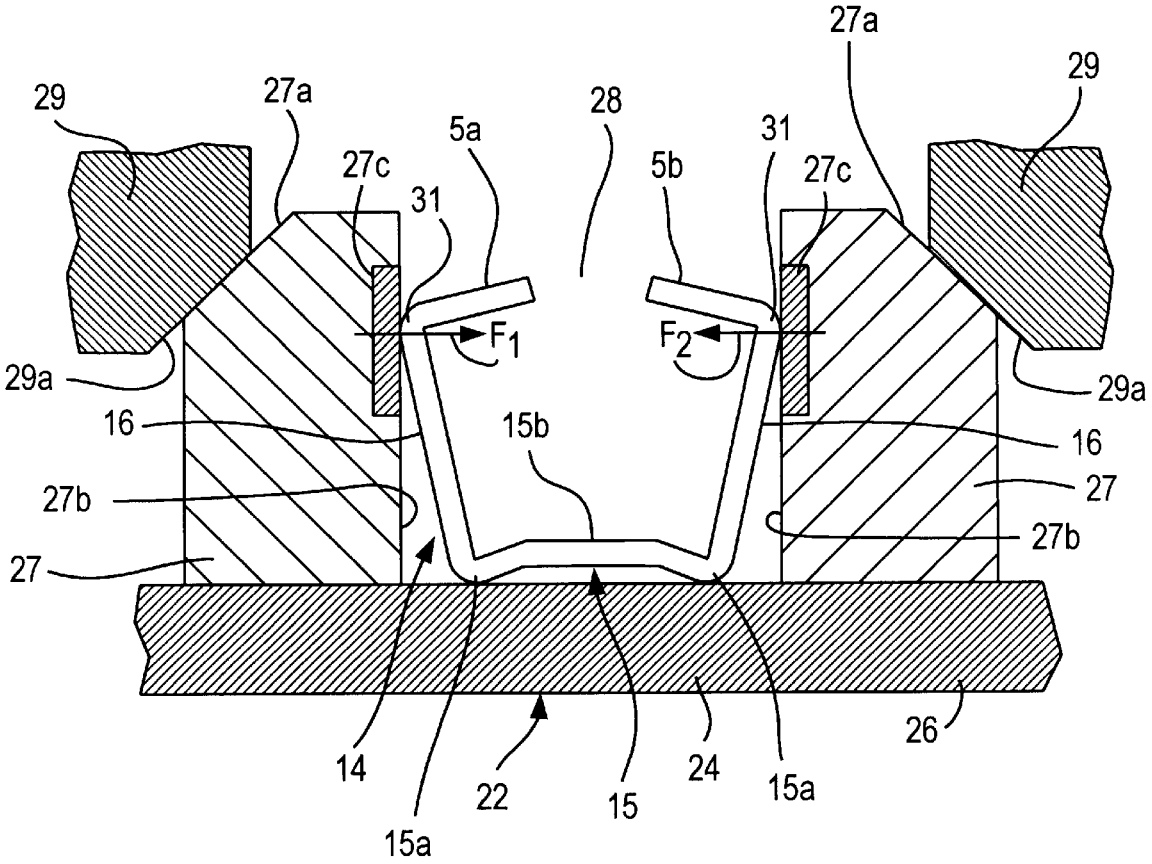
FIG. 22 shows a press punching member in contact with a bent portion of the secondary intermediate product depicted in FIG. 21.

FIG. 21 shows the state that the secondary intermediate product 14 having the lower mold 24 and the upper mold 25 separated from each other is set in a space opposite. When the upper mold 23 is drawn down along the arrow A1, as shown in FIG. 22, the taper portions 29*a* and 29*a* of the driving members 29 and 29 are engaging into the taper portions 27*a* and 27*a* of the press punching members 27 and 27. Thus, the press punching members 27 and 27 move by approaching each other, and the frictional contact members 27*c* and 27*c* of the press punching members 27 and 27 contact with the corner 31 between the adjoining walls 16 and 16 and the wall including seams 5*a* and 5*b*, such that a pair of adjoining walls 16 and 16 are pressed to approach with each other by an external force F1.

Therefore, though the stress is concentrated at the one specified wall 15, since the border portions between the adjoining wall 14 and the curved portion 15*a* and between the curved portion 15*a* and flat part 15*b* are difficult to deform by hiding, the force F2 works in the direction to allow the flat part 15*b* to come in contact with the fixed plate 26.

Figure 23:
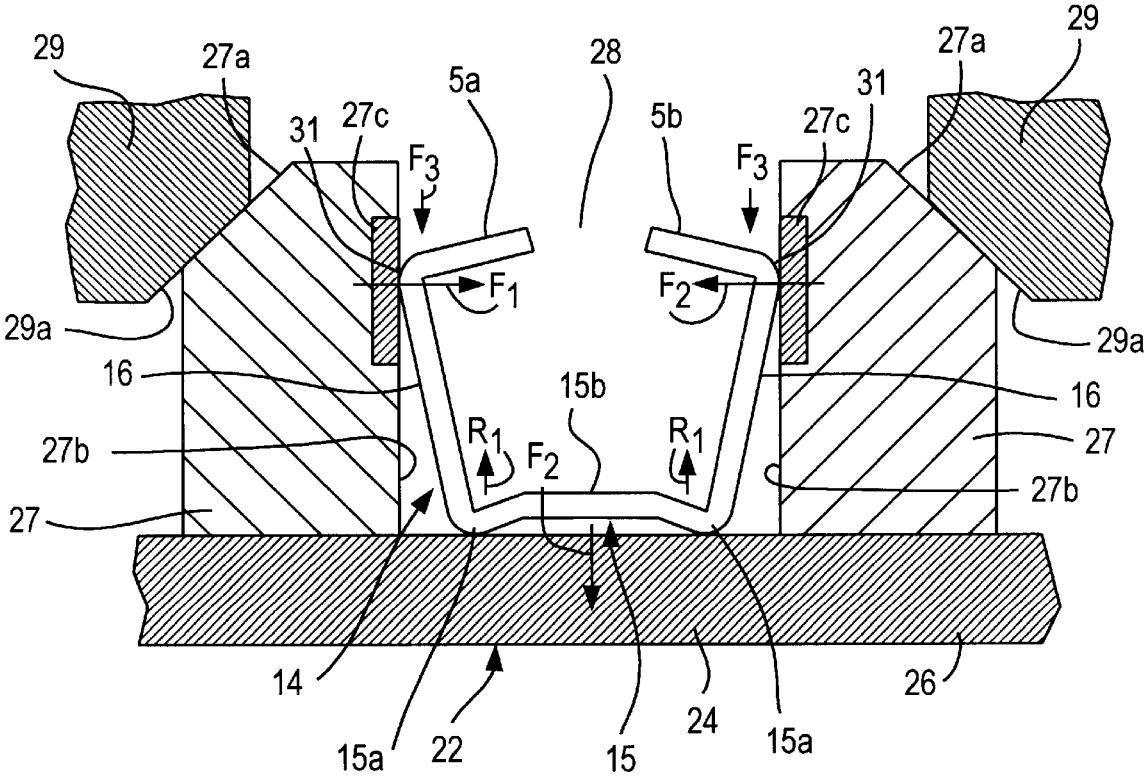
FIG. 23 is a view illustrating an external force applied on the secondary intermediate product depicted in FIG. 21.

As shown in FIG. 23, a reaction force R1 works at the bending member 15*a* to raise the intermediate product 14. When selecting a material of the friction contact member 27*c* so that a static friction force F3 between the friction contact member 27*c* and bending member 31 is greater than the reaction force R1, contact between the bending member 15*a* and fixing plate 26 is maintained.

Figure 24:
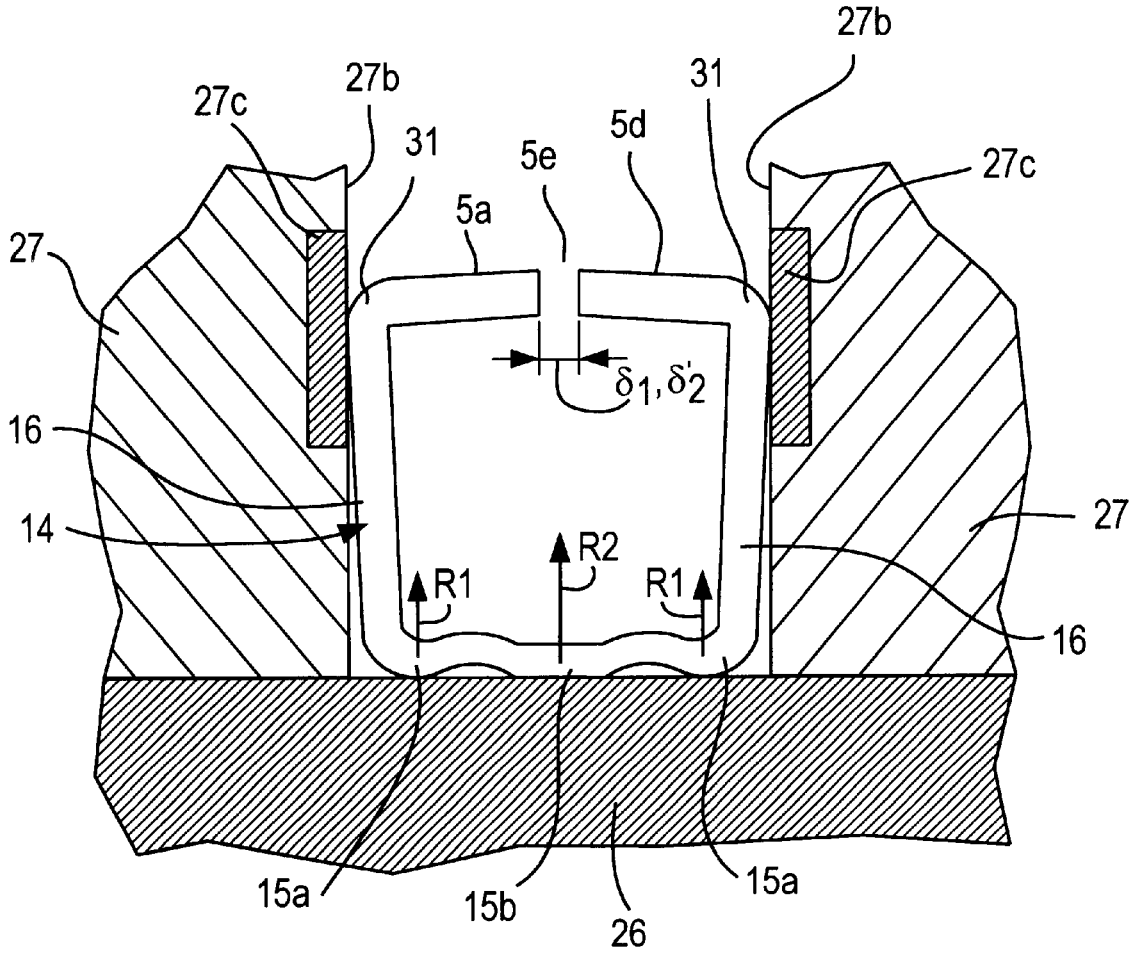
FIG. 24 is a view illustrating a modification process of the secondary intermediate product depicted in FIG. 21.

While maintaining the contact state, the pressure punch members 27 and 27 are moved in such a manner that they approach each other, as shown in FIG. 24, the curved portion 31 is gotten out slightly of an upper direction of punch surfaces 27*b* and 27*b* and a pair of walls 16 rise. At the same time, the flat part 15*b* is transformed in a direction by which a gap between the flat part 15*b* and fixed plate 26 disappears. The flat part 15*b* comes in contact with the fixing plate 26.

By the flat part 15*b* coming in contact with the fixed plate 26, a second reaction force R2 works at the flat part 15*b*. When a static friction force F3 between the friction contact member 27*c* and bending member is greater than the sum of the first reaction force R1 and second reaction force R2, the contact between the flat part 15*b* and fixed plate 26 is maintained. And the flat part 15*b* is further transformed in a direction when it contacts the fixed plate 26.

Also, when the fixed plate 26 is absent, a pair of press punching members 27 move into a direction in which they approach each other until a junction port 5*e* contacts thereto. And when the pair of press punching members 27 move in a direction in which they are separated from each other, a reference numeral δ1' is a degree of opening based on a spring back force that one specified wall 15 returns to an original curved convex shape. A reference numeral δ2' is a degree of closing based on a spring back force which will be described later.

Figure 25:
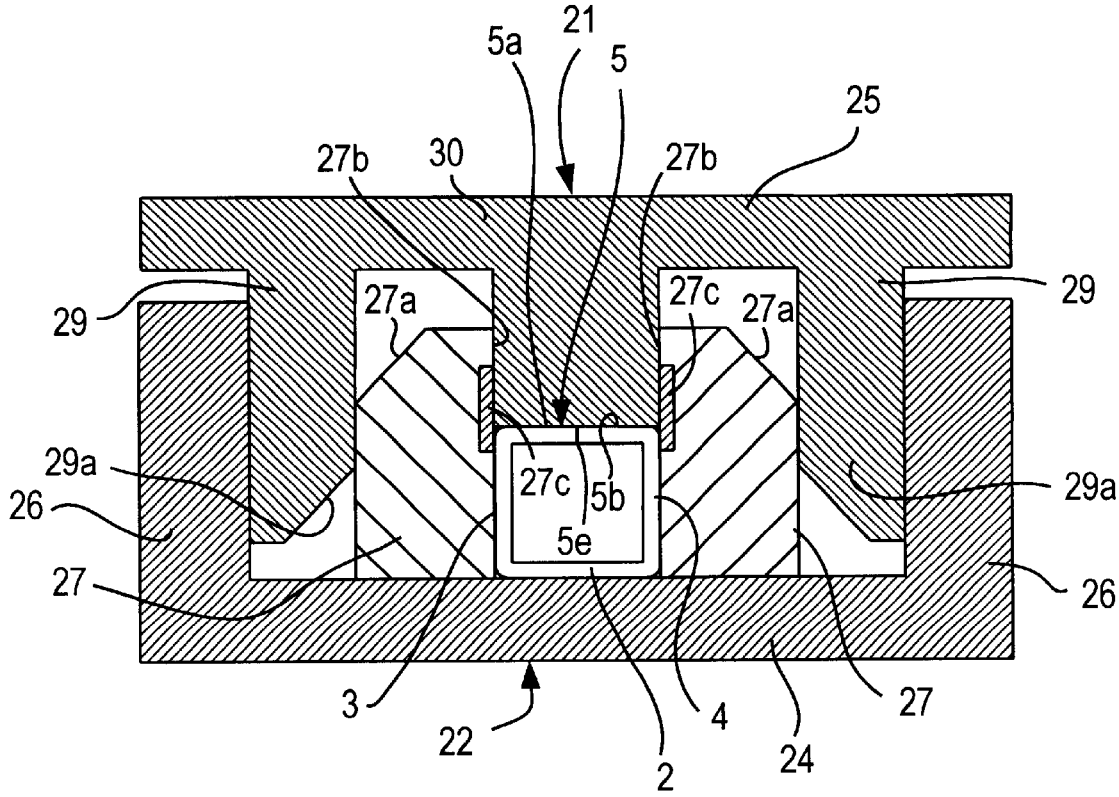
FIG. 25 in a view showing a pair of press punching members of the apparatus in its standing state depicted in FIG. 21.

When the upper forming portion 23 descends in a state shown in FIG. 24, the fastening between taper portions 27*a* and 27*a* of press punching members 27 and 27 and taper portions 29*a* and 29*a* of driving members 29 and 29 is terminated. Accordingly, as shown in FIG. 25, movements of press punching members 27 and 27 stop so that sections of wall including seams 5*a* and 5*b* are contact to each other. As a result, an upper wall 5 to which a seam 5*e* contacts to is formed. At the same time, a pair of side walls 3 and 4 and a bottom wall 2 are formed. In a process from a state shown in FIG. 24 to a state shown in FIG. 25, the seam 5*e* is displaced by an amount corresponding to the degree of closing δ2'.

When the upper forming portion 23 ascends, the fastening between the press punching members 27 and 27 and driving members 29 and 29 is terminated. By means of the fastening termination, the press punching members 27 and 27 move in a direction in which they separate from each other. And a first external force F1 having been pressed to side walls 3 and 4, a second external force F2, first and second reaction forces R1 and R2 having pressed to the bottom wall 2 are terminated to form an prism pipe body 1 shown in FIGS. 1 and 2.

Figure 26A:
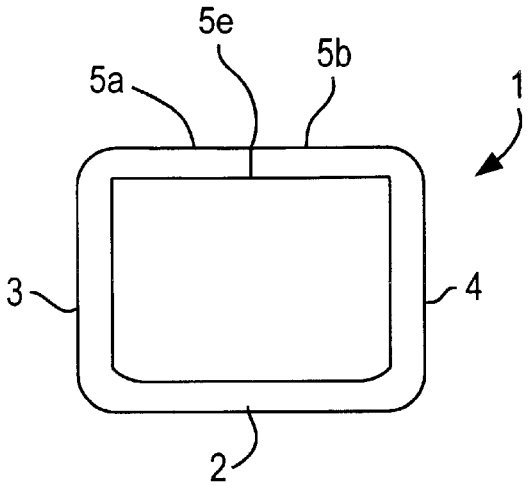
FIG. 26 is views showing a prism pipe body manufactured by the apparatus depicted in FIG. 21 and illustrating the opening of seam of the secondary intermediate product by a spring back force generated at a pair of side walls, wherein FIG. 26(*a*) shows the prism pipe body with closely contacted seam, FIG. 26(*b*) is a view illustrating that the seam is virtually opened by a spring back force f2 tending to open the seam generated at the bottom wall and FIG. 26(*c*) is a view illustrating a degree of closing of the seam by a spring back force r2 tending to close the seam generated at the bottom wall.
Figure 26B:
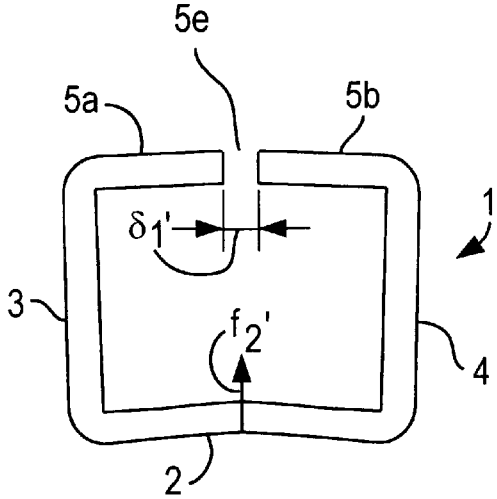
Figure 26C:
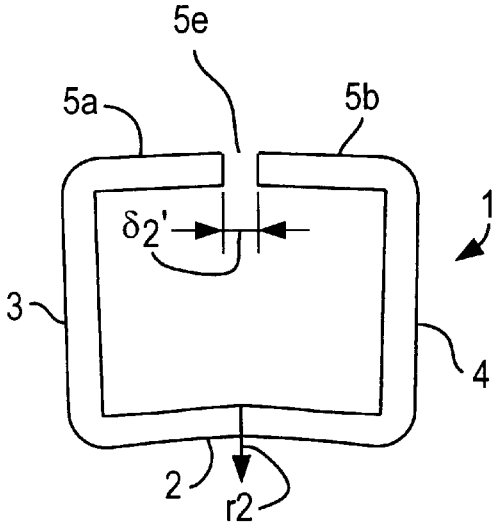

FIG. 26 is a view for ill slating an operation of the prism pipe body formed by a manufacturing apparatus shown in FIG. 21. A first spring back force f2' is generated at the bottom surface wall 2 of prism pipe body 1 shown in FIG. 26(*a*). The spring back force f2' is a force which tends to return to an original shape by removing the second external force F2 as shown in FIG. 26(*b*). Accordingly, wall including seams 5*a* and 5*b* are displaced into a direction by which they are separated from each other so that the seam 5*c* is opened by the open amount δ1'.

On the other hand, a second spring back force r2 is generated at the bottom wall 2 as shown in FIG. 26(*c*). The second spring back force r2 is a force which tends to return to an original shape by removing the second reaction force R2. When the degree of closing δ2' of the seam 5*e* based on the second spring back force r2 is set than the open amount δ1' of the seam 5*e* based on the first spring back force f2', an engaging state between seems 5*c* is maintained even though an external force pressed to the side walls 3 and 4 by means of press punching members 27 and 27 is terminated.

In an apparatus for manufacturing the prism pipe body 1, the friction contact member 27*c* is installed at a press punching member 27 so that contact occurs between one specified wall 15 and a fixed plate 24 while pressing a pair of adjoining walls 16 of the intermediate product 14.

Figure 27:
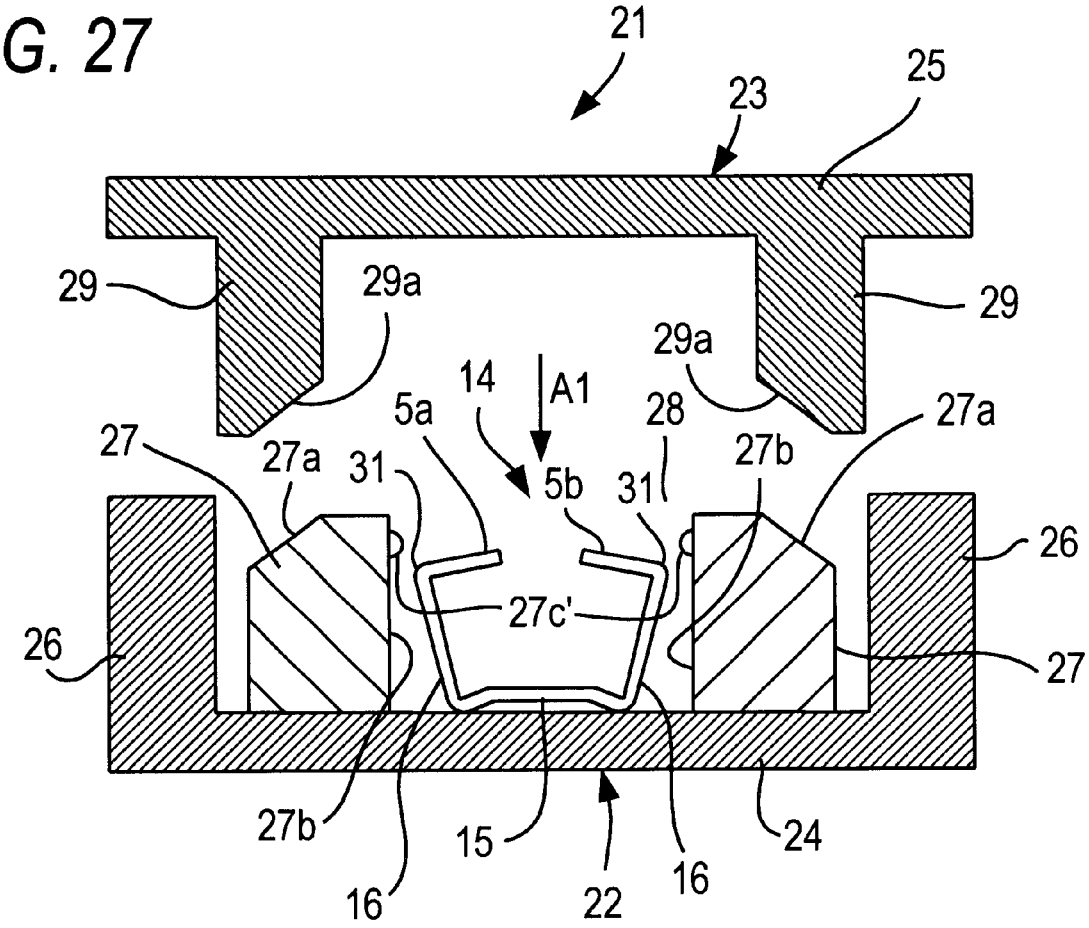
FIG. 27 shows an example of modification of the apparatus depicted in FIG. 21.

Instead of forming the friction contact member 27*c* at the pressure punch member 27, as shown in FIG. 27, by forming a keeper protrusion 27*c*' at the pressure punch member 27, contact maintains between one specified wall 15 and a fixed plate 24 while pressing a pair of adjoining walls 16 of the intermediate product 14.

[Example of 3 of Apparatus for Manufacturing Prism Pipe Body]

Figure 28:
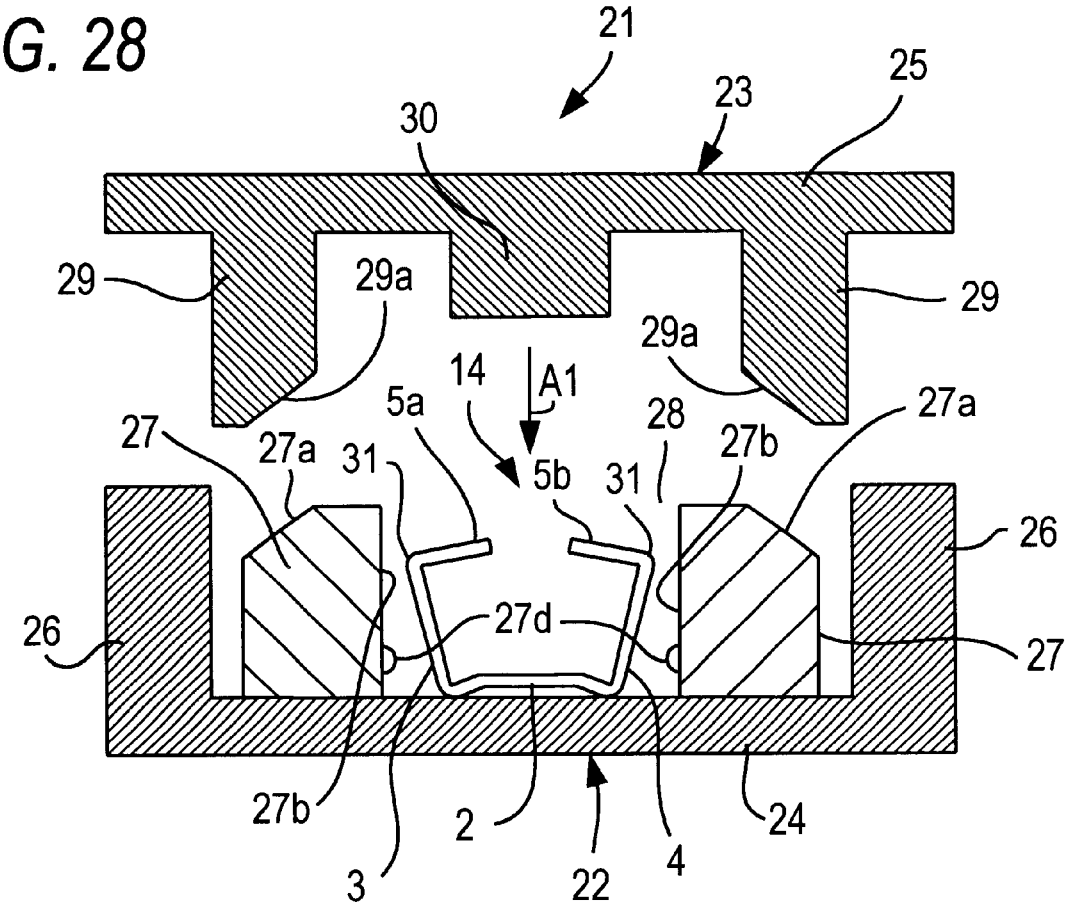
FIG. 28 is a schematic diagram showing example 3 of an apparatus used in the method of manufacturing prism pipe body according to the present invention, wherein the schematic diagram shows that the secondary intermediate product depicted in FIG. 6 is set on the apparatus.

FIG. 28 shows another example of the apparatus for manufacturing prism pipe body 1 shown in FIG. 1.

When the apparatus for manufacturing the prism pipe body 1 shown in FIG. 28 is used, as shown in FIGS. 29 and 30, convex portions 3*a* and 4*a* are located in lengthwise at regular intervals in a pair of side walls 3 and 4 and are symmetrically formed on the right and left based on a central line O1 passing the seam 5*e*.

A metal plate 6 shown in FIG. 3 is used for a material of the prism pipe body 1 shown in FIGS. 29 and 30. A primary intermediate product 8 shown in FIG. 4 is formed by a working device shown in FIG. 5.

In a second processing step, a secondary intermediate product 14 shown in FIG. 7 and a second intermediate product having the same as the secondary intermediate forming portion 14 are formed. As shown in FIG. 31, the flat part 15*a* and adjoining wall 16 are vertically formed to each other.

Figure 32A:
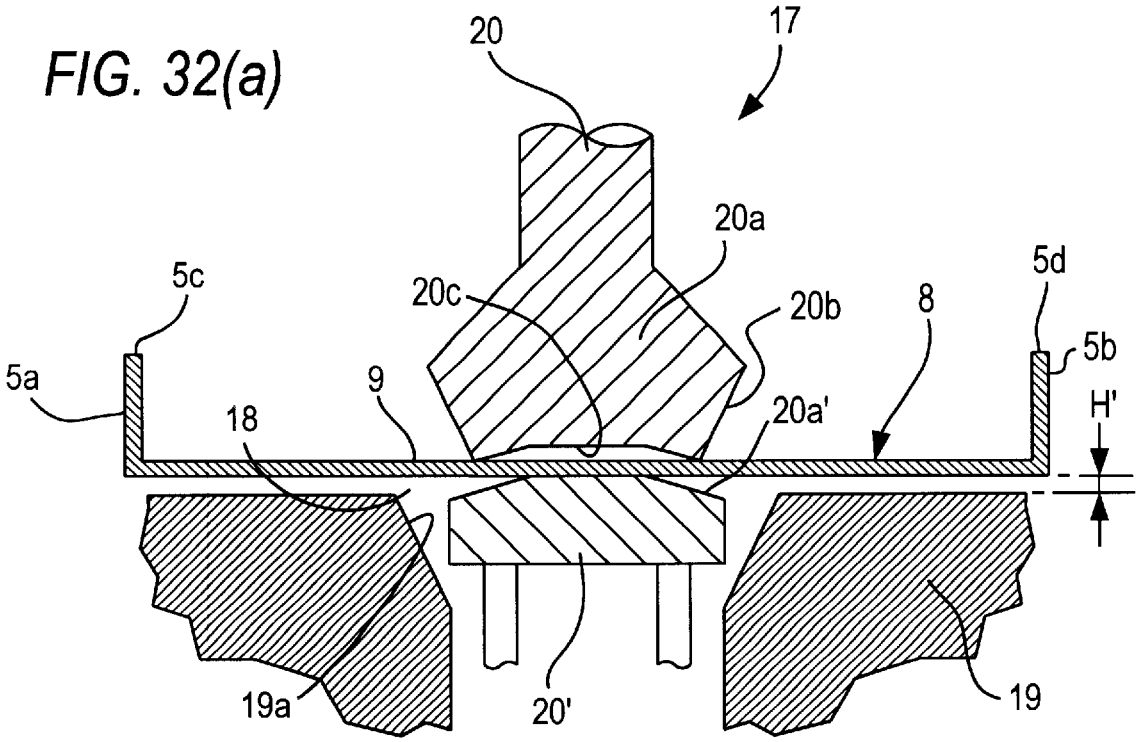
FIG. 32 is views illustrating the pressing apparatus used for forming the secondary intermediate product depicted in FIG. 28, wherein FIG. 32(*a*) is a view before forming, and FIG. 32(*b*) is a view after forming.
Figure 32B:
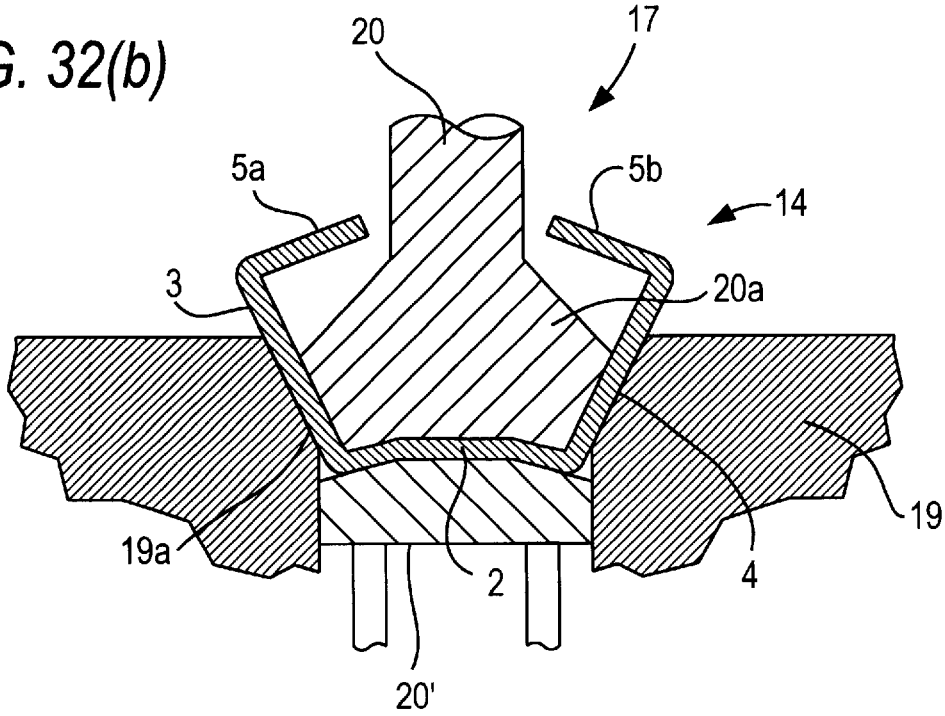

A presser shown in FIG. 32 is used to form the secondary intermediate forming portion 14. The only difference between the pressers shown in FIGS. 9 and 32 is that the bottom surface shape of the press punching member 20 and an upper surface shape of a movable plate 20'. The remaining elements are identical with each other, thus detailed description of the presser shown in FIG. 32 is omitted by using identical reference numerals.

In an apparatus for manufacturing the prism pipe body 1 shown in FIG. 28, a protrusion forming convex portion 27*d* is located in lengthwise of the prism pipe body 1 shown in FIG. 29 at regular intervals in punch surfaces 27*b* and 27*b* of a pair of press punching members 27 and 27 and are formed at the right angle to the ground at regular intervals. The protrusion forming convex portion 27*d* serves to define protrusions 3*a* and 4*a*.

The remaining elements in the apparatus for manufacturing the prism pipe body 1 shown in FIG. 28 are the same as that of the apparatus shown in FIG. 13. A detailed description of the apparatus shown in FIG. 28 is omitted. An operation thereof will be described with references to FIGS. 33 through 35.

As shown in FIG. 28, a second intermediate product 14 is set in a space 28 opposite the pressure punch members 27 and 27 to direct the bottom wall 2 in a lower direction in a third processing step.

Figure 33:
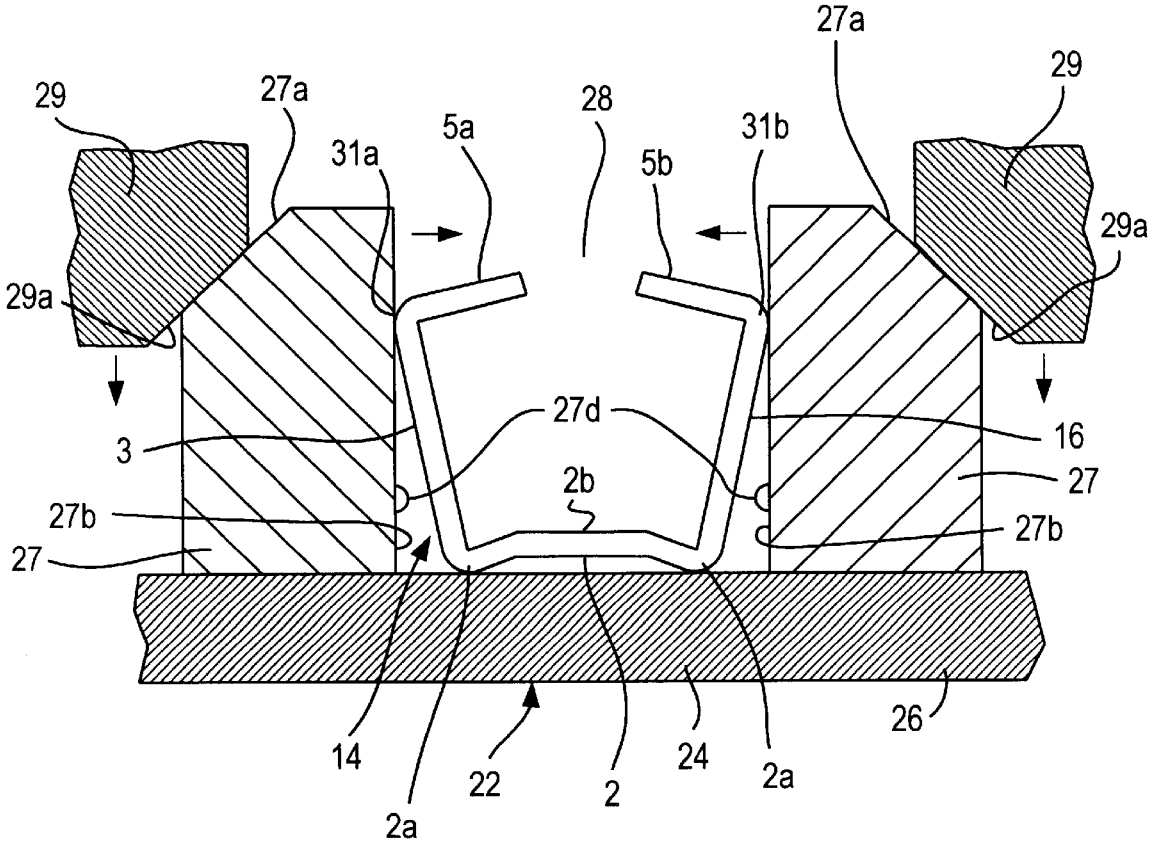
FIG. 33 is a view showing the press punching member contacted with a bent portion of the secondary intermediate product depicted in FIG. 28.

When the upper forming portion 23 descends in the direction of arrow A1 in the state, taper portions 29*a* and 29*a* of driving members 29 and 29 fasten to taper portions 27*a* and 27*a* of press punching members 27 and 27. Accordingly, as shown in FIG. 33, the press punching members 27 and 27 are moved and approach each other by resisting an elastic force of a spring member.

Accordingly, the punch surfaces 27*b* and 27*b* of press punching members 27 and 27 come in contact with a bending parts 31 and 31 which is a boundary of side walls 3 and 4 and junction walls 5*a* and 5*b*. Thus the side walls 3 and 4 are pressed and approach each other by an external force pressed by means of the punch surfaces 27*b* and 27*b*.

Figure 34:
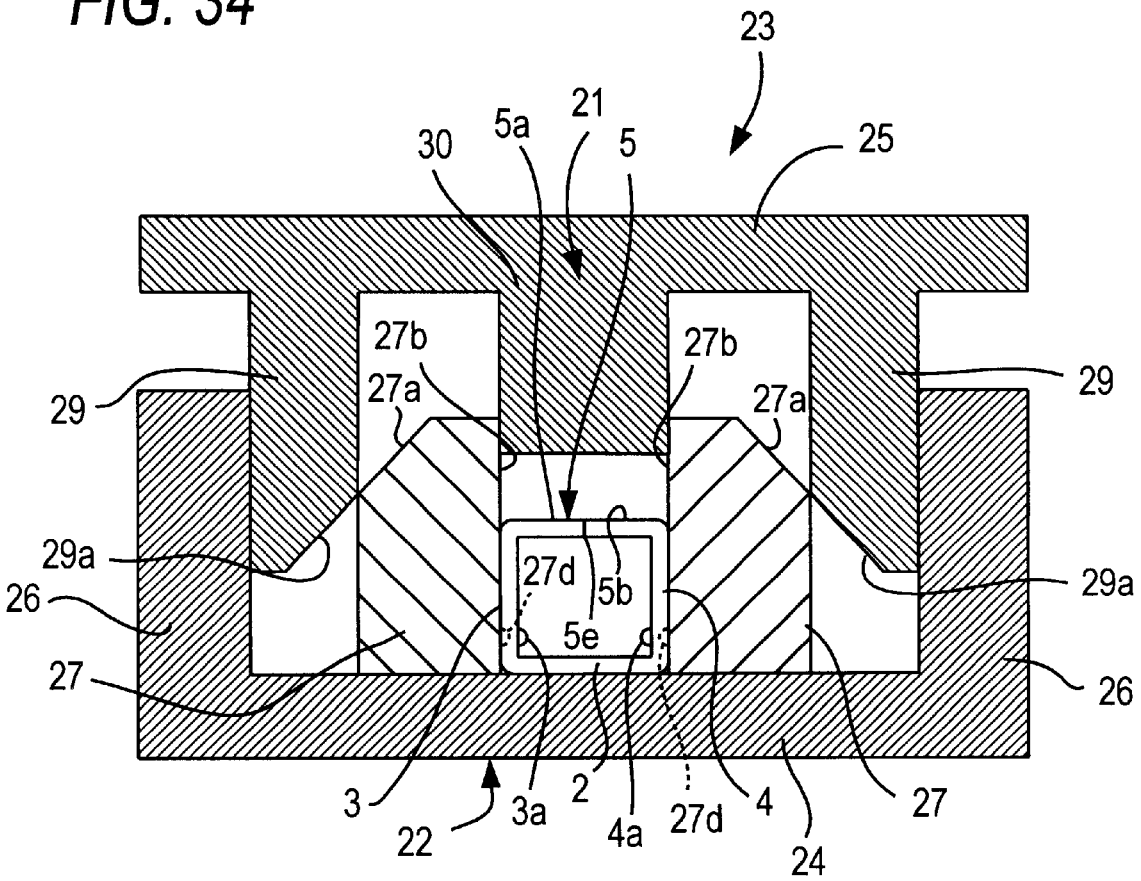
FIG. 34 is a view showing a pair of press punching members of the apparatus in its standing state depicted in FIG. 28.

When the press punching members 27 and 27 are further driven in a direction in which they are approach to each other, a curve of the bottom wall 2 is terminated and sections 5*c* and 5*d* approach and finally contact to each other. Accordingly, as shown in FIG. 34, the upper wall 5 is formed. At the same time, convex portions 3*a* and 4*a* are formed at a place (at least a place under a height direction center of a side walls 3 and 4) near to the bottom wall 2 of side walls 3 and 4 by the protrusion forming convex portion 27*c*.

Figure 35:
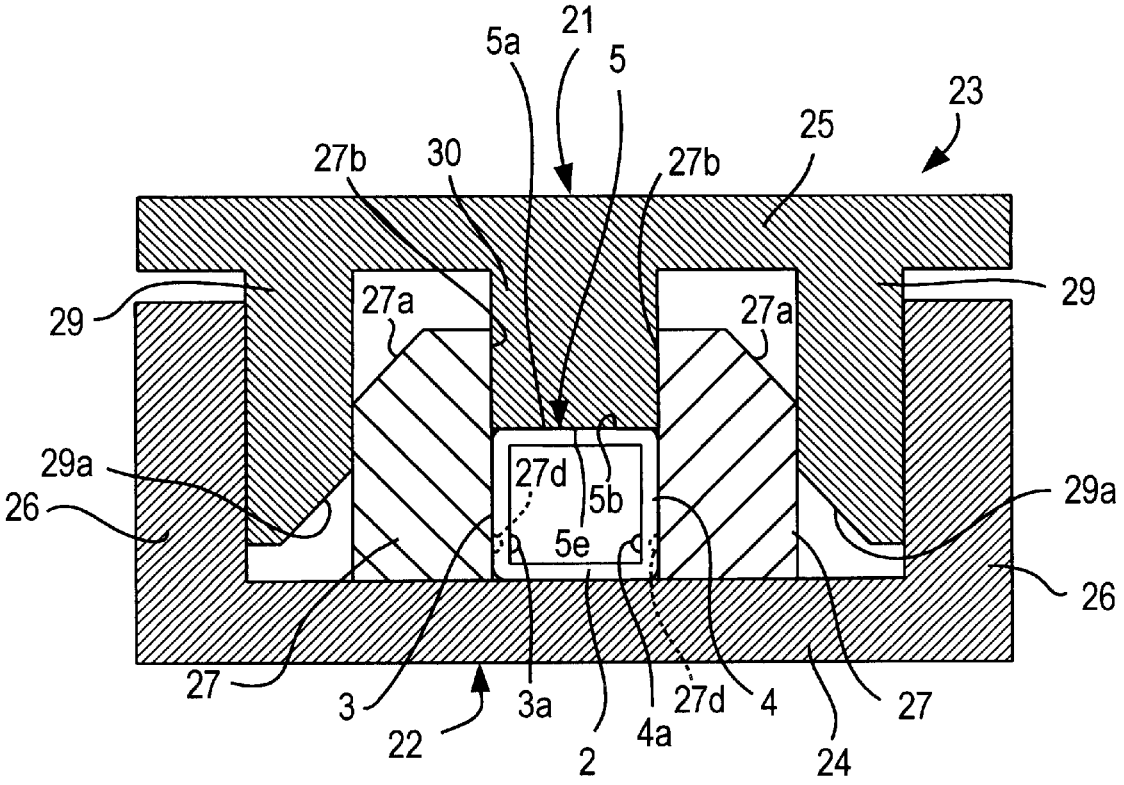
FIG. 35 is a view showing the press punching member depicted in FIG. 28 contacted with the upper wall.

Then, in a fourth processing step, the upper forming portion 23 further descends, and the fastening between taper portions 27*a* and 27*a* of press punching members 27 and 27 and taper portions 29*a* and 29*a* of driving members 29 and 29 is released. Accordingly, the press punching members 27 and 27 stop in that location. When the upper mold 23 further descends in by applying the pressure to the side walls 3 and 4, the pressure punching member 30 contacts to the upper wall 5, as shown in FIG. 35, and pressure is applied to the upper wall 5. By applying pressure to the press punching member 30, the upper wall 5 and bottom wall 2 are surely become planed. However, the fourth processing step is not indispensable.

And, when the upper mold 23 ascends and separates from the lower mold 22, the press punching members 27 and 27 are estranged from each other to thereby obtain the prism pipe body 1 shown in FIG. 29.

Figure 36:
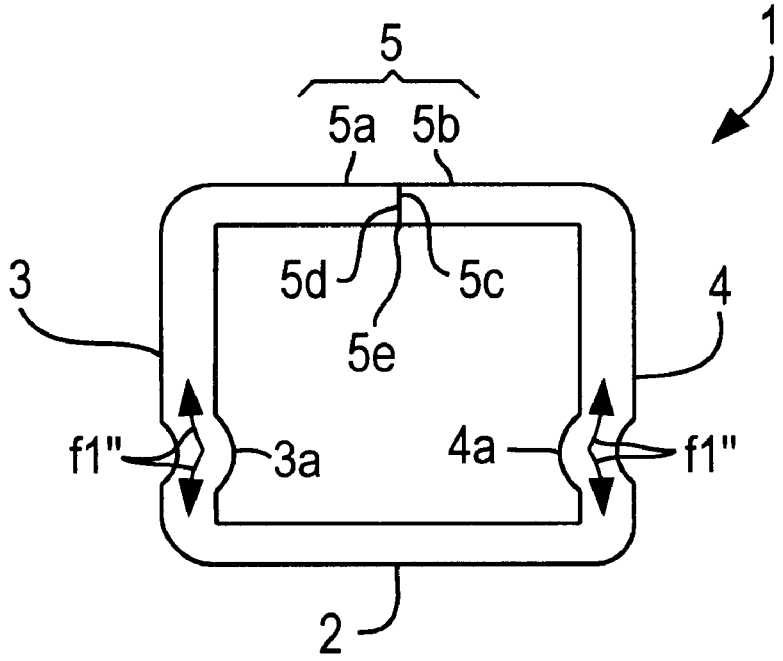
FIG. 36 is a view illustrating an operation of the spring back force generated at the prism pipe body depicted in FIG. 30.
Figure 37:
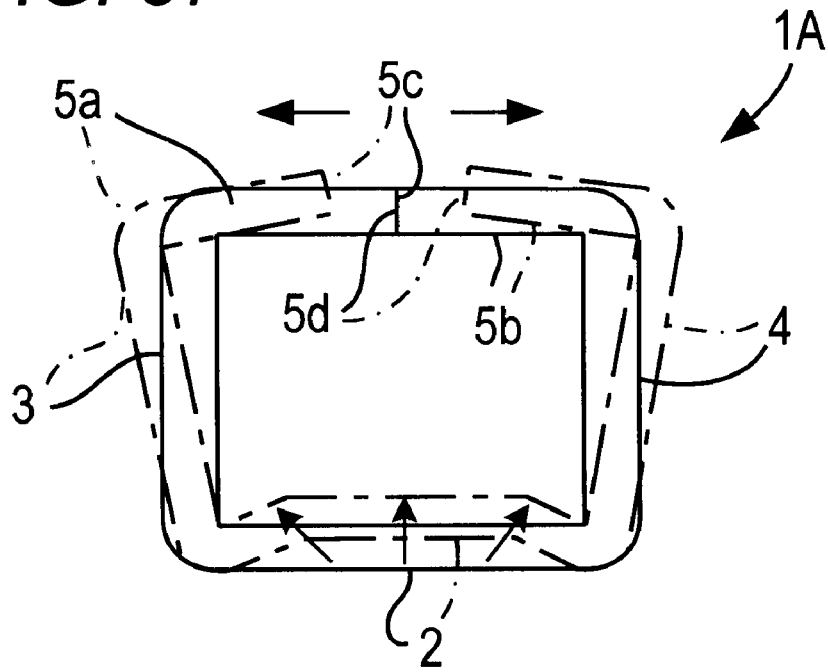
FIG. 37 is a diagram illustrating a spring back force generated at a prism pipe body without convex portion.

FIG. 36 is a view for illustration the prism pipe body 1 manufactured by the manufacturing apparatus shown in FIG. 28. FIG. 37 shows a prism pipe body 1A not having convex portion, for comparison. The only difference between the prism pipe body 1 shown in FIG. 36 and the prism pipe body 1A show in FIG. 37 is that the prism pipe body 1A has convex portion in the third processing step and the remaining elements are identical with the prism pipe body 1 shown in FIG. 36. Parts corresponding to the prism pipe body 1 in the prism pipe body 1A are allotted to the same reference numeral of the prism pipe body 1.

Generally, when transforming manufactured products by means of a press work (bending work), spring back is generated. The spring back means a phenomenon that the transformation returns to an original state after a working force is removed. Accordingly, the prism pipe body 1 and the bottom wall 2 of prism pipe body 1A tend to return to a curved surface shown as a chain line in FIG. 37 by a stress generated according to spring back (spring back force).

That is, after the external force by the press punching members 27 and 27 is removed, the sections 5*a* and 5*d* of wall including seams 5*a* and 5*b* tend to separate from each other. In the prism pipe body 1A shown in FIG. 37, it is difficult to exactly prevent a gap between the sections 5*c* and 5*d* without performing welding operation. However, it is easy to exactly prevent the gap between the sections 5*c* and 5*d* by the above mentioned study.

However, in the prism pipe body 1 manufactured by the manufacturing apparatus shown in FIG. 28, convex portions 3*a* and 4*a* are formed on the side walls 3 and 4. As shown in FIG. 36, the spring back force f1" is generated at a place in which the convex portions 3*a* and 4*a* are formed. Accordingly, the spring back force f1" offsets the spring back force which is generated at the bottom surface wall 2. Or, the spring back force f1" operates to close the seam 5*e* by a force greater than the spring back force in the bottom wall 2.

Figure 38A:
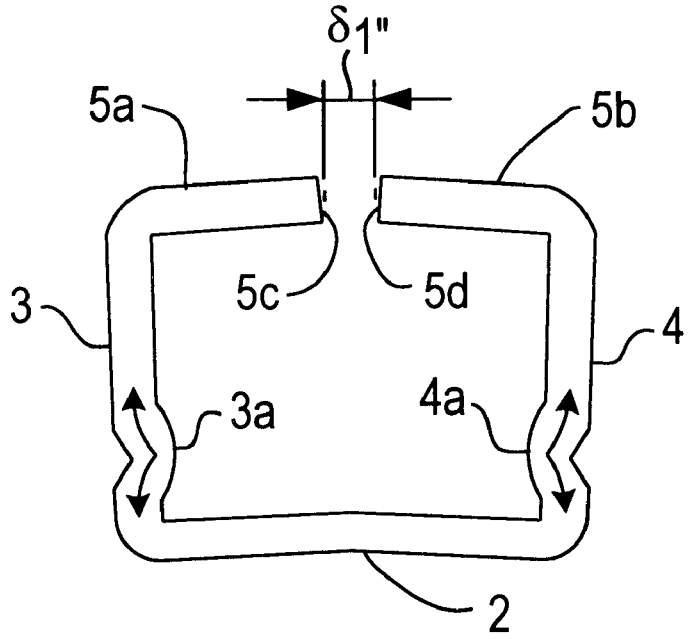
FIG. 38 is a separated and emphasized explanatory views for effect of the spring back force of the prism pipe body depicted in FIG. 36, wherein FIG. 38(*a*) shows effects of the spring back force generated at the bottom wall, and FIG. 38(*b*) shows effects of the spring back force generated at the convex portion.
Figure 38B:
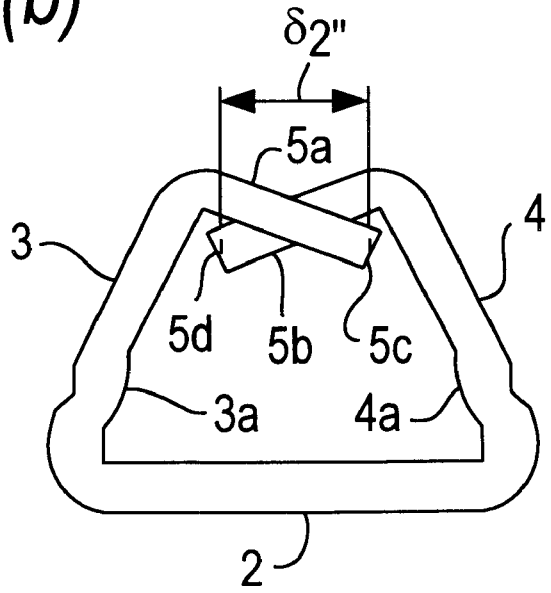

Accordingly, adhering sections 5*c* and 5*d* without performing the welding operation can prevent the gap. Concretely, as shown in FIG. 38(*a*), open amount between sections 5*c* and 5*d* by the spring back force is generated at the bottom surface wall 2 is δ1". As shown in FIG. 38(*b*), if degree of closing between sections 5*c* and 5*d* by the spring back force f1" is set to δ2" (under condition that sections 5*c* and 5*d* can freely move without interference by each other), the sections 5*c* and 5*d* contact to each other when δ1"≦δ2".

Figure 39:
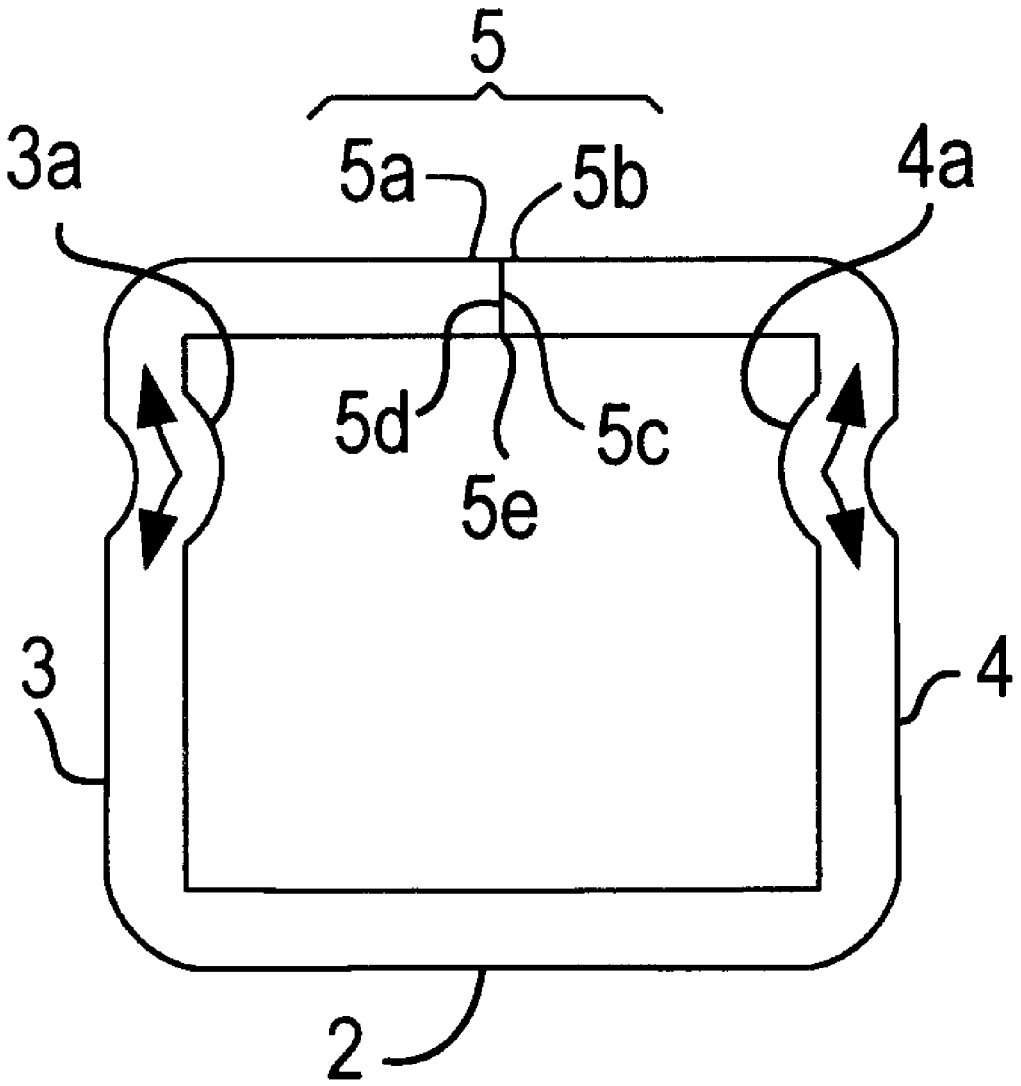
FIG. 39 is a diagram illustrating a spring back force generated at a prism pipe body having convex portion near by an upper wall.

Also, since the convex portions 3*a* and 4*a* is formed near the bottom wall 2 meaning far from the seam 5*e,* as shown in FIG. 39, a force in a direction close between sections 5*c* and 5*d* can apply to the convex portions 3*a* and 4*a* in this case more efficiently than the convex portions 3*a* and 4*a* in another case whereby the convex portions 3*a* and 4*a* are formed near the wall including seam 5 and formed at a side near to the seam 5*e.* Also, since convex portions 3*a* and 4*a* are located at the right and left based on a seam 5*e,* a force in a direction close between sections 5*c* and 5*d* can apply to the convex portions 3*a* and 4*a* with a good balance.

The prism pipe body 1 shown in FIG. 28 can be manufactured by forming protrusions 27*c* and 27*c* at a conventional presser. Since conventional equipment is efficiently used, precision of a product is improved by controlling equipment investment.

Also in a press forming device 21 of the apparatus for manufacturing the prism pipe body 1, convex portion is formed on a surface (side walls 3 and 4) other than the upper wall 5 having wall including seams 5*a* and 5*b*. Thus, the wall including seams 5*a* and 5*b* are prevented by an influence of pressing force from getting out of the prism pipe body 1, and thus not to form the upper wall 5.

Also, in the apparatus for manufacturing the prism pipe body 1 shown in FIG. 28, the convex portion 3*a* and 4*a* is formed on the side walls 3 and 4 of the prism pipe body 1. However, the convex portion 3*a* and 4*a* can be formed on the bottom wall 2 instead of at the side walls 3 and 4 of the prism pipe body 1.

Figure 40:
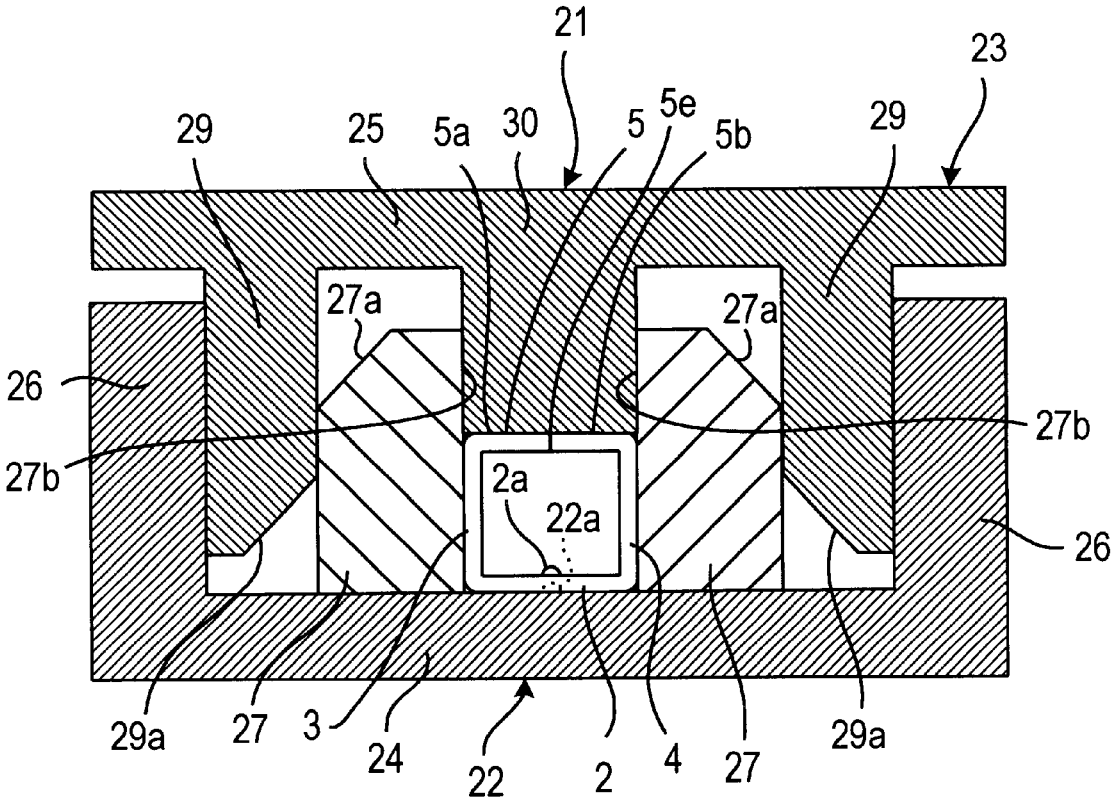
FIG. 40 is a illustrative view showing an modified example of the prism pipe body forming apparatus shown in FIG. 28 and the apparatus makes the convex portion at the bottom wall.

In this case, as shown in FIG. 40, convex portion forming protrusion 22*a* is formed at a fixed plate 22. And, when pressing the secondary intermediate product 14 from an upper direction by means of the press punching member 30, the convex portion 2*a* is formed on the center of the bottom wall 2.

Also, as shown in FIG. 29, plural numbers of convex portions 3*a* and 4*a* are formed at predetermined intervals in a lengthwise. However, a line convex portion extending lengthwise is formed on the side wall 3 and 4.

(3) [Example 1 of Prism Pipe Body Having a Fastening Plate]

Figure 41C:
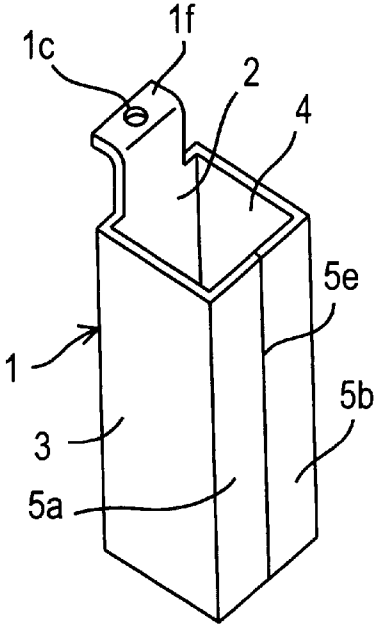
FIG. 41 is views showing a prism pipe body with a fastening plate integrally formed, wherein FIG. 41(*a*) shows a side wall of the prism pipe body at which a pair of fastening plates are formed, FIG. 41(*b*) is a view showing the prism pipe body depicted in FIG. 41(*a*) tightly attached to a member having a "U" shaped cross section, and FIG. 41(*c*) is a view showing a bent fastening plate formed on the bottom wall.
Figure 41B:
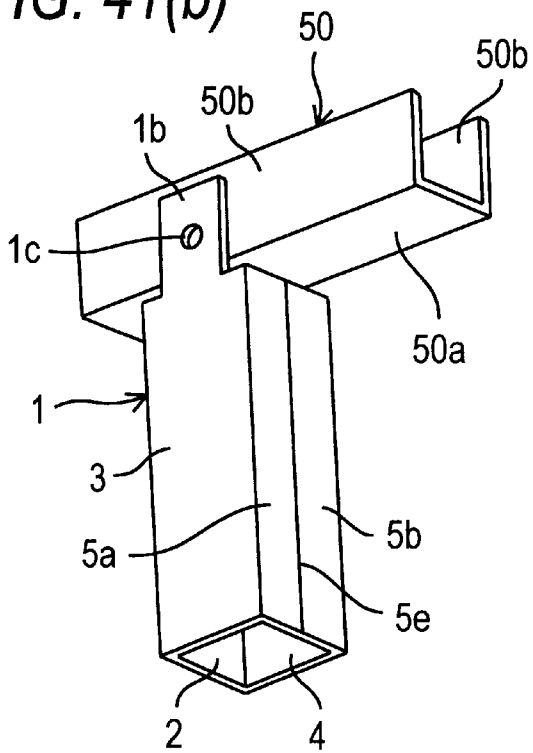
Figure 41A:
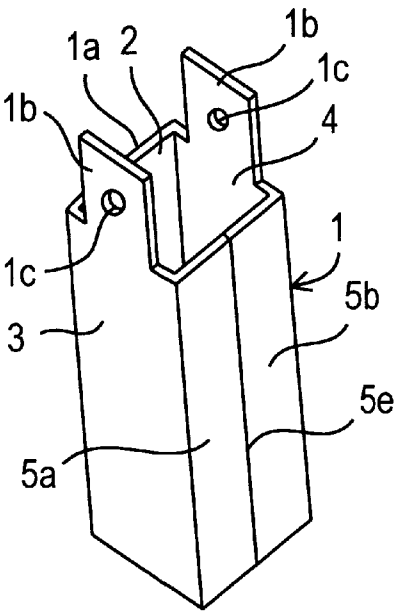
Figure 42C:
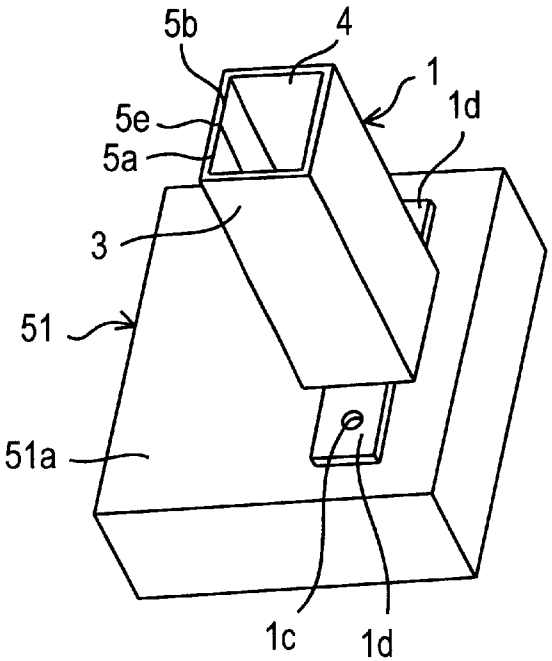
FIG. 42 is views showing a prism pipe body with a fastening plate integrally formed, wherein FIG. 42(*a*) shows a prism pipe body with a pair of bent fastening plates which is formed by bending outside on a side wall, FIG. 42(*b*) is a view showing the prism pipe body depicted in FIG. 42(*a*) attached to a member having a "U" shape cross section, and FIG. 42(*c*) is a view showing the prism pipe body depicted in FIG. 42(*a*) attached to a base member.
Figure 42B:
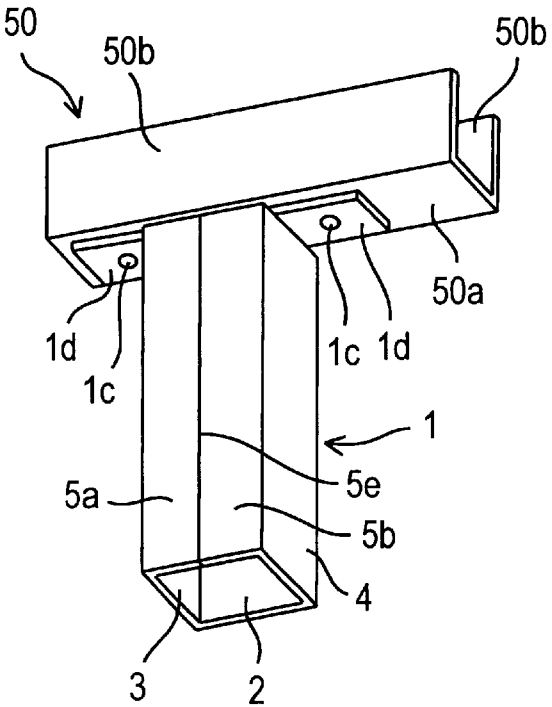
Figure 42A:
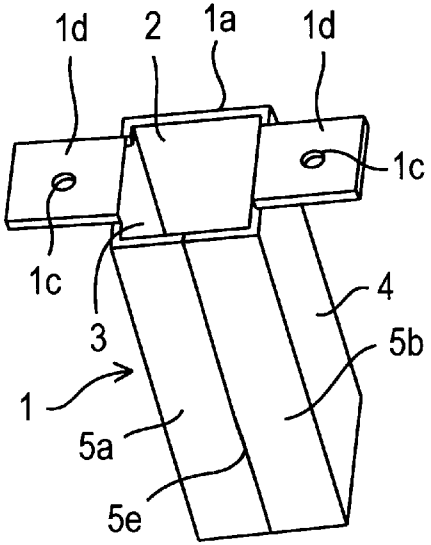
Figure 43A:
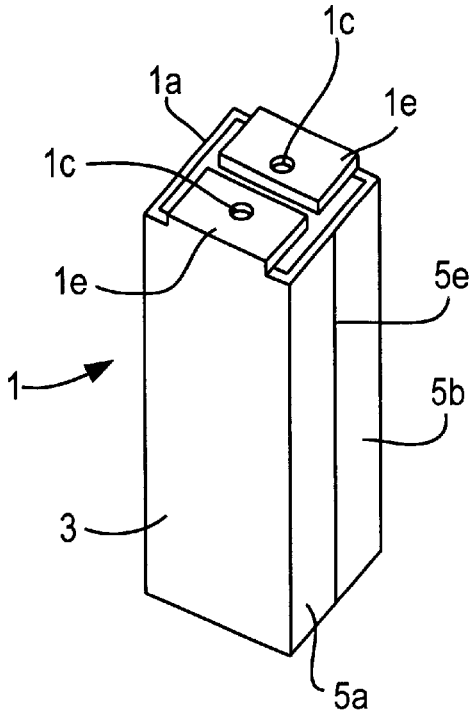
FIG. 43 is views showing a prism pipe body with a fastening plate integrally formed, wherein FIG. 43(*a*) shows a prism pipe body at which a pair of bent fastening plates bent toward an external side of a side wall are formed, and FIG. 43(*b*) is a view showing the prism pipe body depicted in FIG. 43(*a*) attached to a member having a "U" cross section.
Figure 43B:
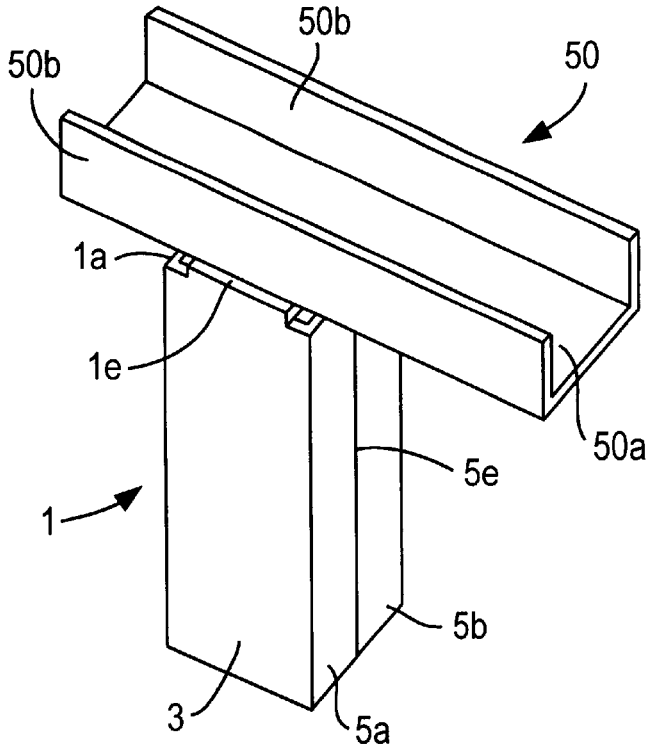

FIGS. 41 through 43 show the prism pipe body having a fastening plate.

A pair of parallel fastening plates 1*b* and 1*b* are formed on a section portion 1*a* of the prism pipe body 1 shown in FIG. 41(*a*). The parallel fastening plates 1*b* and 1*b* protrude parallel from the side walls 3 and 4. Tapped holes 1*c* and 1*c* are formed on the parallel fastening plates 1*b* and 1*b,* respectively.

The prism pipe body 1 shown in FIG. 41(*b*) is screwed to a "U" shaped section member 50. The "U" shaped section member 50 includes a bottom surface portion 50*a* and a pair of standing walls 50*b* and 50*b*.

The prism pipe body 1 is fixed to a bottom surface portion 50*a* of the "U" shaped section member 50, by facing to a section portion to 1*c* thereof the bottom surface portion 50*a* and facing to the parallel fastening plates 1*b* and 1*b* pair of standing walls 50*b* and 50*b* to screw the pair of standing walls 50*b* and 50*b* and fastening plates 1*b* and 1*b*.

A pair of curved fastening plates 1*d* and 1*d* are formed on a section portion 1*a* of the prism pipe body 1 shown in FIG. 42(*a*). The curved fastening plates 1*d* and 1*d* are formed by bending the parallel fastening plates 1*c* and 1*c* shown in FIG. 41(*a*) in an outer direction.

The prism pipe body 1 shown in FIG. 42(*a*) is fixed to a bottom surface portion 50*a* of the "U" shaped member 50, for example, as shown in FIG. 42(*b*), by facing to the "U" shaped section member 50 and the curved fastening plates 1*d* and 1*d* to the bottom surface portion 50*a* thereof to screw the curved fastening plates 1*d,* 1*d* and the bottom surface portion 50 thereof.

The prism pipe body 1 shown in FIG. 42(*a*) is fixed to an upper surface portion 51*a* of a rectangular block member 51, for example, by facing to a section portion 1*a* thereof to the upper surface 51*a* of a rectangular block member 51 and facing to the curved fastening plates 1*d* and 1*d* each other to screw the curved fastening plates 1*d* and 1*d* and the upper surface portion 51*a* of a rectangular block member 51.

A pair of curved fastening plates 1*e* and 1*e* are formed on a section portion 1*a* of the prism pipe body 1 shown in FIG. 43(*a*). The curved fastening plates 1*e* and 1*e* are formed by bending the parallel fastening plates 1*b* and 1*b* shown in FIG. 41(*a*) in an inner direction.

The prism pipe body 1 shown in FIG. 43(*a*) is fixed to a bottom surface 50*a* of the "U" shaped section member 50, for example, by facing to the curved fastening plates 1*e* and 1*e* to the bottom surface 50*a* of the "U" shaped section member 50 to screw the curved fastening plates 1*e,* 1*e* and the bottom surface 50*a* thereof.

Since fastening plates are formed on a section portion of the prism pipe body 1 shown in FIGS. 41 through 43, the prism pipe body 1 can be fastened to another member without using a fastening bracket member.

As shown in FIGS. 41 through 43, shapes of the fastening plates can be changed, and freedom of fastening the prism pipe body 1 to another member is improved.

Also, fastening the prism pipe body 1 to another member occurs by integrally forming fastening plates on the section portion 1*a* of the prism pipe body 1. Accordingly, when comparing the prism pipe body 1 shown in FIGS. 41 through 43 with the prism pipe body 1 shown in FIG. 1(*a*), fastening plates are not integrally formed on the section portion thereof. In the prism pipe body 1 shown in FIGS. 41 through 43, fastening strength is improved.

Also, in the prism pipe body 1 shown in FIGS. 41(*a*), 41(*b*), 42, and 43, since fastening plates are located far from the bottom wall 2 causing insufficient processing transformation and the upper wall 5 has a seam, size precision of the fastening plates can be guaranteed.

When forming the bottom wall 2 at the fastening plates, since the curved fastening plate 1*f* is formed by protruding and bending a front end 1*c* of the fastening plate from section portion as shown in FIG. 41(*c*) parallel, size precision of the fastening plates can be guaranteed.

When processing and forming the prism pipe body 1, since the bottom wall 2 receives a concave and convex transformation, it is difficult to form the curved fastening portion in the previous process. However, as shown in FIG. 41(*c*), the curved fastening plate is easily formed on the bottom wall 2 by forming a parallel protrusion and bending it later as shown in FIG. 41(*c*).

[Method for Manufacturing the Prism Pipe Body of Item (3)]

Figure 48:
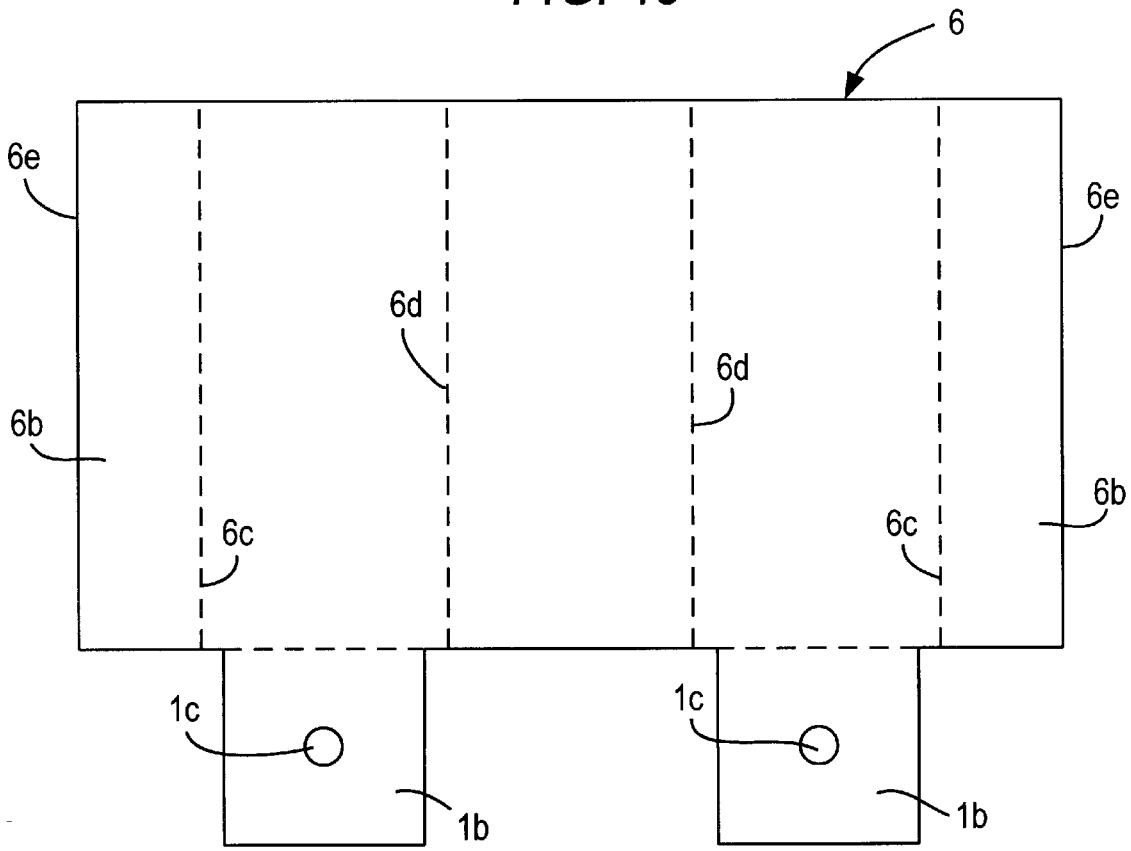
FIG. 48 is a plane view of a metal plate used for manufacturing the prism pipe body depicted in FIG. 41.

In manufacturing the prism pipe body 1 shown in FIG. 41, a metal plate 6 shown in FIG. 48 is used. A pair of parallel fastening plates 1*b* and 1*b* are previously formed on the metal plate 6 by means of a punching operation.

Figure 49:
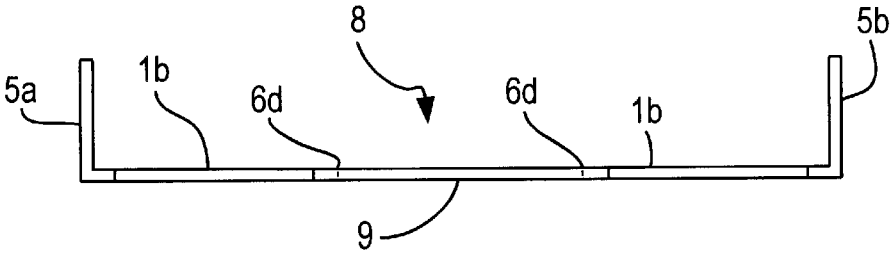
FIG. 49 is a front view of a primary intermediate product formed by using the metal plate depicted in FIG. 41.

The metal plate 6 is mounted to a presser 10 shown in FIG. 5 and is pressed by means of the presser 10 to thereby form a first intermediate product 8 shown in FIG. 49. Then the first intermediate product 8 shown in FIG. 49 is mounted to a presser 17 shown in FIG. 9 and is pressed by means of the presser 17 to thereby form a secondary intermediate product 14 shown in FIG. 50.

Figure 50:
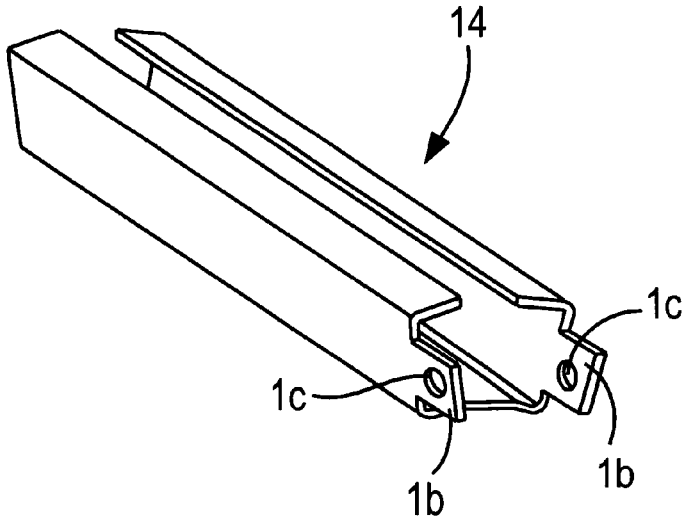
FIG. 50 is a perspective view of secondary intermediate product formed by using the primary intermediate product depicted in FIG. 49.

Then the secondary intermediate product 14 show in FIG. 50 is mounted to any one of pressers 21 shown in FIGS. 13, 21, and 28 and is pressed by means of the presser 21 to thereby form a prism pipe body 1 shown in FIG. 41(*a*).

The prism pipe body 1 shown in FIG. 42 is obtained by standing the parallel fastening plate 1*b* formed on the metal plate 6 shown in FIG. 48 in an outer side, mounting and pressing it to and by the presser 10 shown in FIG. 5.

Figure 51:
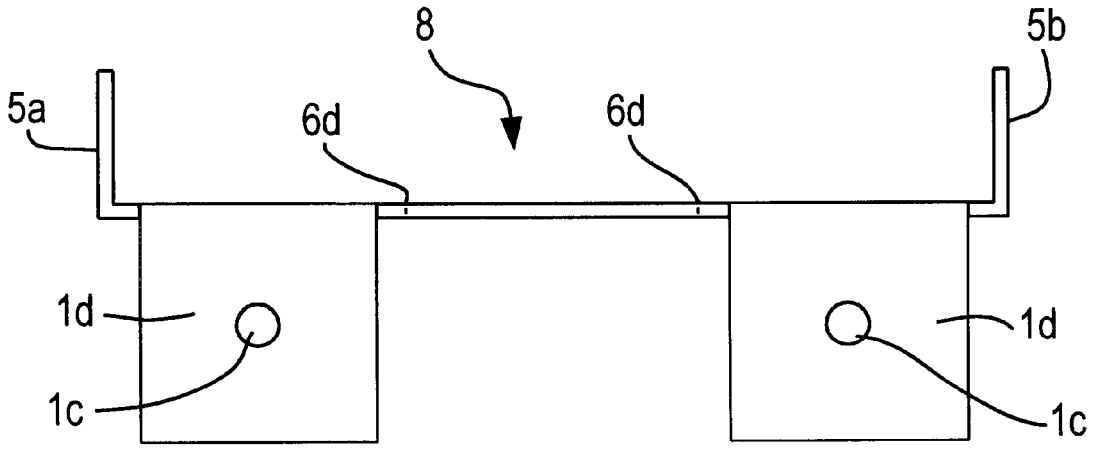
FIG. 51 is a front view of a primary intermediate product used for manufacturing of the prism pipe body depicted in FIG. 42.
Figure 52:
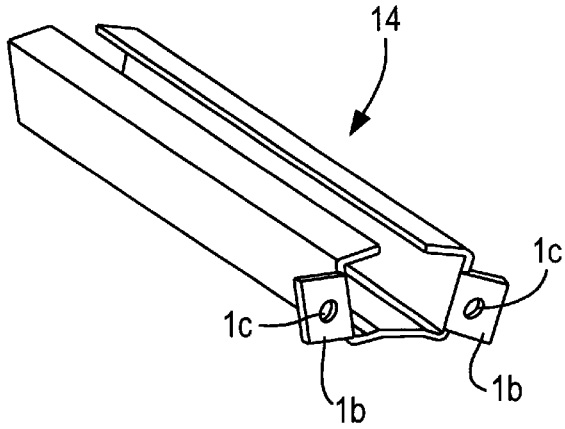
FIG. 52 is a perspective view of a secondary intermediate product formed by using the primary intermediate product depicted in FIG. 51.

Accordingly, the primary intermediate product 8 shown in FIG. 51 is formed. Then the primary intermediate product 8 shown in FIG. 51 is pressed by the presser 17 shown in FIG. 9 to form the second intermediate product 14 shown in FIG. 52. Then the secondary intermediate product 14 is mounted and pressed to and by means of any one of pressers 21 shown in FIGS. 13, 21, and 28 to thereby form a prism pipe body 1 shown in FIG. 42.

Figure 53:
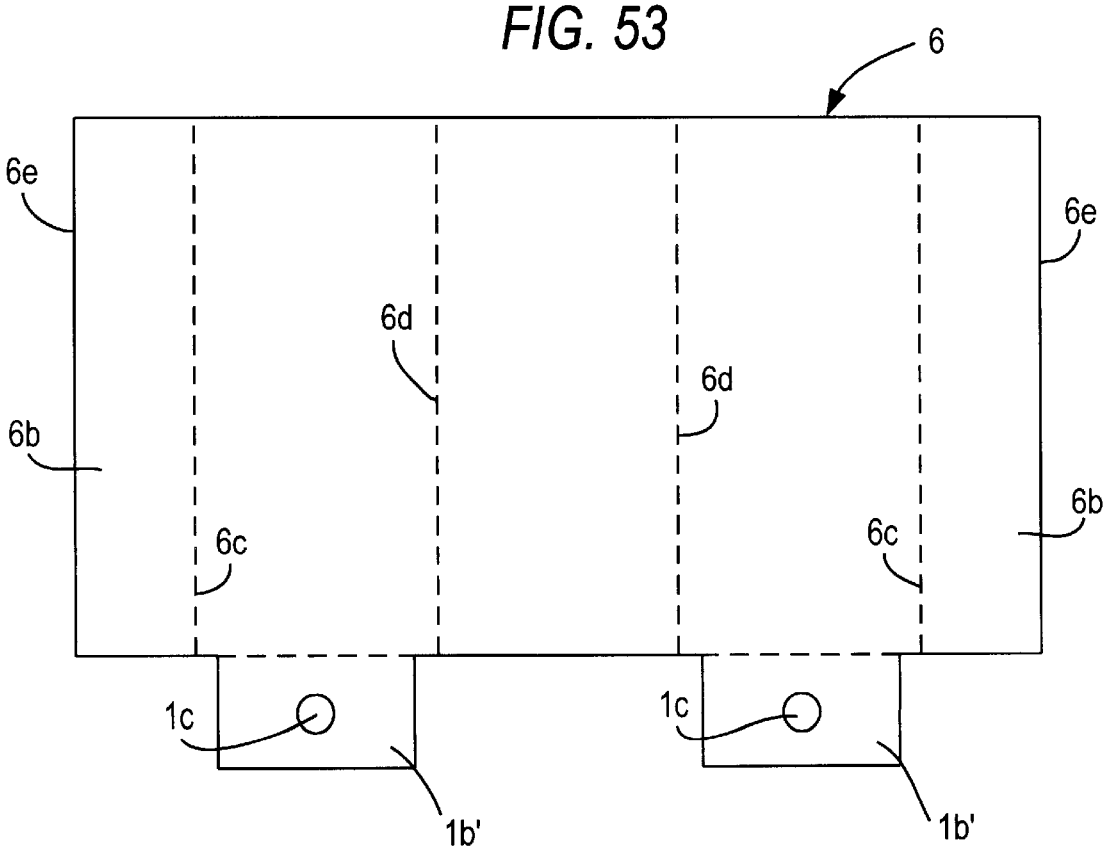
FIG. 53 is a plane view of a metal plate used for manufacturing the prism pipe body depicted in FIG. 43.

In manufacturing the prism pipe body 1 shown in FIG. 43, a metal plate 6 shown in FIG. 53 is used. A pair of fastening plates 1*b*' and 1*b*" are previously formed on the metal plate 6 by means of a punching operation. Before a primary intermediate product 8, the pair of fastening plates 1*b*' and 1*b*' of metal plate 6 stand in inside.

Figure 54:
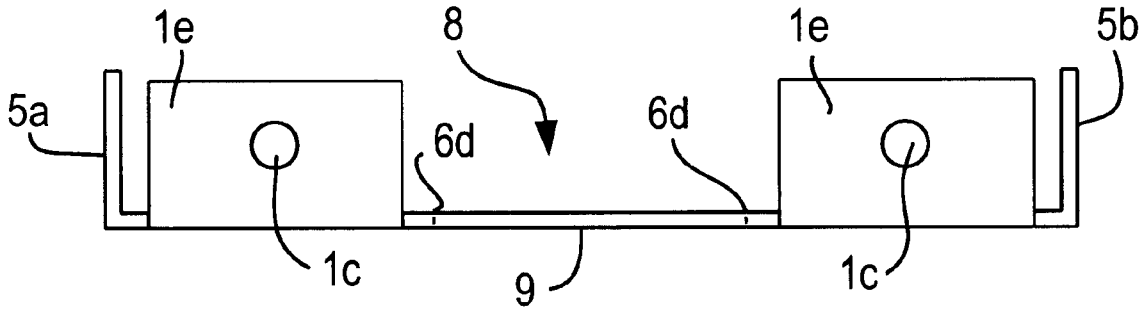
FIG. 54 is a front view of a primary intermediate product formed by using the metal plate depicted in FIG. 53.

Then the metal plate 6 is mounted to a presser 10 shown in FIG. 5 and is pressed by means of the presser 10 to form a primary intermediate product 8 shown in FIG. 54. Then the primary intermediate product 8 shown in FIG. 54 is mounted to a presser 17 shown in FIG. 9 and is pressed by means of the presser 17 to thereby form a secondary intermediate product 14 shown in FIG. 55.

Figure 55:
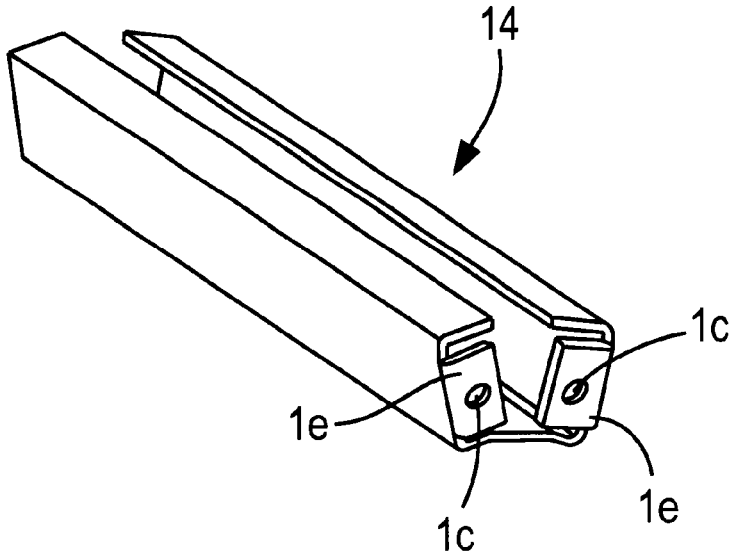
FIG. 55 is a perspective view of a secondary intermediate product formed by using the primary intermediate product depicted in FIG. 54.

Then the secondary intermediate product 14 shown in FIG. 55 is mounted and pressed to and by means of any one of pressers 21 shown in FIGS. 13, 21, and 28 to thereby form a prism pipe body 1 shown in FIG. 43.

(4) [Example 2 of a Prism Pipe Body Having a Fastening Plate]

Figure 44A:
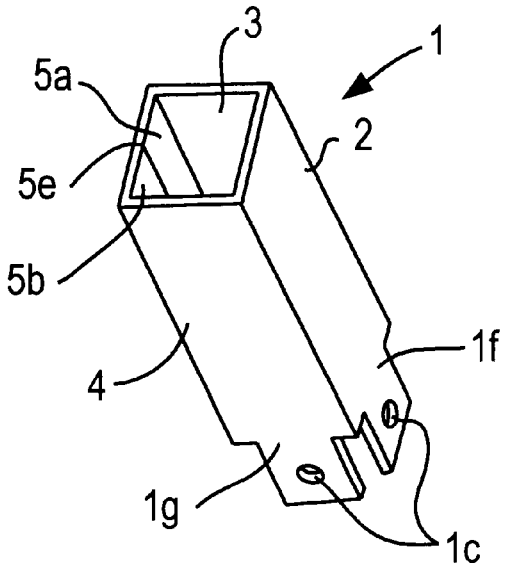
FIG. 44 is views showing a prism pipe body with a fastening plate integrally formed, wherein FIG. 44(*a*) shows a prism pipe body having a perpendicular fastening plate which is formed on a pair of said walls and a bottom wall, and FIG. 44(*b*) is a view showing the prism pipe body depicted in FIG. 44(*a*) attached to a corner of a base member.
Figure 44B:
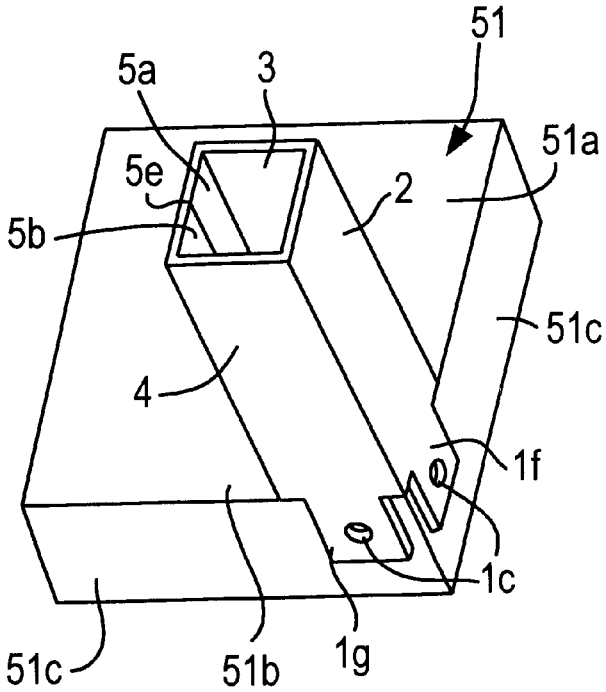

Rectangular fastening plates 1*f* and 1*g* are formed on a section portion 1*a* of the prism pipe body 1 shown in FIG. 44(*a*). The rectangular fastening plates 1*f* and 1*g* are formed rectangular to each other. The rectangular fastening plate 1*f* protrudes parallel from the bottom wall 2. The rectangular fastening plate 1*g* protrudes parallel from one side wall 4.

The prism pipe body 1 shown in FIG. 44(*a*) is fixed to a corner 51*b* of an upper portion 51*a* of the regular block member 51, by facing to a section portion 1*a* thereof to the corner 51*b* and facing to the rectangular plate 1*f* and 1*g* to side portions 51*c* and 51*c* of the rectangular block member 51 to screw the rectangular fastening plates 1*f* and 1*g* to the side portions 51*c*, as shown in FIG. 44(*b*).

According to the prism pipe body 1 shown in FIG. 44(*a*), since the prism pipe body 1 can be mounted to the rectangular block member 51 from two directions right angle to each other, a mounting strength of the prism pipe body 1 shown in FIG. 44(*a*) is improved compare with a fastening plate structure shown in FIGS. 41 through 43.

Figure 45A:
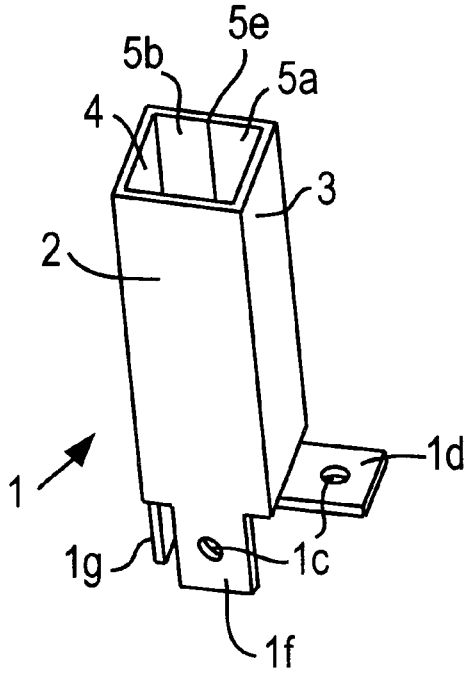
FIG. 45 is views showing a prism pipe body with a fastening plate integrally formed, wherein FIG. 45(*a*) shows a prism pipe body having a perpendicular fastening plate which is formed on a pair of side walls and a bottom wall, and FIG. 45(*b*) is a view showing the prism pipe body depicted in FIG. 45(*a*) attached in a corner of a base member at three ways.
Figure 45B:
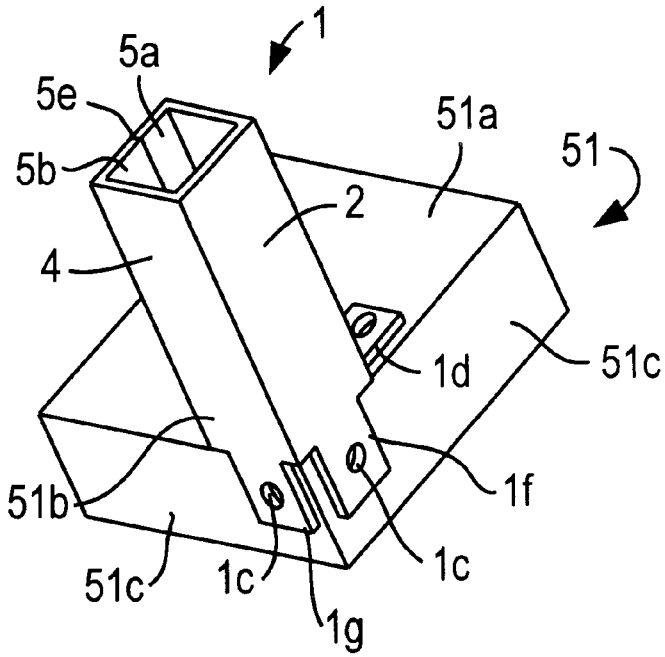

The prism pipe body 1 shown in FIG. 45(*a*) has a curved fastening plate 1*d* which is further curved in an outer side of a side wall 3 in another direction of the prism pipe body 1 shown in FIG. 44(*a*). The curved fastening plate 1*d* is the right angle to rectangular fastening plates 1*f* and 1*g*.

The prism pipe body 1 shown in FIG. 45(*a*) is fixed to a corner 51*b* of an upper portion 51*a* of the rectangular block member 51, by facing to a section portion 1*a* thereof with a curved fastening plate 1*d* to the upper portion 51*a*, and facing to the rectangular fastening plates 1*f* and 1*g* to side portions 51*c* and 51*c* of the rectangular block member 51 to screw the curved fastening plate 1*d* to the upper portion 51*a* and to screw the rectangular fastening plates 1*f* and 1*g* to the side portion 51*c* and 51*c*.

According to the prism pipe body 1 shown in FIG. 45(*a*), since the prism pipe body 1 can be mounted to the rectangular block member 51 from three directions right angle to one another, a mounting strength of the prism pipe body 1 shown in FIG. 45(*a*) is improved comparing with a fastening plate structure shown in FIG. 44(*a*).

Figure 46A:
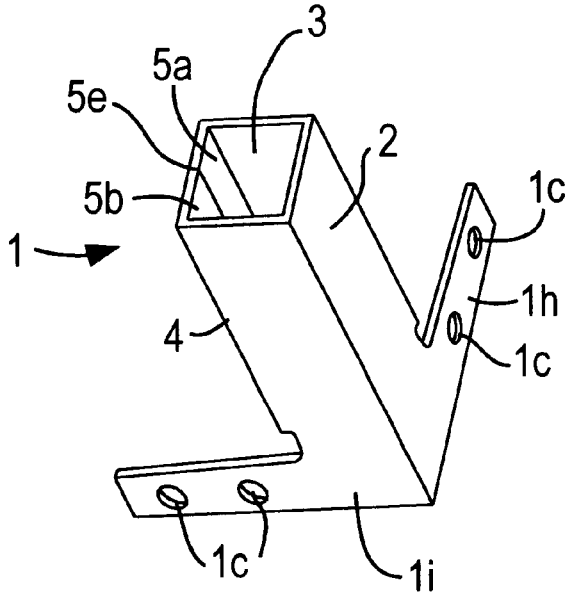
FIG. 46 is views showing a prism pipe body with a fastening plate integrally formed, wherein FIG. 46(*a*) shows a prism pipe body having a "L" shaped fastening plate which is formed on a pair of side walls and a bottom wall, and FIG. 46(*b*) is a view showing the prism pipe body depicted in FIG. 46(*a*) attached to a corner of base member.
Figure 46B:
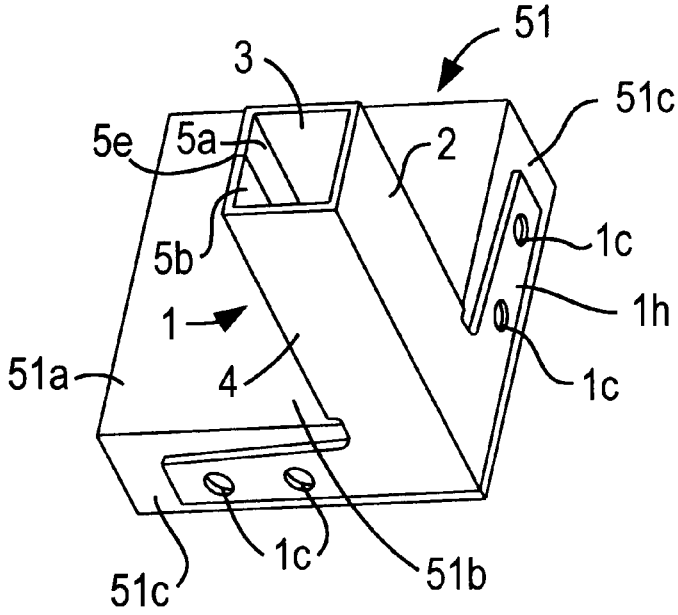

The prism pipe body 1 shown in FIG. 46(*a*) has L shaped fastening plates 1*h* and 1*i* which are formed on a bottom wall 2 and a side wall 4 and the L shaped fastening plates 1*h* and 1*i* are perpendicular to each other. The L shaped fastening plates 1*h* and 1*i* extend in a direction which the side portion 51*c* extends.

The prism pipe body 1 shown in FIG. 46(*a*) is fixed to a corner 51*b* of the rectangular shaped block member 51, for example, by facing to a section portion 1*c* of the prism pipe body 1 to the corner 51*b* of the rectangular shaped block member 51 and screwing the L shaped fastening plates 1*h* and 1*i* along the side portion 51*c*, as shown in FIG. 46(*b*).

According to the prism pipe body 1 shown in FIG. 46(*a*), since a junction area between a fastening plate and the side portion 51*c* can readily be assured, a mounting strength of the prism pipe body 1 shown in FIG. 46(*a*) improved when comparing with the prism pipe body 1 shown in FIG. 44(*a*).

Figure 47A:
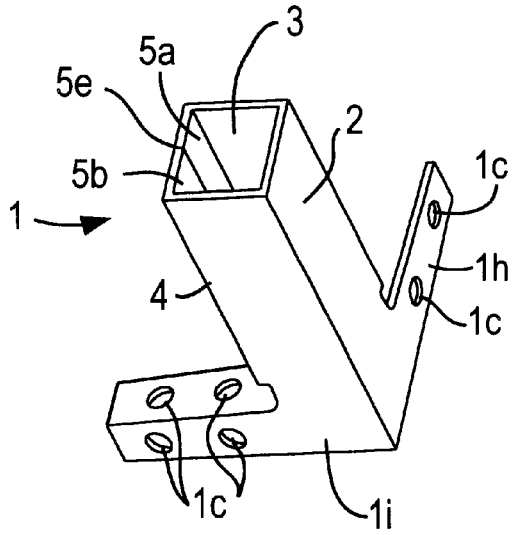
FIG. 47 is views showing a prism pipe body with fastening plates integrally formed, wherein FIG. 47(*a*) is a view showing a prism pipe body having "L" shaped fastening plate which is formed on a pair of side walls and a bottom wall, and a bent fastening plate formed on one of the "L" shaped fastening plate, FIG. 47(*b*) is a view showing a prism pipe body having "L" shaped fastening plate which is formed on one of the pair of side walls and a bottom wall, and a bent fastening plate formed on other one of the pair of side wall, and FIG. 47(*c*) is a view showing the prism pipe body depicted in FIG. 47(*b*) attached to a corner of an attaching member.
Figure 47B:
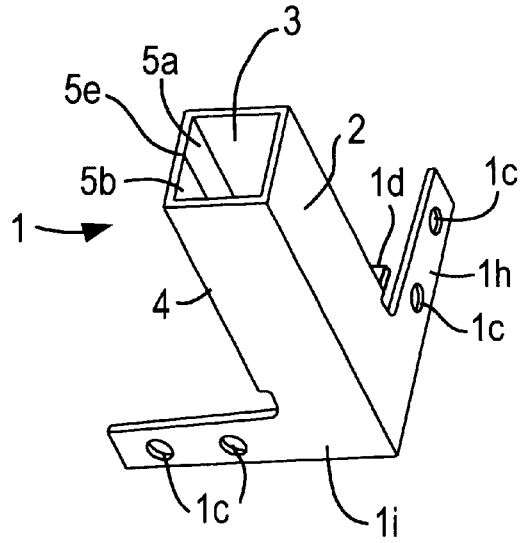
Figure 47C:
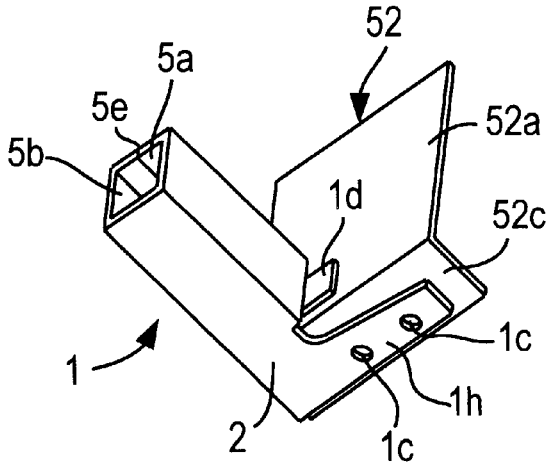

The prism pipe body 1 shown in FIG. 47(*a*) includes a curved fastening plate 1*i* additionally which is further formed on the L shaped fastening plate 1*i* of the prism pipe body shown in FIG. 46(*a*). The curved fastening plate 1*j* is a right angle to the L shaped fastening plate 1*i*.

The prism pipe body 1 shown in FIG. 47(*b*) includes a curved fastening plate 1*d* which is formed on a side wall 3 in the other direction of the prism pipe body 1 shown in FIG. 46(*a*).

The prism pipe body 1 shown in FIG. 47(*b*) is fixed to a mounted member 52, for example, by screwing the L shaped fastening plates 1*h* and 1*i* to side portion 52*c* and 52*c* of the mounted member 52 and screwing the curved fastening plate 1*d* to an upper side 52*a*.

According to the prism pipe body 1 shown in FIGS. 47(*a*) and 47(*b*), since the prism pipe body 1 can be screwed to another member from three directions right angle to one another, a mounting strength of the prism pipe body 1 shown in FIGS. 47(*a*) and 47(*b*) is more improved when comparing with a fastening plate structure shown in FIG. 46(*a*).

According to the prism pipe body 1 shown in FIGS. 44 through 47, when the prism pipe body 1 is mounted to the mounted member to form a frame assembly which will be described later, the seam 5*e* is formed in an inner direction so that it is difficult to be seen from an outer side. Therefore, an external appearance of the frame assembly is improved.

[Method for Manufacturing Prism Pipe Body of Item (4)]

Figure 56:
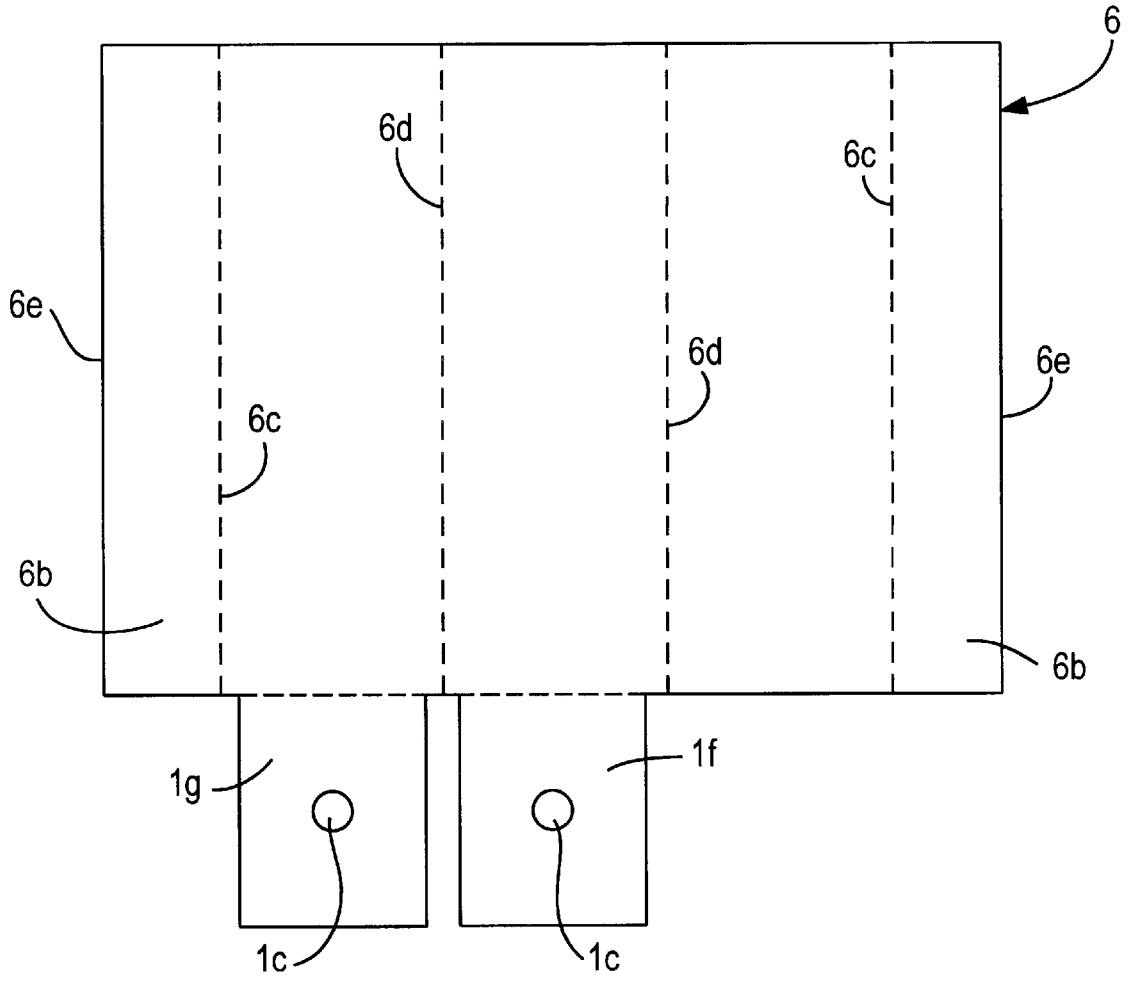
FIG. 56 is a plane view of a metal plate used for manufacturing of the prism pipe body depicted in FIG. 44.
Figure 57:
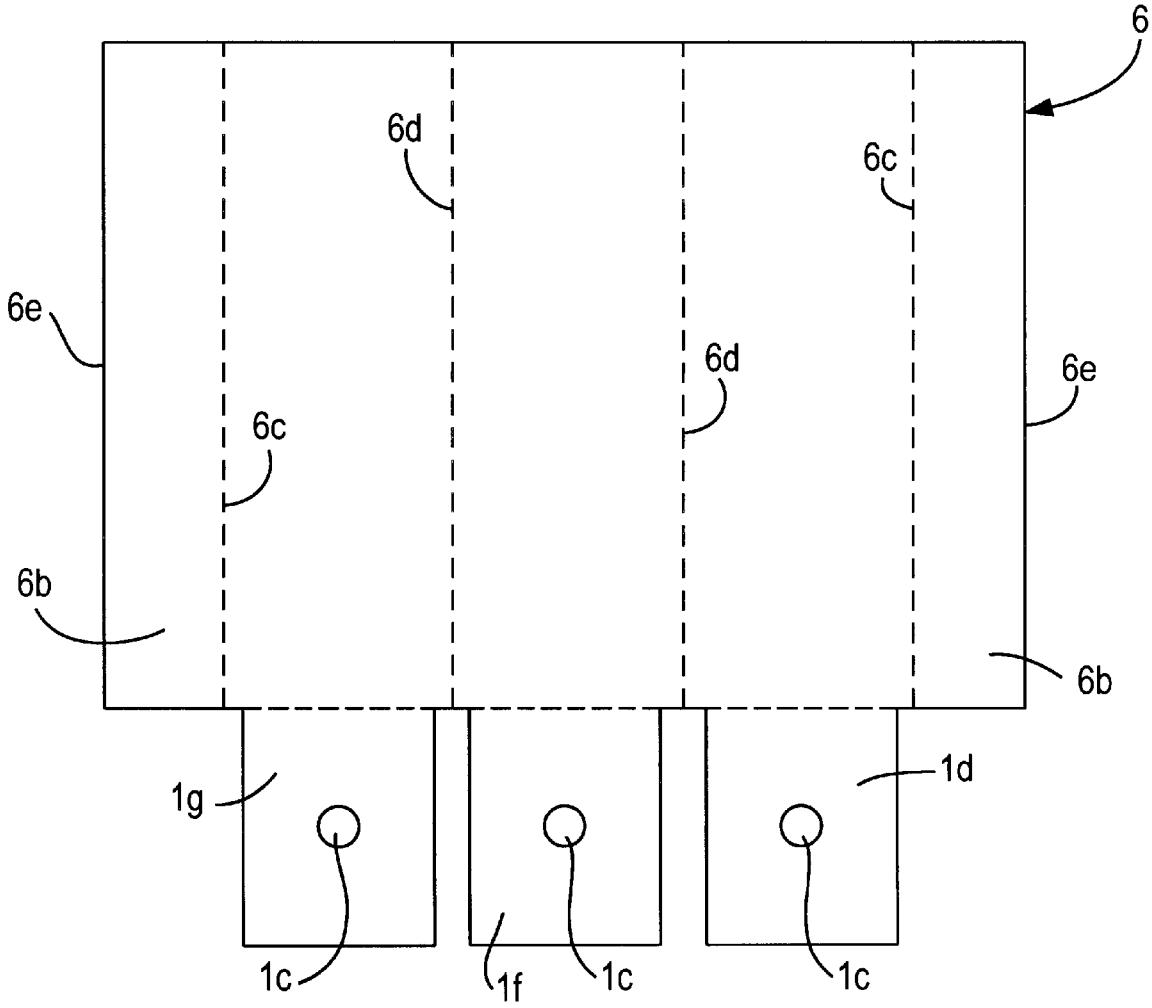
FIG. 57 is a plane view of a metal plate used for manufacturing of the prism pipe body depicted in FIG. 45.
Figure 58:
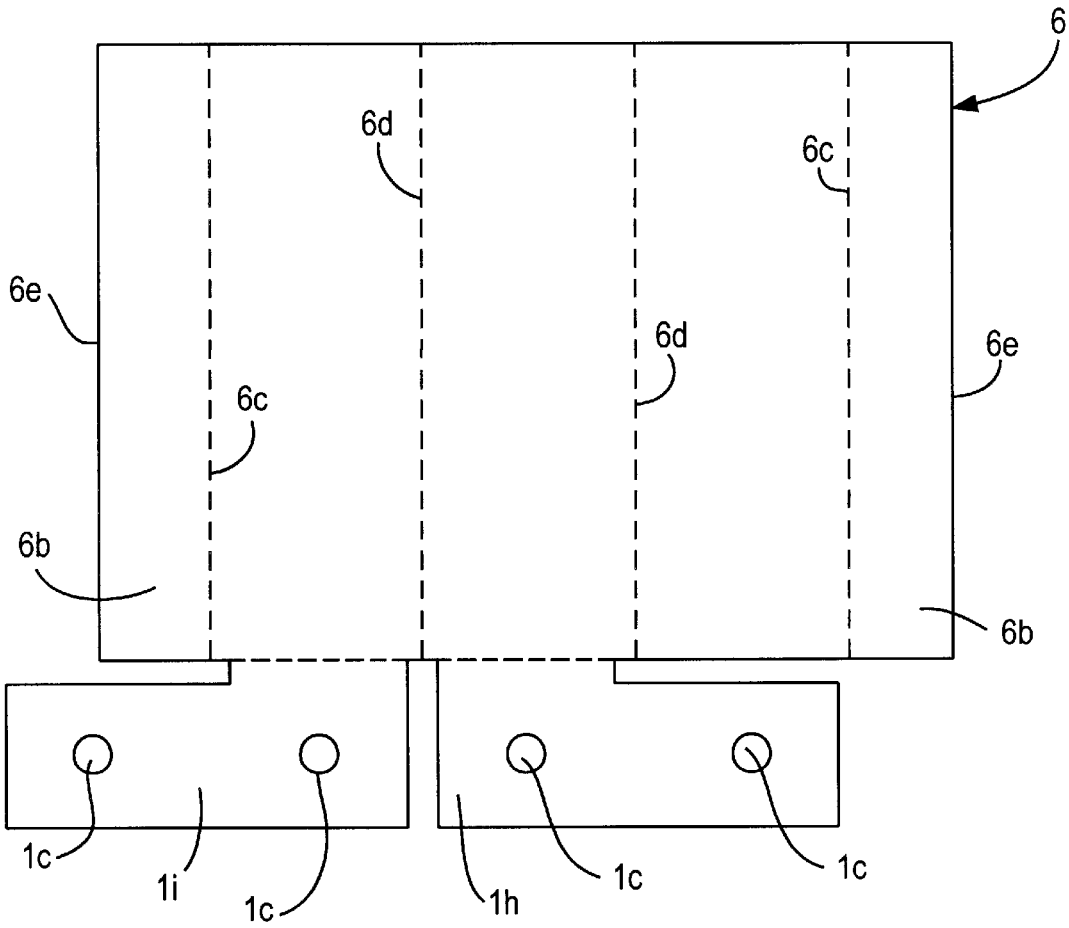
FIG. 58 is a plane view of a metal plate used for manufacturing of the prism pipe body depicted in FIG. 46.

In manufacturing the prism pipe body 1 shown in FIG. 44, a metal plate 6 shown in FIG. 56 is used. In manufacturing the prism pipe body 1 shown in FIG. 46, a metal plate 6 shown in FIG. 57 is used. In manufacturing the prism pipe body 1 shown in FIG. 46, a metal plate 6 shown in FIG. 58 is used.

The metal plate 6 is pressed by the same pressing method to form a first intermediate product 8 and a second intermediate product 14. The second intermediate product 14 is mounted and pressed to and by a presser 21 shown in FIGS. 13, 21, and 28 to form the prism pipe body shown in FIGS. 44 through 46.

Figure 59:
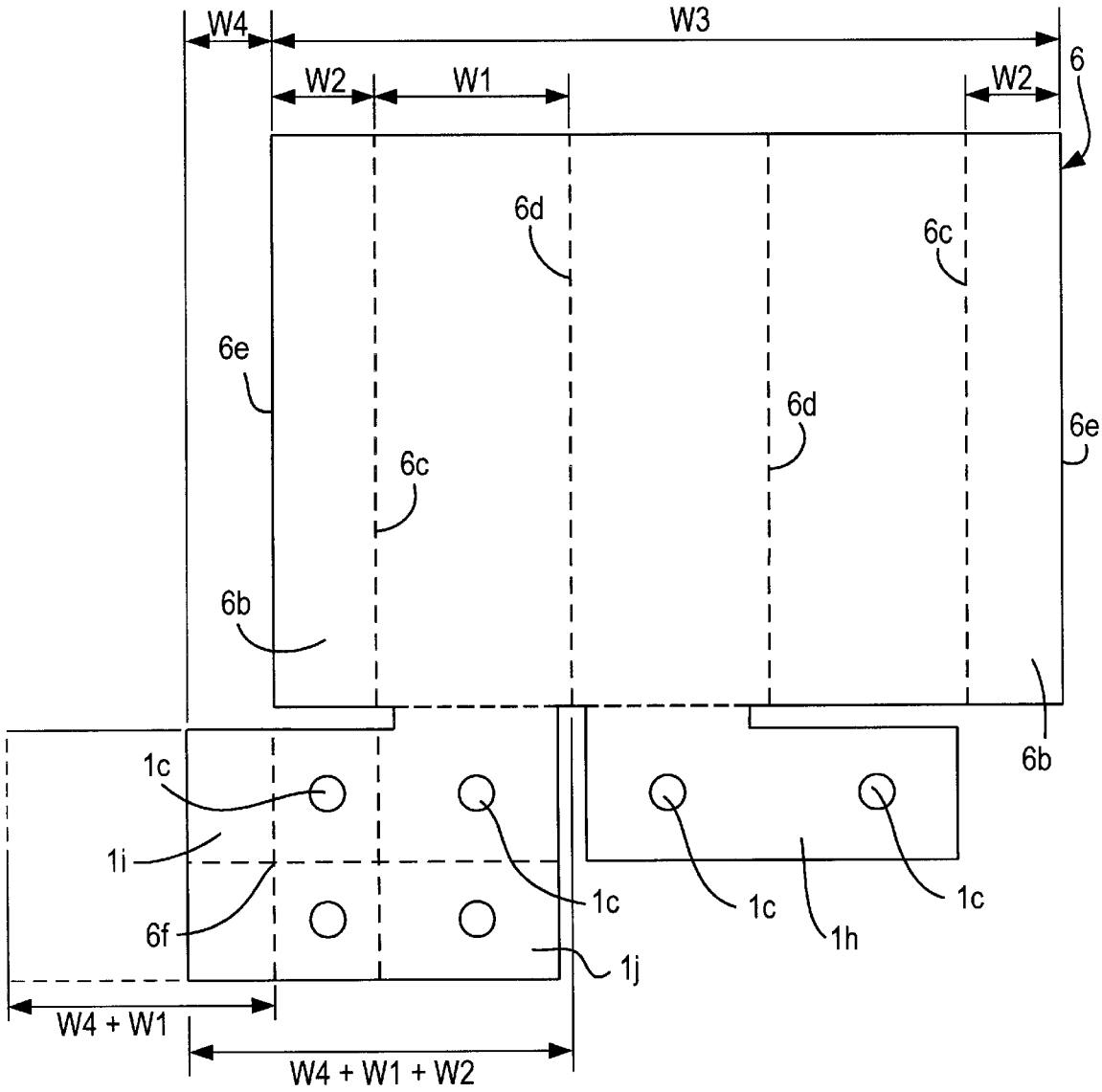
FIG. 59 is a plane view of a metal plate used for manufacturing of the prism pipe body depicted in FIG. 47(*a*)

Also, in the prism pipe body 1 shown in FIG. 47(*a*), a metal plate 6 shown in FIG. 59 is stood in advance along a broken line 6*f* and is pressed to form a primary intermediate product 8. The description of the metal plate 6 used for manufacturing of the prism pipe body 1 shown in FIG. 47(*b*) is omitted.

However, when forming L shaped fastening plates 1*h* and 1*i* at wall including seams 5*a* and 5*b*, since a width of the prism pipe body 1 is not efficiently used, a problem with mounting strength of the prism pipe body 1 is generated.

That is, when forming fastening plates at wall including seams 5*a* and 5*b*, since a width W2 from a broken line 6*c* to a side 6*c*is about half of a width W1 from a broken line 6*d* to a broken line 6*c*, a mounting strength of the fastening plates is decreased. But, since the prism pipe body 1 shown in FIGS. 44 through 47, the fastening plates are formed on walls other than junction walls 5*a* and 5*b*, accordingly, as shown in FIG. 59, the width W1 (a width of a surface of the prism pipe body 1) from the broken line 6*d* to the broken line 6*c* can be efficiently used so that a mounting strength of fastening plates in this case is more improved than a case in which the fastening plates are formed on wall including seams 5*a* and 5*b*.

Also, according to the prism pipe body 1 shown in FIGS. 44 through 47, the fastening plates are formed on walls other than wall including seams 5*a* and 5*b*. Accordingly, a width W3 of a rectangular metal plate 6 which is used as a material to form the prism pipe body 1 can be efficiently used.

That is, in the prism pipe body 1 shown in FIGS. 44 through 47, in order to form L shaped fastening plates 1*i* and 1*h* having a length of about (W1+W2+W4), a metal plate having a width of (W1+W4) may be used. However, in order to form the fastening plates at wall including seams 5*a* and 5*b*, a metal plate having a width of (W1+W4+W3) should be used. Thus, a material having a broad width by width (W1+W4) needs to thereby decrease an application of a material.

(5) [Prism Pipe Body Having a Portion for Tolerance]

Figure 60:
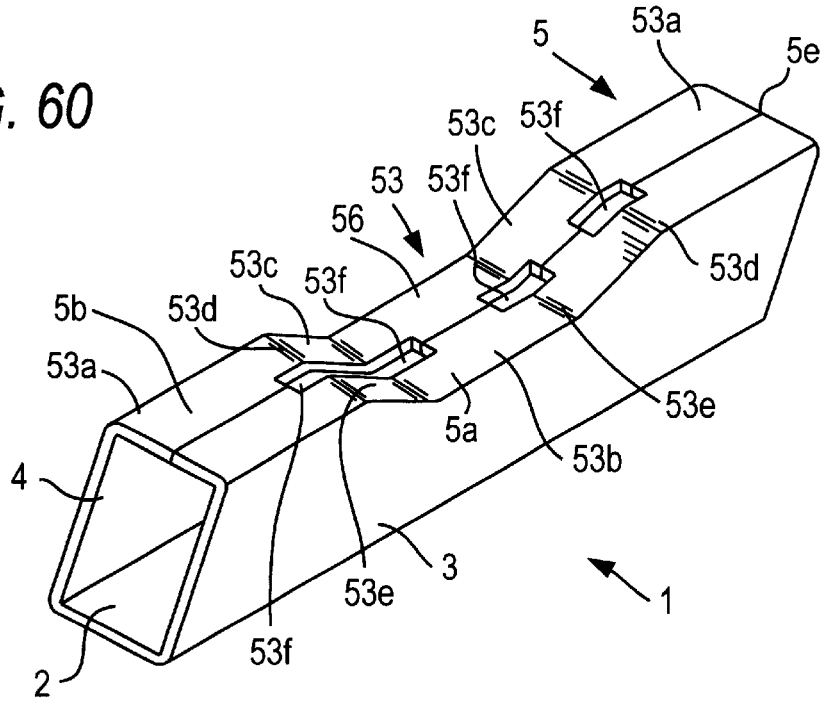
FIG. 60 is a perspective view of a prism pipe body according to the present invention having a portion for tolerance.

A closed section shape of a prism pipe body 1 shown in FIG. 60 is a rectangular shape. An interference preventing portion for tolerance 53 is formed on an upper wall 5 of the prism pipe body 1. The interference preventing portion for tolerance 53 is formed from below explanation.

The prism pipe body 1 is used as a component which manufactures a frame assembly such as a copy machine. The frame assembly includes a copy machine forming unit as an image forming device.

The copy machine forming unit has a complex shape. Accordingly, when a copy machine forming unit is received in the frame assembly, the prism pipe body 1 and the copy machine forming unit are apt to interfere with each other.

Also, in order to substitute another copy machine forming unit for the copy machine forming unit received in the prism pipe body 1, when separating the received copy machine forming unit therefrom, the copy machine forming unit can interfere with the prism pipe body such as contacting with the prism pipe body 1. Also, when maintaining the received copy machine forming unit, a maintenance tool can contact with the prism pipe body 1.

Because of these kinds of reasons, the interference preventing portion for tolerance 53 is formed at the prism pipe body 1.

The upper wall 5 of the prism pipe body 1 includes continuous curved walls having different heights to the bottom wall 2 in order to form the interference preventing portion for tolerance 58.

That is, the upper wall 5 includes flat surfaces 53*a* and 53*a* and slope portions 53*c* and 53*c*. The flat surfaces 53*a* are located at both sides of the interference preventing portion for tolerance 53. The slope portions 53*c* forms the interference preventing portion for tolerance 53 with the flat surfaces 53*b*. The slope portions 53*c* are continuously connected to the flat surfaces 53*a* through a curved portion 53*d*. The slope portions 53*c* are continuously connected to the flat surface 53*b* through a curved portion 53*e*.

An opening portion 53*f* is formed on the curved portions 53*d* and 53*e*. The reason that the opening portion 53*f* is formed will be described when describing the method for manufacturing the prism pipe body 1 later.

According to the prism pipe body 1, while avoiding a decline of a local strength caused by forming the interference preventing portion for tolerance 53 at the prism pipe body 1, the interference preventing portion for tolerance 53 can be formed at the prism pipe body 1.

Figure 61:
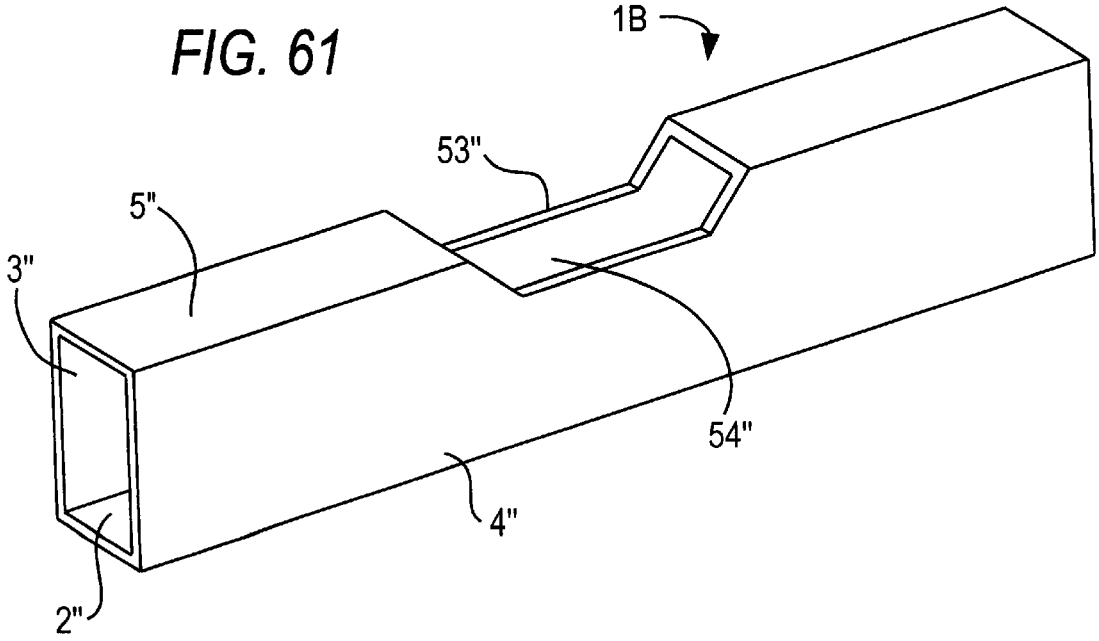
FIG. 61 is a perspective view of a prism pipe body having a portion for tolerance of the prior art.

That is, as shown in FIG. 61, a conventional prism pipe body 1B not having a seam is used for a frame assembly. An electric sewing pipe body or pressing material is an example of the conventional prism pipe body 1B.

In the prism pipe body 1B shown in FIG. 61, in order to form an interference preventing portion for tolerance 53" at a upper wall 5", when cutting a part of the upper wall 5", a hole 54 is opened at a place corresponding to the interference preventing portion for tolerance 53". Accordingly, when forming the interference preventing portion for tolerance 53" at the prism pipe body 1B, a strength of a forming place of the interference preventing portion for tolerance 53" is decreased.

That is, in the frame assembly formed by using the prism pipe body 1B shown in FIG. 61, shaking based on a bending transformation and vibration is apt to increase. Accordingly, when the frame assembly is used as the copy machine without using any hands, an image stress distortion is apt to be generated. Also, in FIG. 61, a reference numeral 2" represents a bottom wall, and reference numeral 3" and 4" represent side walls.

Conventionally, in order to solve the problem, a reinforcement countermeasure of the frame assembly has been performed.

Accordingly, the number of processes and a cost are increased. One the contrary, when the prism pipe body shown in FIG. 60 is used, in manufacturing the prism pipe body 1, since the prism pipe body can leave the interference preventing portion for tolerance 53 having continuous curved walls, an increase in the cost can be prevented.

[Method for Manufacturing Prism Pipe Body Having a Portion for Tolerance]

Figure 62:
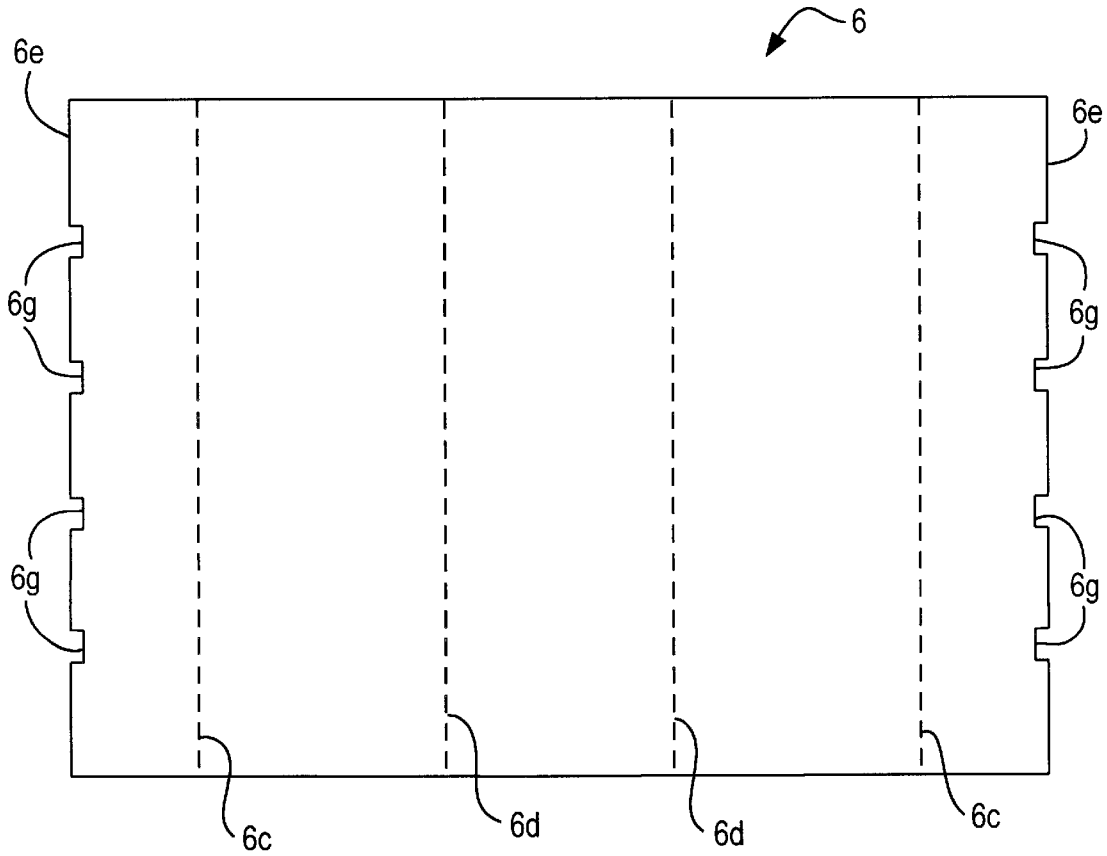
FIG. 62 is a plane view of a metal plate used for manufacturing of the prism pipe body depicted in FIG. 60.

In manufacturing the prism pipe body 1 shown in FIG. 60, the metal plate 6 shown in FIG. 62 is used. In the metal plate 6, a slot 6*g* is formed at a place corresponding to a place at which curved portions 53*d* and 53*e* are formed.

Figure 63:
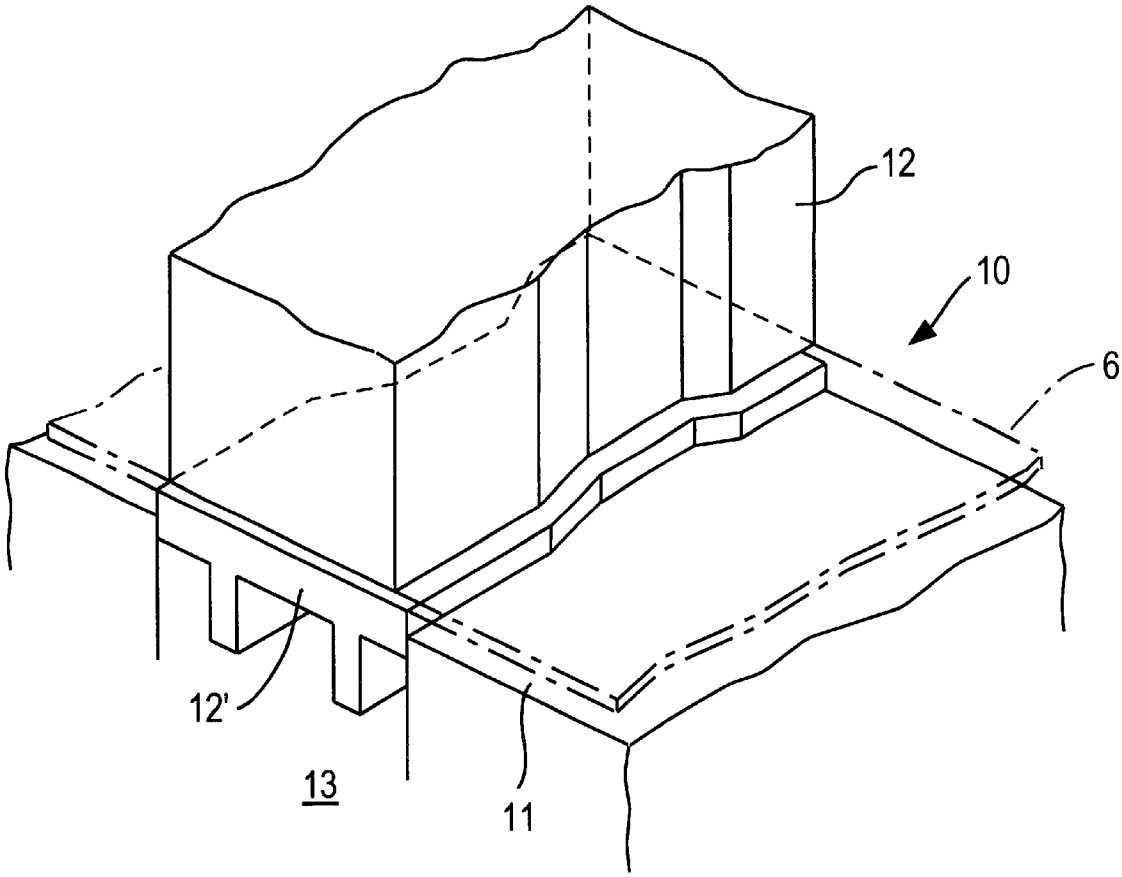
FIG. 63 is a perspective view of a pressing apparatus used for manufacturing of the primary intermediate product depicted in FIG. 64.
Figure 64:
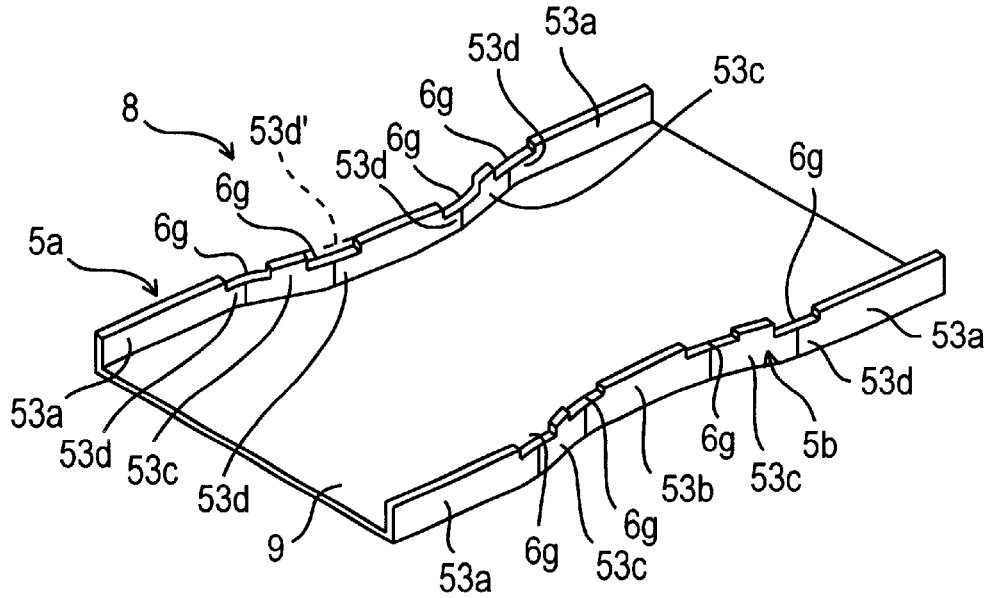
FIG. 64 is a perspective view of a primary intermediate product formed by using the metal plate depicted in FIG. 62.

The metal plate 6 is mounted and pressed to and by a press forming device 10 shown in FIG. 63 to form a primary intermediate product 8 shown in FIG. 64. In FIG. 64, the same reference numerals are allotted to the same configuration elements shown in FIG. 4 as the primary intermediate product 8.

Figure 68A:
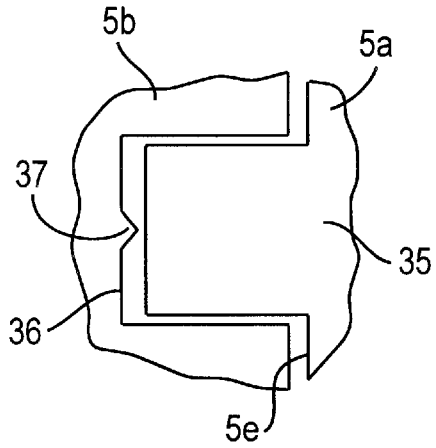
FIG. 68 is views illustrating a prism pipe body with a wall including seam which is consisted by engagement, wherein FIG. 68(*a*) is a partial enlarged view showing a state before engagement, FIG. 68(*b*) is a partial enlarged view showing a state after engagement, and FIG. 68(*c*) is a perspective view showing the whole structure.
Figure 68B:
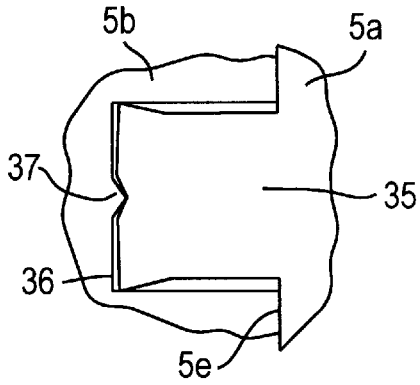
Figure 68C:
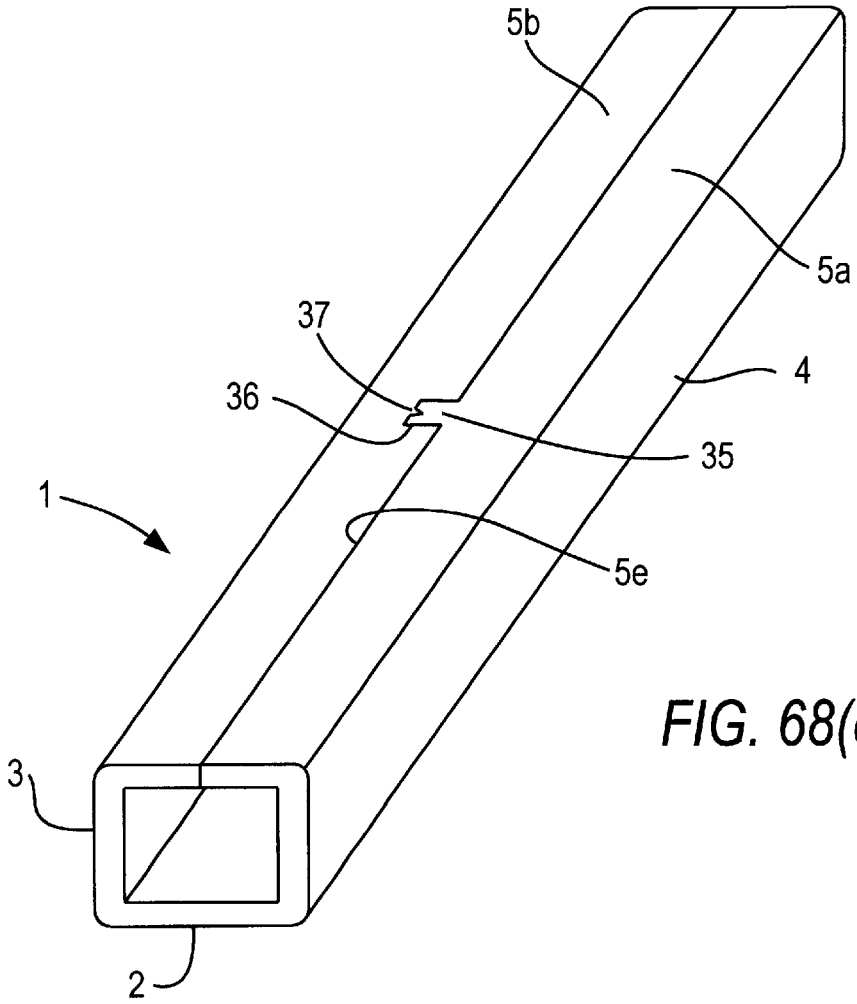

When wall including seams 5*a* and 5*b* are stood up and formed by a presser 10 shown in FIG. 68, flat portions 53*a* and 53*b*, a slope portion 53*c*, and curved portions 53*d* and 53*e* formed at a primary intermediate product 8 shown in FIG. 64.

Punch surfaces of the fixed plate 11, press punching member 12, and movable plate 12' have shapes corresponding to an outer shape of the primary intermediate product 8 shown in FIG 64.

When the primary intermediate product 8 is formed by a press forming operation, a stress distortion transformation (for example, expansion) is generated at an end edge 53*d*' of the curved portion 53*d*. The slot 6*g* is formed to remove the transformation of the end edge 53*d*'.

Figure 65:
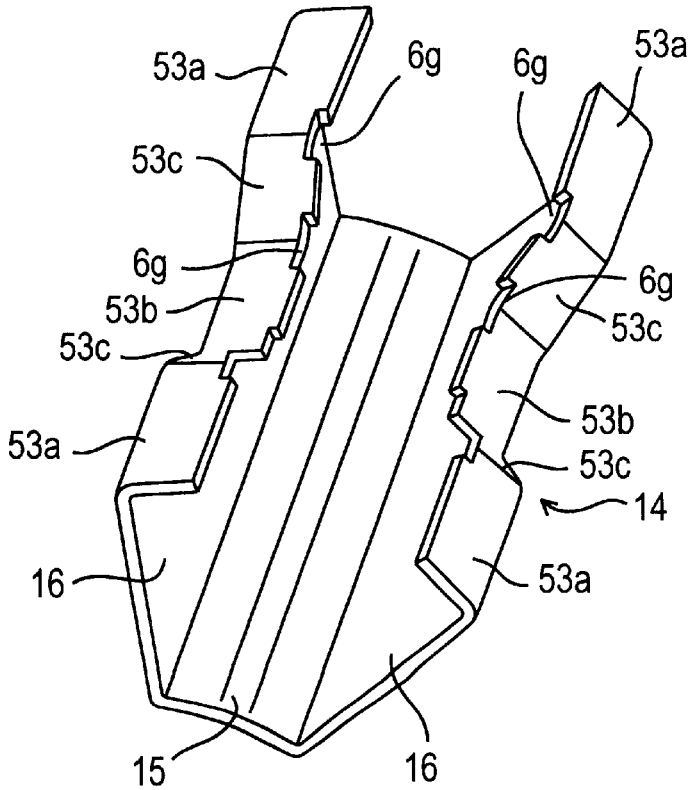
FIG. 65 is a perspective view of a secondary intermediate product formed by using the primary intermediate product depicted in FIG. 64.

Then the primary intermediate product 8 is mounted and pressed to and by the press forming device 17 shown in FIG. 9 to form a secondary intermediate product 14 shown in FIG. 65. Then the secondary intermediate product 14 is mounted and processed to and by any one of press forming devices 21 shown in FIGS. 13, 21, and 28 to finally obtain a prism pipe body 1 shown in FIG. 60.

Figure 66:
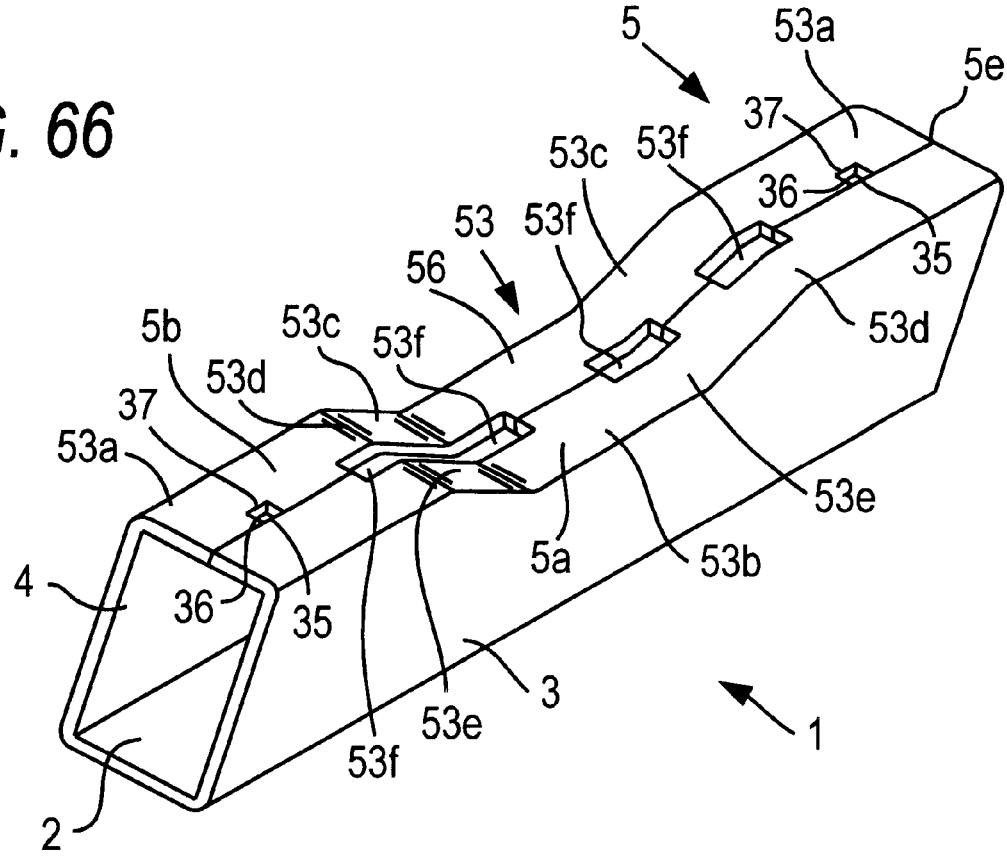
FIG. 66 is a perspective view showing another example of the prism pipe body depicted in FIG. 60.

Also, the prism pipe body 1 shown in FIG. 66 is a modified example of the square pipe body 1 shown in FIG. 60. An engaging protrusion 35 is formed on a wall including seam 5*a*. An engaging concave portion 36 is formed on the wall including seam 5*b*. A protrusion 37 is tapered into the engaging concave portion 36 so that adhesion of the wall including seam 5*a* is guaranteed. The prism pipe body 1 will be described in detail by using a prism pipe body 1 shown in FIG. 67.

(6) [Prism Pipe Body Having Caulking]

Figure 67:
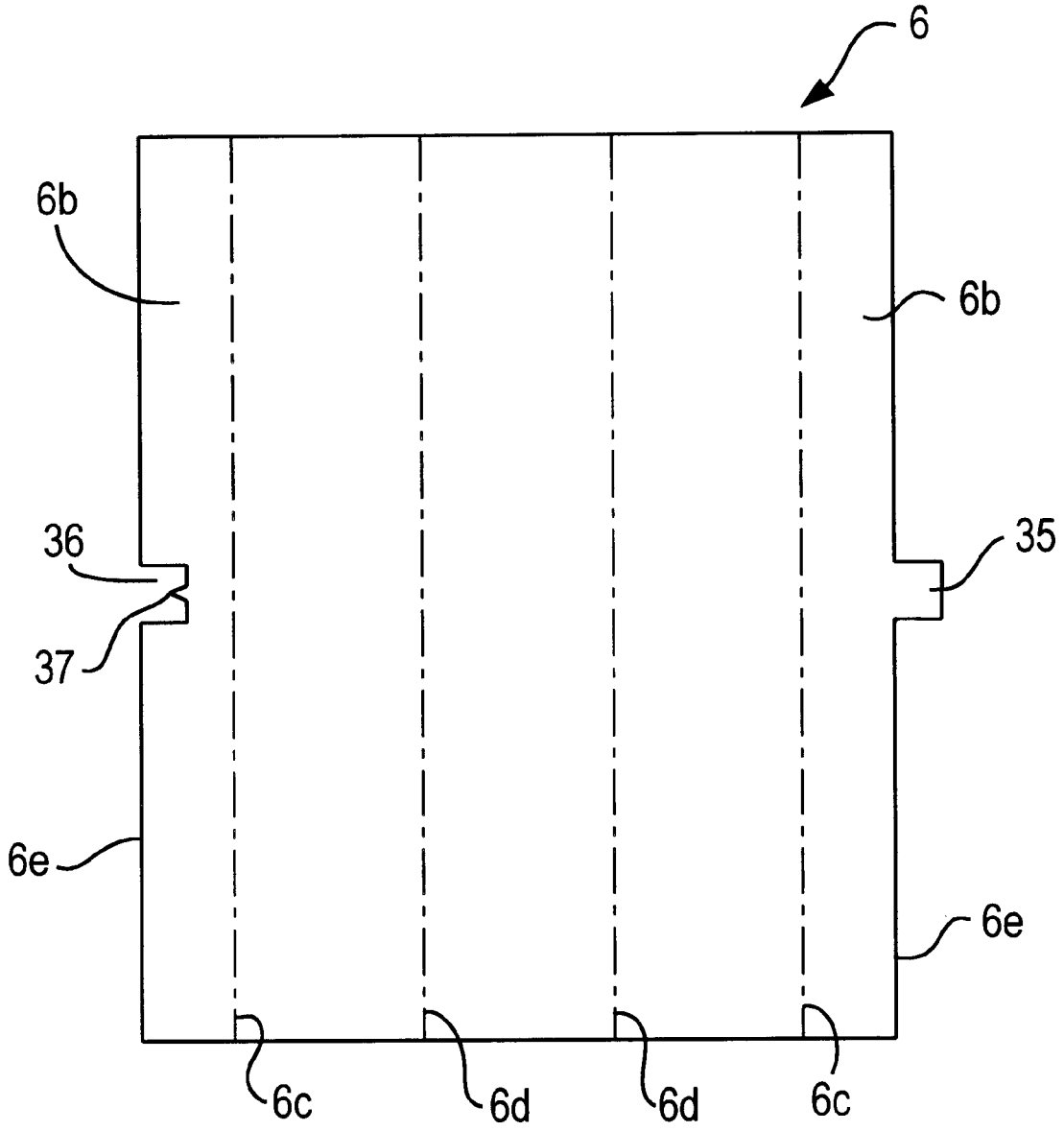
FIG. 67 a plane view of a metal plate used for manufacturing of the prism pipe body depicted in FIG. 68.

In the above mentioned description, the prism pipe body 1 is excluded shown in FIG. 66, and an adhesion state of a seam 5*e* is assured based on a spring back force. However, as shown in FIG. 67, engaging protrusion 35 and engaging concave portion 36 as engaging portion are formed on sides 6*b* and 6*b* of a metal plate 6. A triangular taper protrusion 37 is formed on the engaging concave portion 36 shown in FIG. 68(*a*) and is tapered into the engaging protrusion 35. And enlarged as shown in FIG. 68(*b*), the engaging protrusion 35 is contacted and fitted into the engaging concave portion 36. The engaging protrusion 35 is transformed by the triangular taper protrusion 37, and a pair of wall including seams 5*a* and 5*b* engage with each other. FIG. 68(*c*) shows a prism pipe body 1 formed by the method.

In the triangular taper protrusion 37, as shown in FIG. 68(*b*), an end portion of engaging protrusion 35 of the prism pipe body 1 is transformed toward both side edges of the engaging concave portion 36. The transformation causes a part of the engaging protrusion 35 to come in contact with both side edges of the engaging concave portion 36.

According to the prism pipe body 1, adhesion of a pair of wall including seams 5*a* and 5*b* based on spring back force generated in assured when it returns to a curved convex portion. In addition to this, the adhesion of the pair of wall including seam 5*a* and 5*b* is assured by fitting and fastening between engaging portions.

Figure 69A:
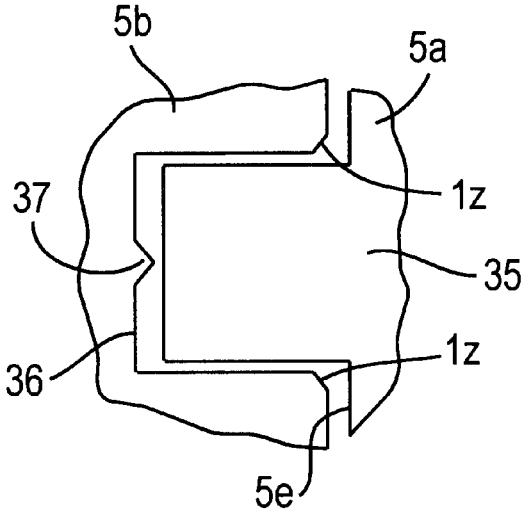
FIG. 69 shows various examples of engaging protrusion and engaging dent depicted in FIG. 68, wherein FIG. 69(*a*) shows a wall including seam with the engaging dent having a guide portion on an opened end, 69(*b*) shows a wall including seam with the engaging protrusion having a guide portion on front end, and FIG. 69(*c*) shows a wall including seam with guide portions at both ends.
Figure 69B:
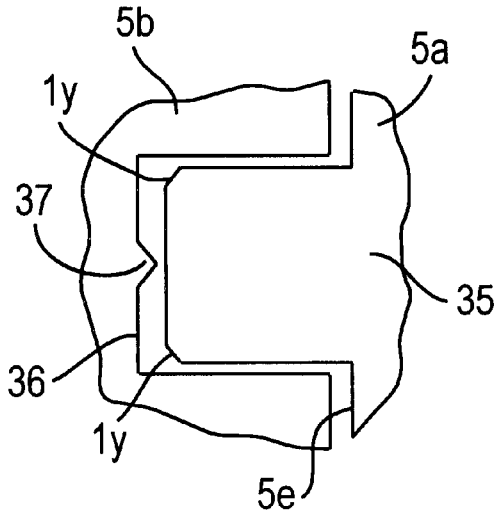
Figure 69C:
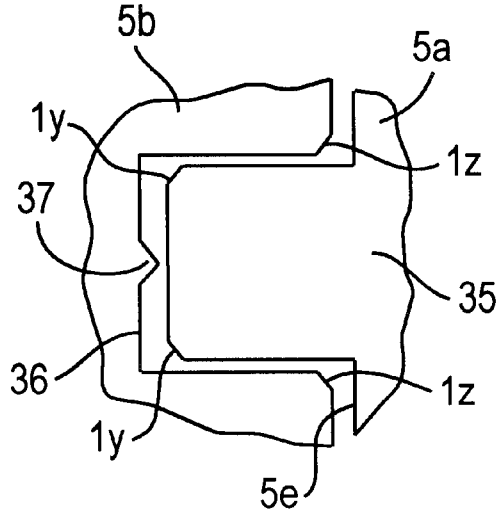
Figure 70A:
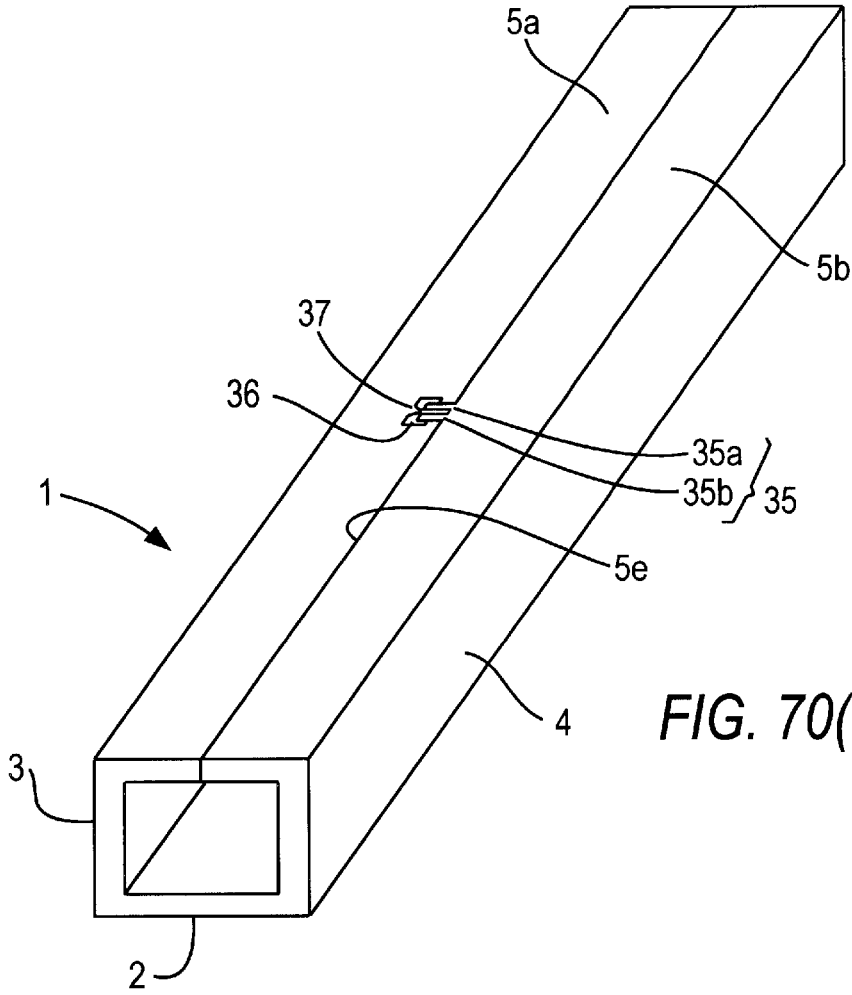
FIG. 70 illustrates a prism pipe body with fork type engaging protrusion, wherein FIG. 70(*a*) is a perspective view thereof, FIG. 70(*b*) is a partial enlarged view before engagement, and FIG. 70(*c*) is a partial enlarged view after engagement.
Figure 70B:
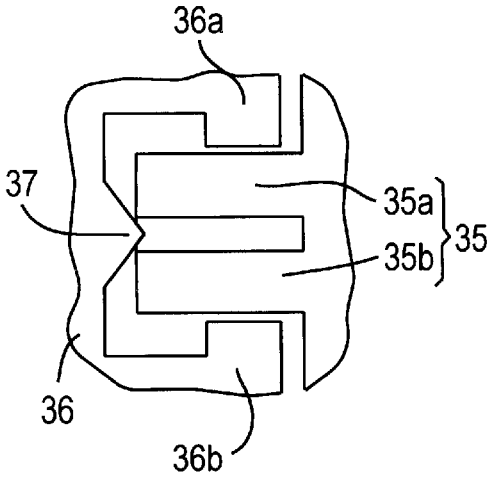
Figure 70C:
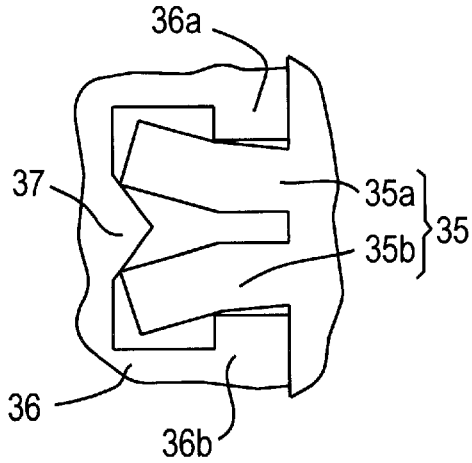
Figure 71:
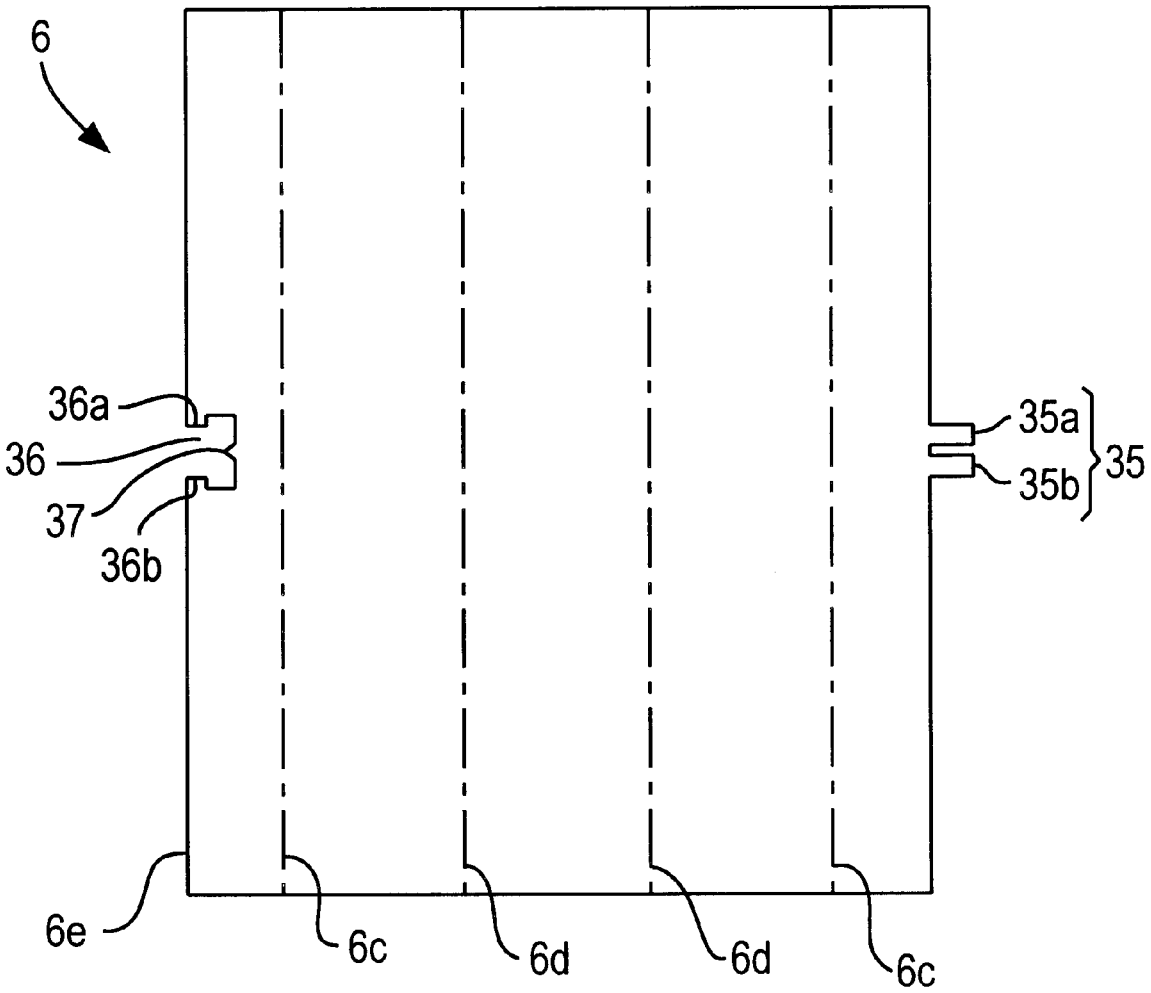
FIG. 71 is a plane view of a metal plate used for manufacturing of the prism pipe body depicted in FIG. 70.
Figure 72A:
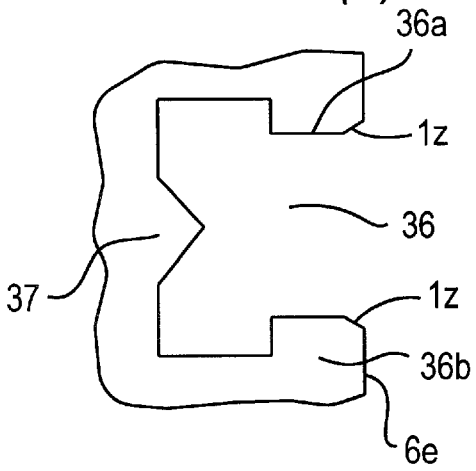
FIG. 72 shows various modified examples of the engaging protrusion and the engaging dent depicted in FIG. 71, wherein FIG. 72(*a*) shows one example of forming the guide portion at a fastening wall, FIG. 72(*b*) shows an example of forming the fork type guide portion at the engaging dent, FIG. 72(*c*) shows an example of forming the guide portion at the outer side of the front end of the fork type protrusion.
Figure 72B:
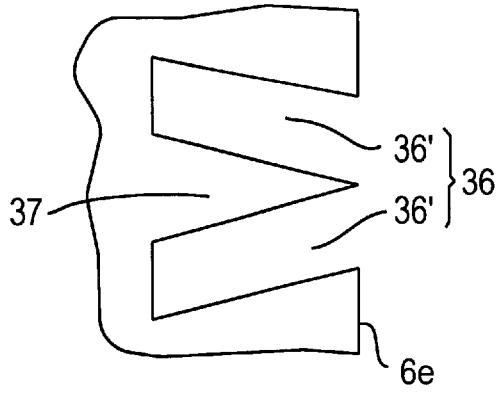
Figure 72C:
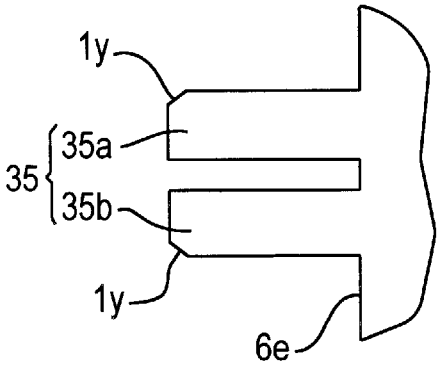
Figure 72D:
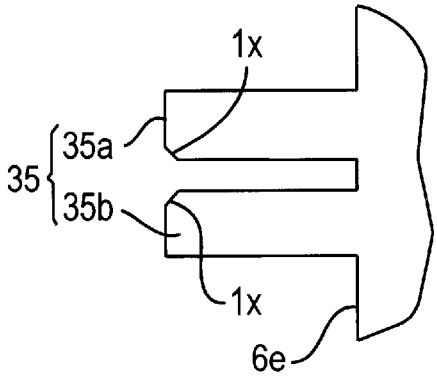
Figure 72E:
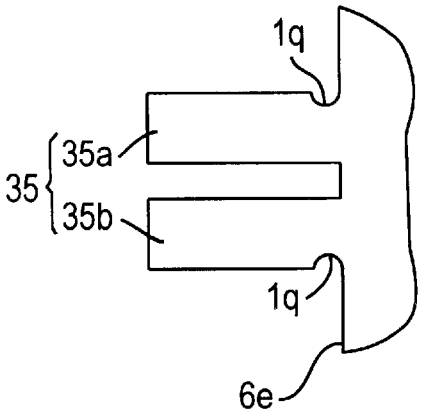
Figure 72F:
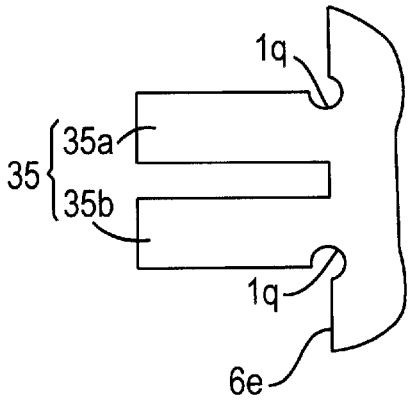

As shown in FIG. 69(*a*), a guide portion 1*z* is formed on an open end of the engaging concave portion 36. The guide portion 1*z* is open toward an open-end side of the engaging concave portion 36. The configuration in which the engaging protrusion 35 can be easily entered into the engaging concave portion 36 can be designed. Also, as shown in FIG. 69(*b*), a slope shape guide portion 1*y* can be formed on a front end of the engaging protrusion 35. Also, as shown in FIG. 69(*c*), two guide portions 1*z* and 1*y* can be formed The prism pipe body 1 shown in FIG. 70(*a*) includes engaging protrusion 35 having two division protrusions (division members) 35*a* and 35*b*. Enlarged as shown in FIG. 70(*b*), protrusion walls 36*a* and 36*b* are formed on an open end of the engaging concave portion 36. The protrusion walls 36*a* and 36*b* protrude from a direction in which they approach each other. The two division protrusions 35*a* and 35*b* are, as shown in FIG. 70(*c*), transformed into directions by which they separate from each other by the taper protrusion 37 and the two division protrusions 35*a* and 35*b* come in contact the protrusion walls 36*a* and 36*b* to prevent a secession. FIG. 71 shows a metal plate 6 which is used for manufacturing of the prism pipe body 1 shown in FIG. 70.

As shown in FIG. 72(*a*), a guide portion 1*z* is formed on engaging concave portion 36. Otherwise, as shown in FIG. 72(*b*), a front and of the taper protrusion 37 extends into a side 6*e*, and two division shape guide portions 36' is formed on the engaging concave portion 36. The two division shape guide portions 36' transforms the two division protrusions 35*a* and 35*b* to separate from it.

Also, as shown in FIG. 72(*c*), a slope shape guide portion 1*z* is formed on an outer side of the two division protrusions 35*a* and 35*b*. Otherwise, as shown in FIG. 72(*d*), a sliding guide portion 1*x* is formed on inside of the two division protrusions 35*a* and 35*b*. When an angle of a pair of sliding guide portions 1*x* approximately coincides with a peak angle of the taper protrusion 37, an initial contact area of the taper protrusion 37 to two division protrusions 35*a* and 35*b* can be widely assured so that transformations of the two division protrusions 35*a* and 35*b* can be easily designed.

Also, as shown in FIG. 72(*e*), by forming a slot 1*q* of a half circular arc at bases of the two division protrusions 35*a* and 35*b*, transformations of the two division protrusions 35*a* and 35*b* can be easily designed. Also, as shown in FIG. 72(*f*), a circular arc shape slot 1*q*' is formed extending from the bases of the two division protrusions 35*a* and 35*b* so that transformations of the two division protrusions 35*a* and 35*b* can be easily designed. The prism pipe body 1 can be formed by a metal plate 6 which is a suitable combination of elements shown in FIGS. 72(*a*) through 72(*e*).

Figure 73:
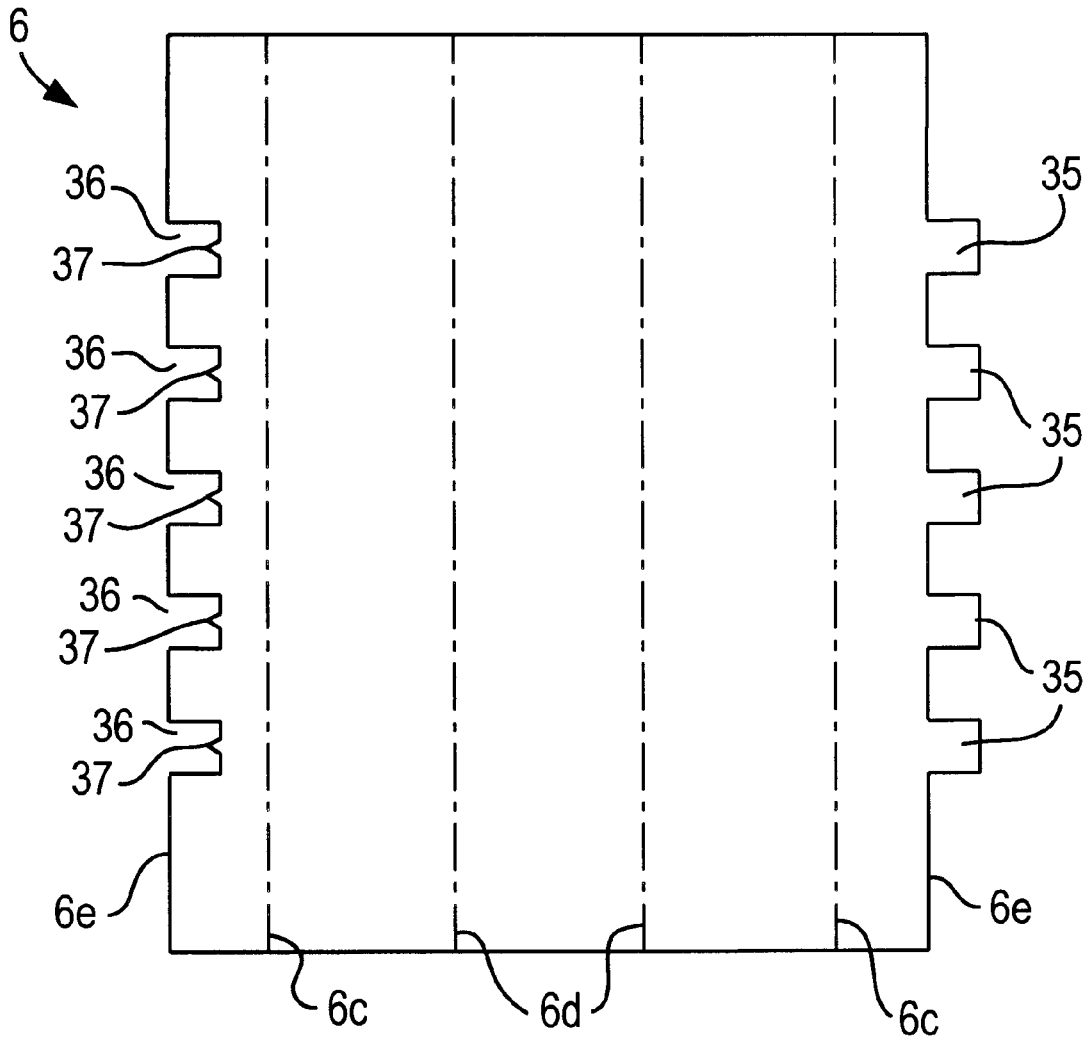
FIG. 73 shows a metal plate with plurality of engaging protrusion and engaging dent formed on each sides.
Figure 74:
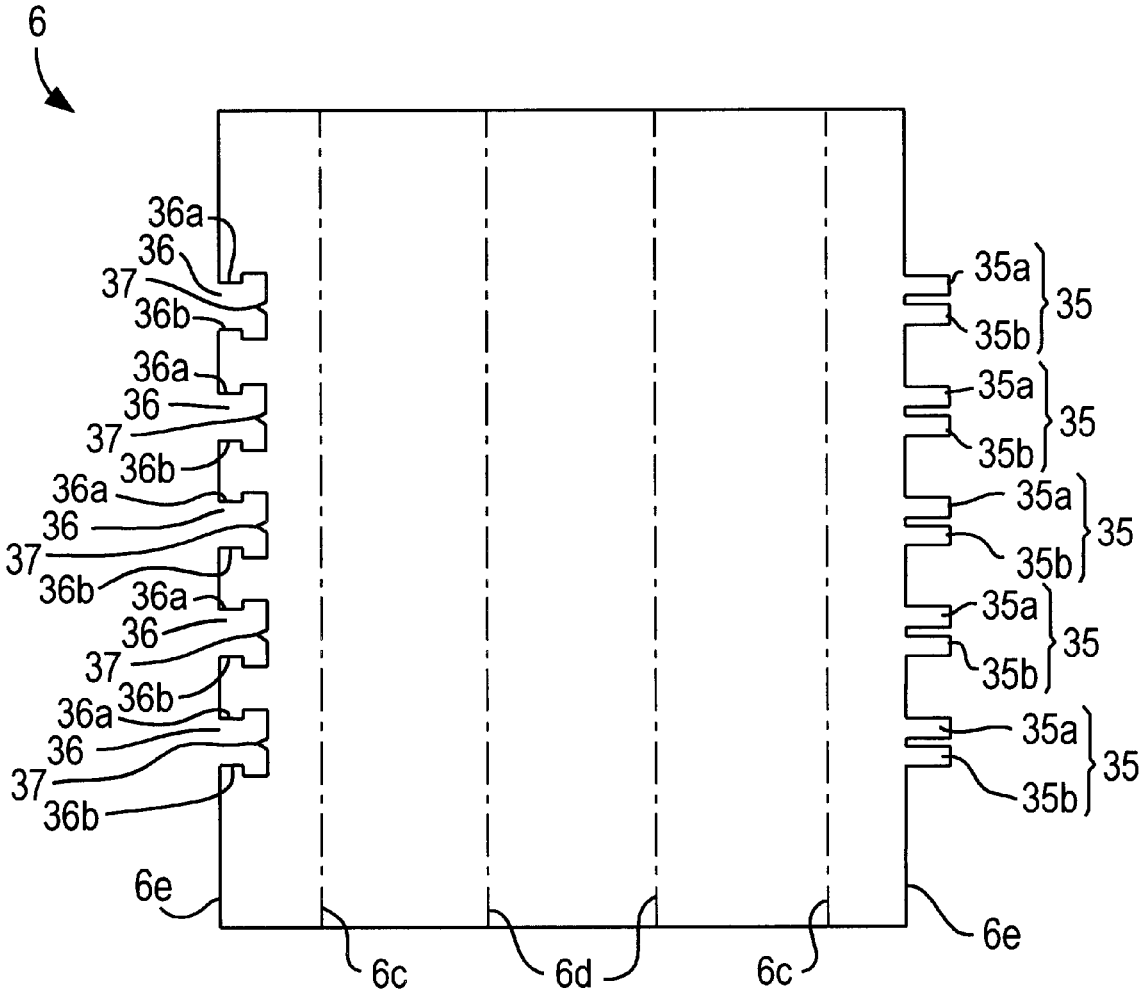
FIG. 74 shows a metal plate with plurality of fork type engaging protrusion and engaging dent formed on each sides.

As mentioned above, in the prism pipe body 1 shown in FIGS. 70 through 72, the prism pipe body 1 is formed by engaging protrusion 35 and engaging concave portion 36. However, as shown in FIG. 73, a plurality of engaging concave portions 36 and taper protrusions 37 are formed in a direction in which one side 6*e* extends at one side 6*e* of the metal plate 6 by predetermined intervals. A plurality of engaging protrusions 35 corresponding to a plurality of engaging concave portions 36 and taper protrusions 37 are formed on the other side 6*e* of the metal plate 6. Also, as in FIG. 74, a pair of fastening walls 36*a* and 36*b* are formed on each of engaging concave portions 36 at the one side 6*e* of the metal plate. A plurality of division protrusion 35*a* and 35*b* are formed on the other side 6*e* of the metal plate 6.

Figure 75:
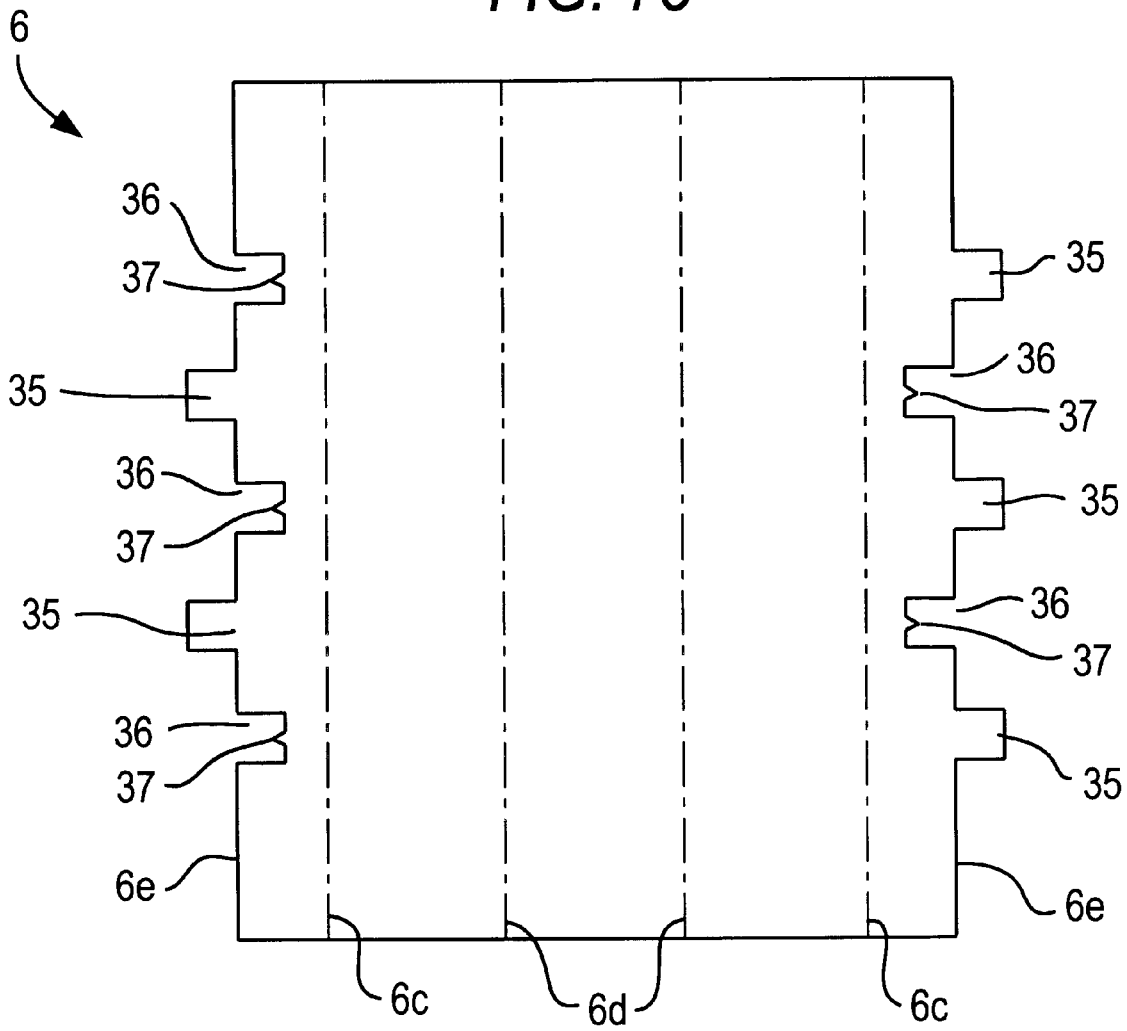
FIG. 75 shows a metal plate with engaging protrusions and dents formed alternately on each sides.
Figure 76:
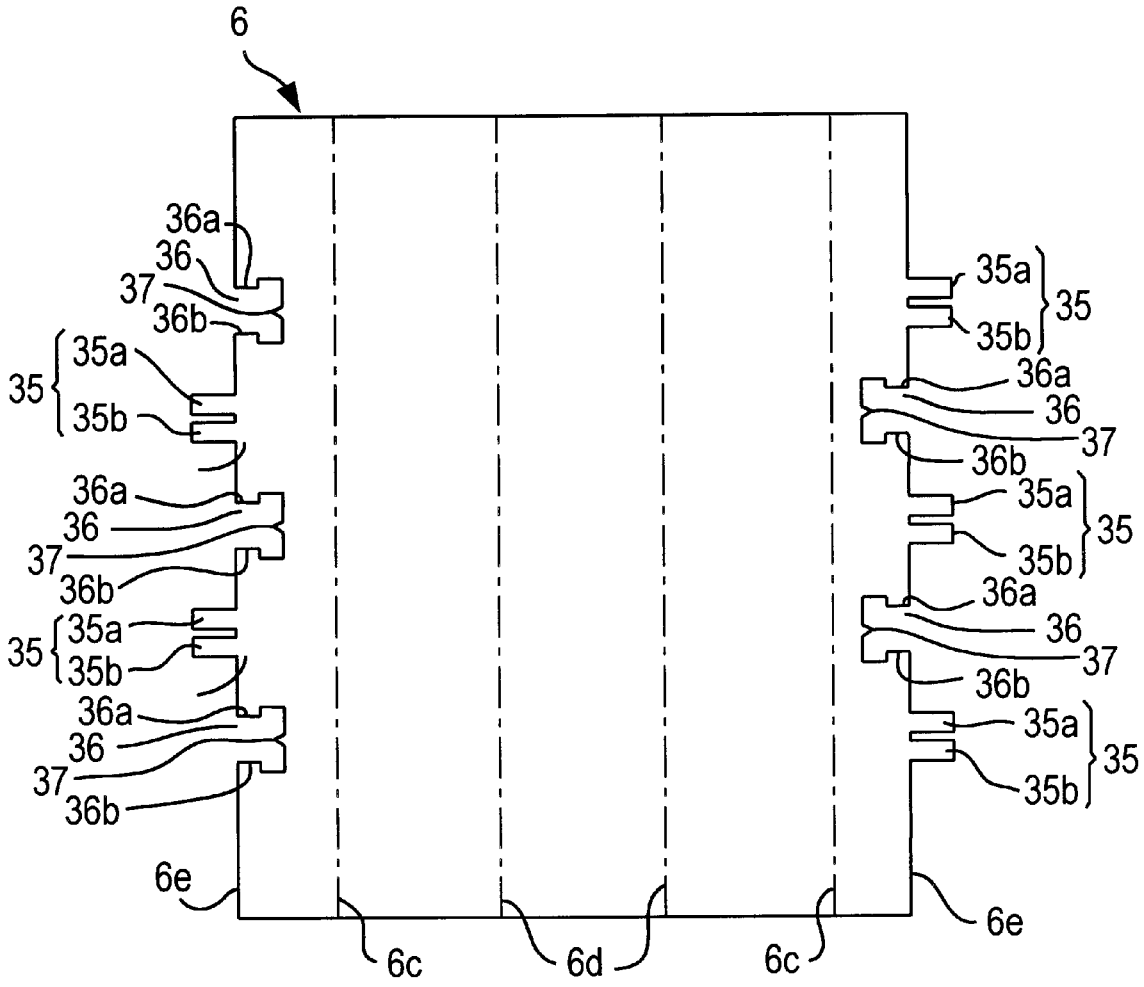
FIG. 76 shows a metal plate with fork type engaging protrusions and dents formed alternately on each sides.

Also, as shown in FIG. 75, the engaging concave portions 36 and engaging protrusions 35 can be formed on each side 6*e* by turns. And as shown in FIG. 76, the division protrusions 35*a* and 35*b* and the engaging concave portion 36 can be formed on each side 6*e* by turns.

Figure 77:
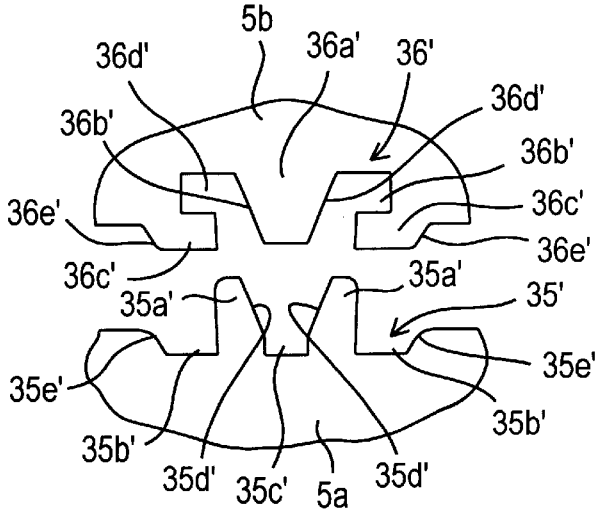
FIG. 77 is a partial enlarged view of a prism pipe body with a male engaging portion and a female engaging portion.

Also, as shown in FIG. 77, a male side engaging portion 35' is formed on a wall including seam 5*a* of one direction. A female side engaging portion 36' is formed on a wall including seam 5*b* of the other direction. The male side engaging portion 35' includes two division protrusion 35*a'* and 36*a'*, engaging concave portions 35*b'* and 35*b'*, and engaging concave portion 35*c'*. The female side engaging portion 36' includes engaging protrusion 36*a'*, and engaging concave portions 36*b'* and 36*b'*, and engaging protrusions 36*c* and 36*c'*. The engaging protrusion 36*a'* engages with the engaging concave portion 35*c'*. The two division protrusion 35*a'* and 35*b'* are engaging to engaging concave portions 36*b'* and 36*b'*. The engaging protrusions 36*c'* and 36*c'* are right angle to the division protrusions 35*a'* and 35*b'*.

Figure 78A:
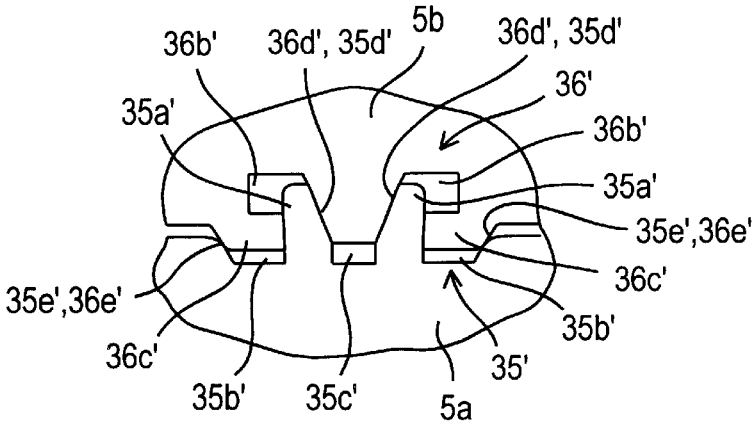
FIG. 78 is views illustrating the operation of the male engaging portion and the female engaging portion, wherein FIG. 78(*a*) illustrates the male engaging portion and the female engaging portion being about to engage, and FIG. 78(*b*) illustrates the male engaging portion and the female engaging portion being engaged.
Figure 78B:
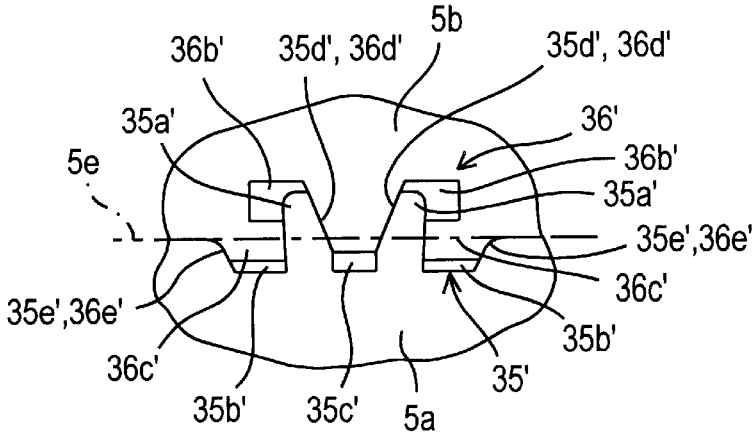

The engaging protrusion 36*a'* includes slope portions 36*d'* and 36*d'*. The engaging protrusions 36*c'* and 36*c'* include shoulders 36*e'* and 36*e'*. The division protrusions 35*a'* and 35*a'* include slope portions 35*d'* and 35*d'*. As the slope portions 35*d'* and 35*d'* become wider as directing toward an open. A shoulder 35*e'* is formed on the wall including seam 5*a* and engages with a shoulder 36*e'*. When the wall including seams 5*a* and 5*b* approach each other as shown in FIG. 78(*a*), engaging protrusion 36*a'* engages with the engaging concave portion 35*c'*. The shoulder 36*e'* engages with a shoulder 35*e'*. The division protrusions 35*a'* and 35*a'* are engaging concave portions 36*b'* and 36*b'*. When the wall including seams 5*a* and 5*b* approach more closely to each other, as shown in FIG. 78(*b*), the two division protrusions 35*a'* and 35*a'* are transformed to a direction by which they separate from each other by tapering of the engaging protrusion 36*a'*. At the same time, the engaging protrusions 36*c'* and 36*c'* are pressed by the shoulders 35*e'* and 35*e'* and transformed into a pressed direction. As shown in FIG. 78(*b*), an upper portion of seam 5*e* and a vicinity thereof are substantially filled with a male mold engaging portion 35' and a female mold engaging portion 36'.

When engaging protrusion with engaging concave portion, it can prevent the wall including seam with respect to a stress distortion from being separated.

(7) [Other Prism Pipe Bodies]

(Deformation Example of the Prism Pipe Body Shown in FIG. 1)

Figure 79:
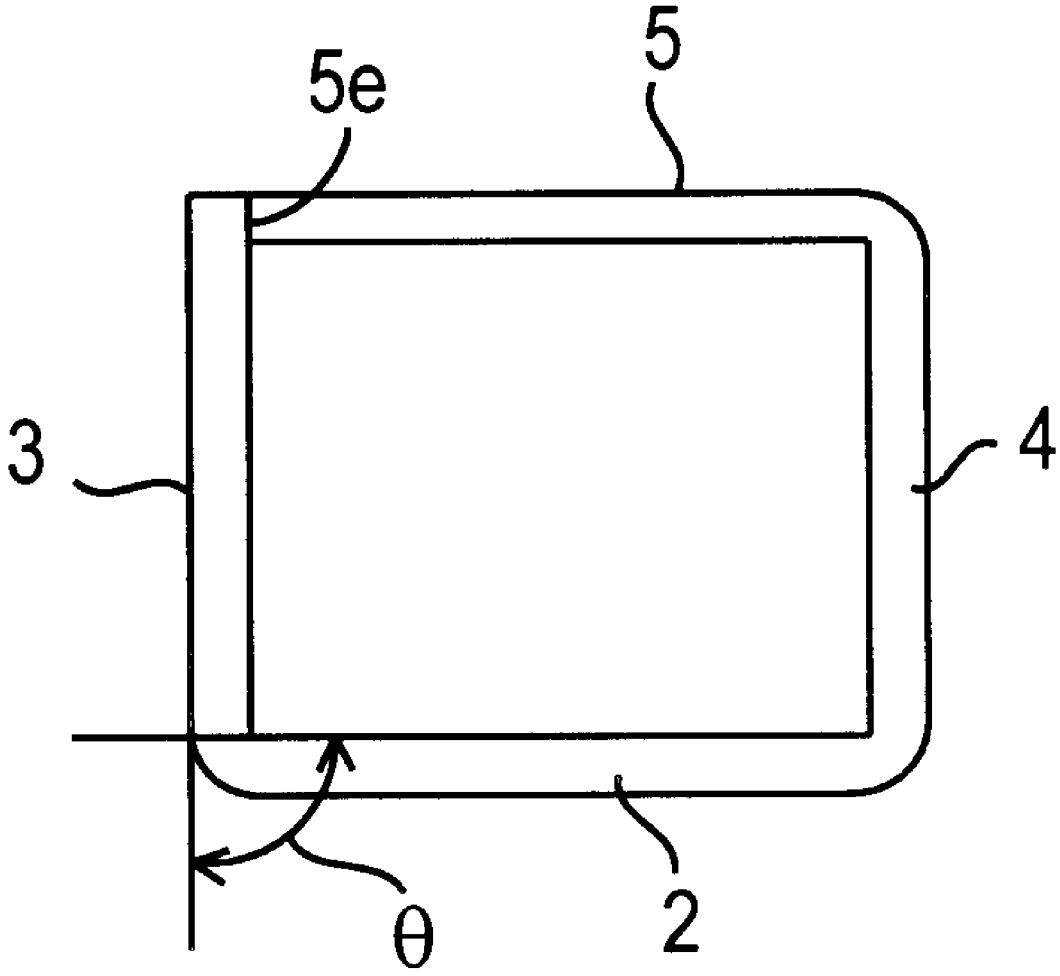
FIG. 79 is a side view illustrating an other position of the seam of the pipe body according to the present invention.

In a prism pipe body 1, a seam 5*e* is formed at the center of an upper wall 5. However, as shown in FIG. 79, for example, a seam 5*e* is formed at a section of the upper wall 5 and a section of the side wall 3, that is, a corner of the upper and side walls 5 and 3. In this case, at lease one direction of sides 6*b* of the metal plate 6 preferably stands up.

(Prism Pipe Body Having a Polygon Shaped Section)

Figure 80A:
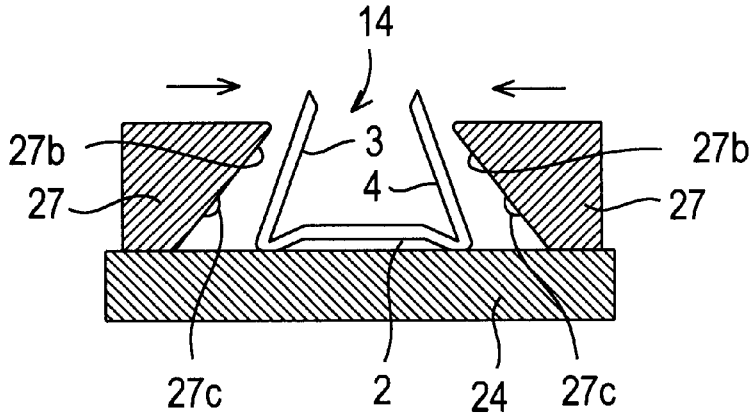
FIG. 80 shows a method of manufacturing prism pipe body having a triangular cross section, wherein FIG. 80(*a*) is a view showing a secondary immediate intermediate product set on a manufacturing apparatus, FIG. 80(*b*) is a view showing a protrusion formed by pressure of a pair of press punching members, and FIG. 80(*c*) is a view showing a completed prism pipe body.
Figure 80B:
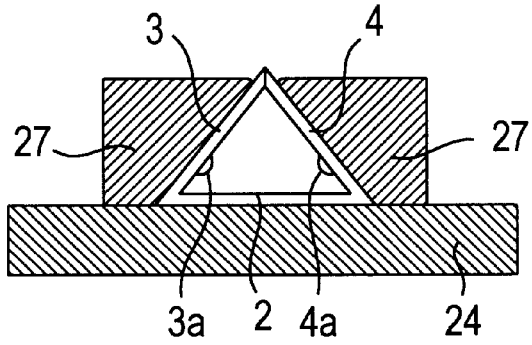
Figure 80C:
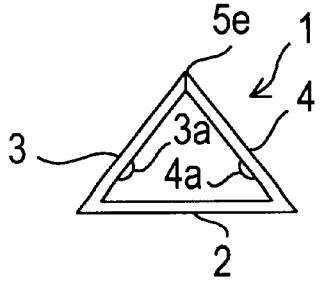
Figure 81A:
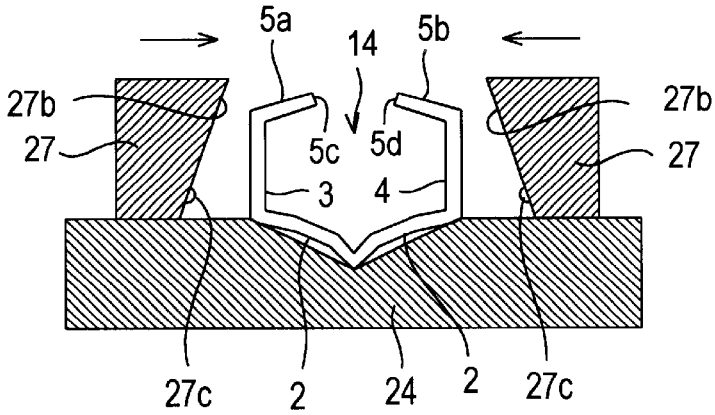
FIG. 81 shows a method of manufacturing prism pipe body having a pentagonal cross section, wherein FIG. 81(*a*) is a view showing a secondary immediate intermediate product set on a manufacturing apparatus, FIG. 81(*b*) is a view showing a protrusion formed by pressure of a pair of press punching members, and FIG. 81(*c*) is a view showing a completed prism pipe body.
Figure 81B:
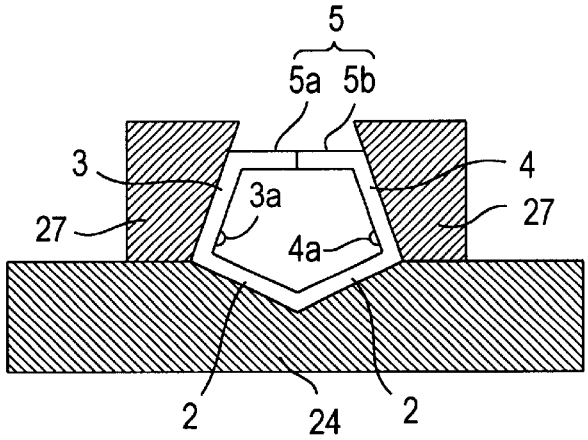
Figure 81C:
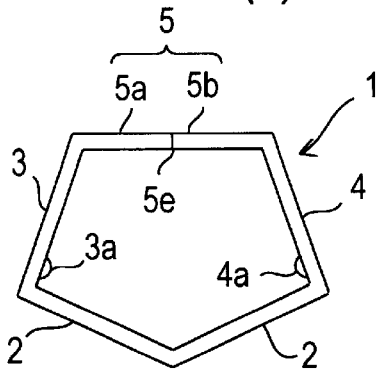
Figure 82A:
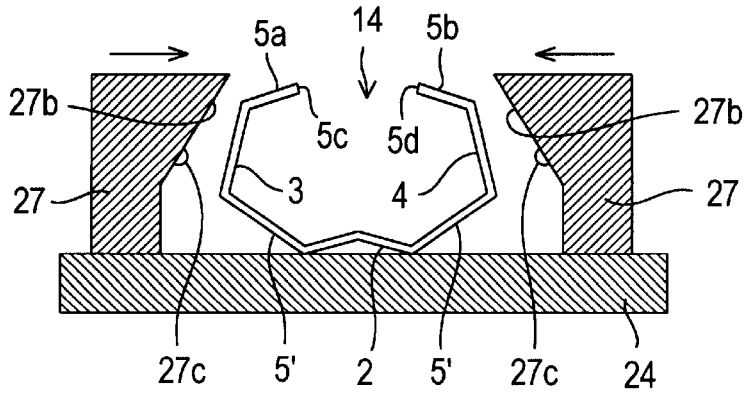
FIG. 82 shows a method of manufacturing prism pipe body having a hexagonal cross section, wherein FIG. 82(*a*) is a view showing a secondary immediate intermediate product set on a manufacturing apparatus, FIG. 82(*b*) is a view showing a protrusion formed by pressure of a pair of press punching members, and FIG. 82(*c*) is a view showing a completed prism pipe body.
Figure 82B:
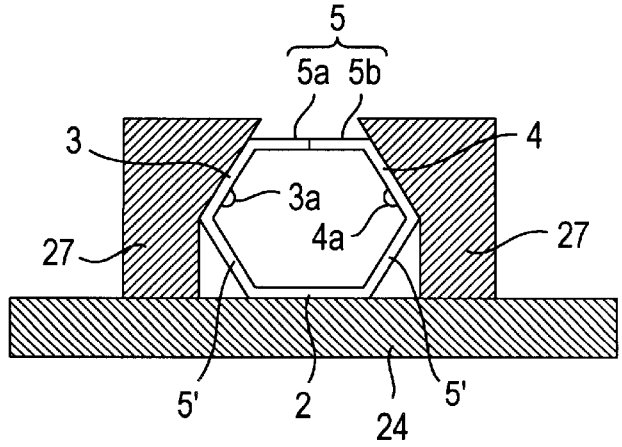
Figure 82C:
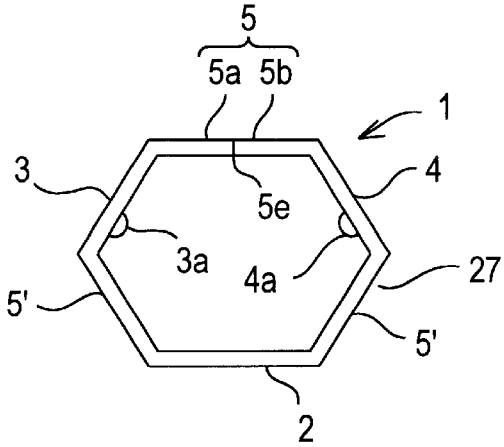
Figure 83A:
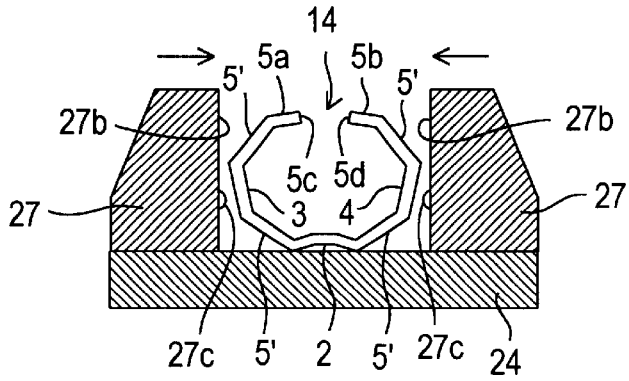
FIG. 83 shows a method of manufacturing prism pipe body having a octagonal cross section, wherein FIG. 83(*a*) is a view showing a secondary immediate intermediate product set on manufacturing apparatus, FIG. 83(*b*) is a view showing a protrusion formed by pressure of a pair of press punching members, and FIG. 83(*c*) is a view showing a completed prism pipe body.
Figure 83B:
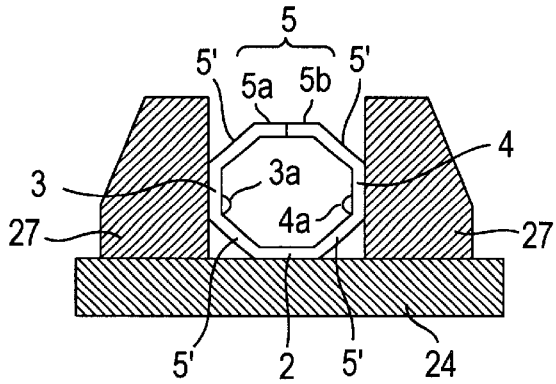
Figure 83C:
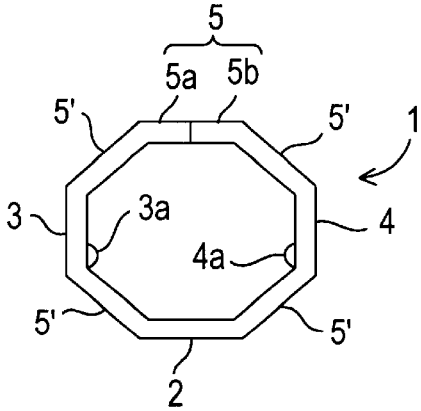

FIG. 80 shows a method for manufacturing pipe body having a triangular section. FIG. 81 shows a method for manufacturing prism pipe body 1 having a pentagonal section. FIG. 82 shows a method for manufacturing prism pipe body 1 having a hexagonal section. FIG. 83 shows a method for manufacturing prism pipe body 1 having an octagonal section. In each FIGS. 80 through 83, (a) represents a state when a second intermediate product is mounted to a press forming device, (b) represents a state when the second intermediate product is pressed by a pressure punch member to form convex portion, and (c) shows a completed square pillar 1 having a many-sided shape. Reference numerals shown in each Figs. corresponds to reference numerals of each element in a method for manufacturing prism pipe body.

That is, a reference numeral 1 represents a prism pipe body. A reference numeral 2 represents a curved surface in a step to form a second intermediate product 14. Reference numerals 3 and 4 are surfaces on which convex portions 3*a* and 4*a* are formed. Reference numerals 5*a* and 5*b* represent wall including seams. Reference numerals 5*c* and 5*d* represent sections. A reference numeral 5 is a surface having a seam 5*c*. A reference numeral 24 is a fixing plate. A reference numeral 27 represents a pressure punch member. Reference numerals 27*c* is a protrusion forming protrusion. A reference numeral 5' represents a surface other than surfaces 2, 3, 4, and 5 of the pipe body. Each pipe body 1 is symmetrical including convex portions 3*a* and 4*a*, and a seam 5*e*. Sections 5*c* and 5*d* of the pipe body 1 are contacted to each other by a spring back force generated in the convex portions 3*a* and 4*a*.

What these types of shaped prism pipe bodies can be formed without forming convex portions 3*a* and 4*a* can be understood from the above-mentioned description.

(Cylindrical Pipe Body)

Figure 84:
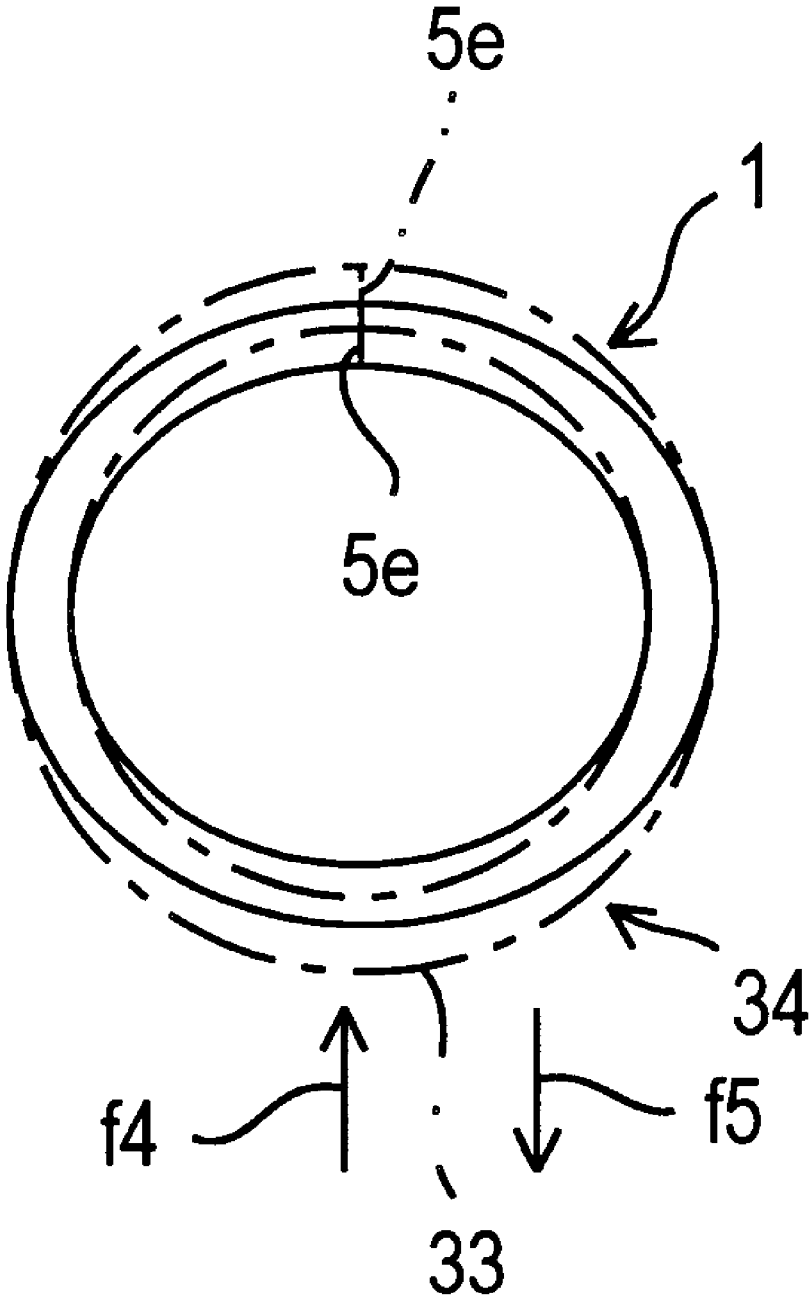
FIG. 84 is a view showing a cylindrical pipe body.

As shown in FIG. 84, a geometrical shape of a closed section can form a circular pipe body 1.

In this case, at first, by bending the metal plate 6, a seam 5*e* long extends in a non-adhesion state, a pair of sides 6*a* long extends, and an elliptical pipe body 34 are formed as a curved intermediate product having a curved convex portion 33 which is expanded into an outer side. Then, while approximately maintaining a shape of a shorter diameter direction the elliptical pipe body 34, an external force is supplied to a curved convex portion 33 which is present at a longer diameter direction in a direction which a curvature thereof becomes smaller to transform the elliptical pipe body 34. In this case, the spring back force f5 to return to original curved convex portion 33 occurs and based on this spring back force f5, the prism pipe body, engaging to the seam 5*e*.

(8) [Example of Using a Prism Pipe Body]

(Example 1 of Using a Prism Pipe Body)

Figure 85A:
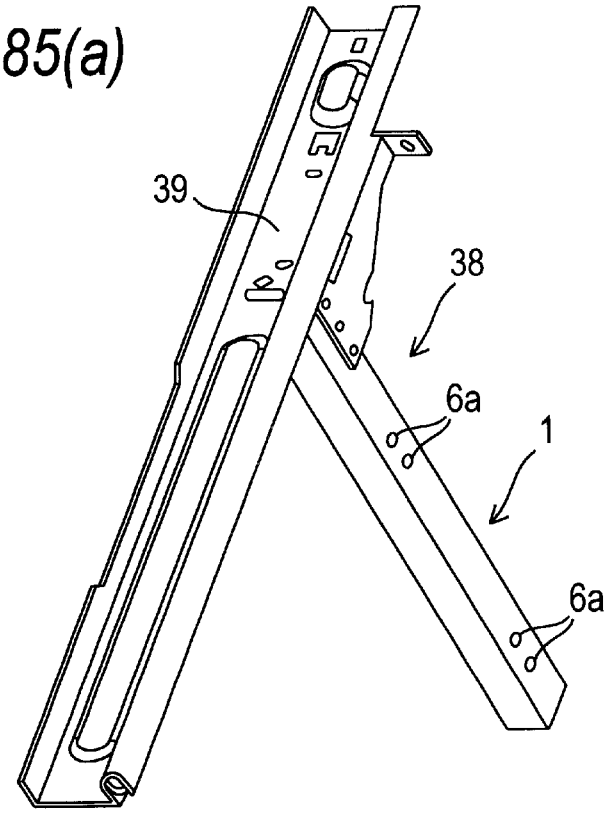
FIG. 85 shows an example of using the prism pipe body depicted in FIG. 1 for a support frame of copy machine, wherein FIG. 85(*a*) is a perspective view of the supporting frame, and FIG. 85(*b*) is a side view of the supporting frame.
Figure 85B:
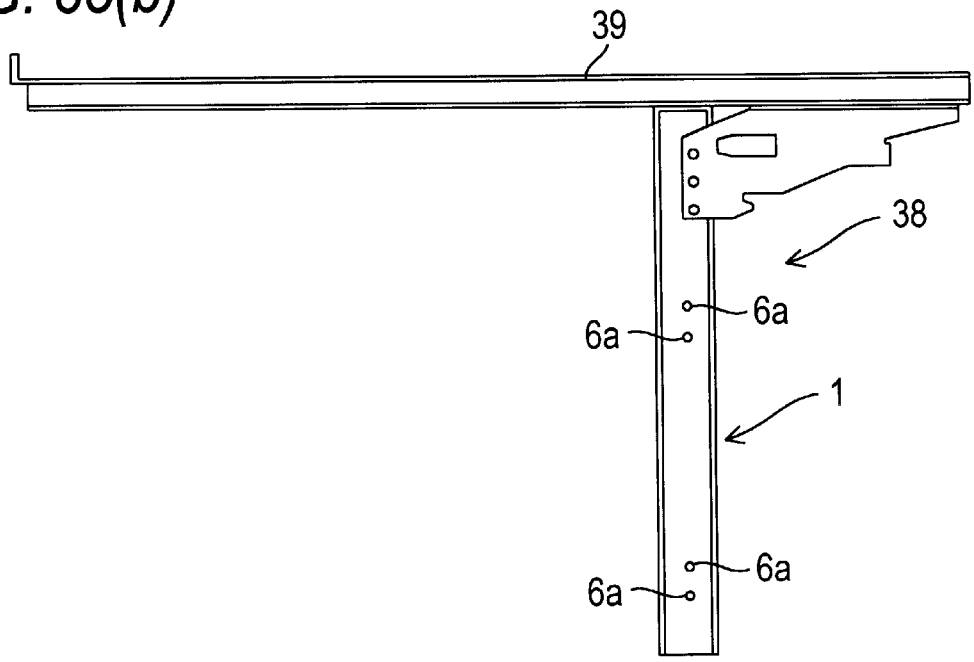
Figure 86:
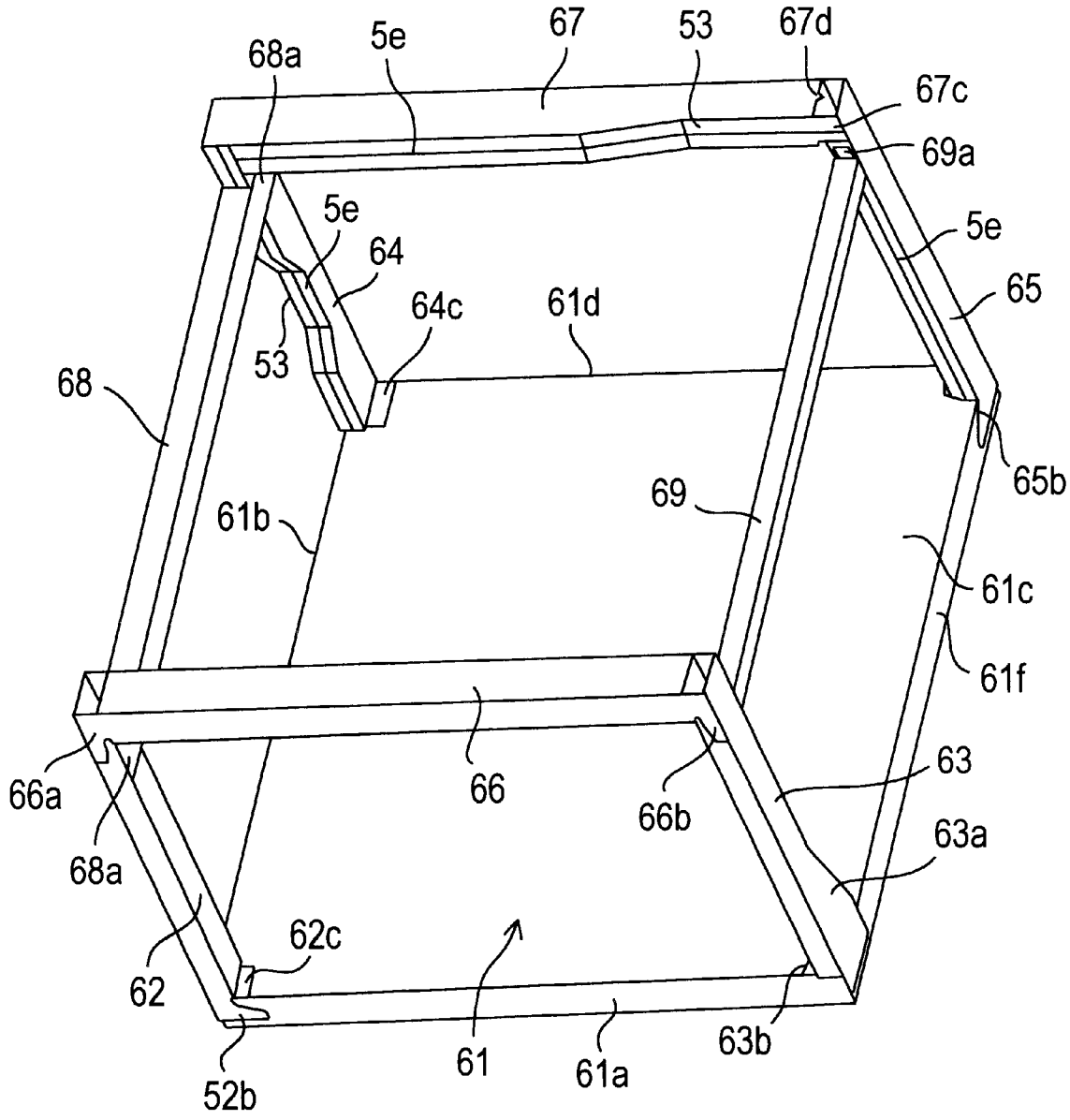
FIG. 86 is a perspective view showing a frame structure made of various prism pipe bodies having engaging portion and portion for tolerance viewing the prism pipe body with portion for tolerance from a direction where the seam can be seen.

The prism pipe body 1 shown in FIG. 1 is, for example, as shown in FIGS. 85(*a*) and 85(*b*), used for a cantilever type frame assembly 38 as a support means of a facsimile combined copy machine. A loading frame 39 is mounted to the prism pipe body 1. For example, scanner unit (not shown) is loaded into the loading frame 39.

(Example 2 of Using a Prism Pipe Body)

FIGS. 86 through 93 show one example of frame assembling formed by a prism pipe body having a seam.

In FIGS. 86 through 93, a reference numeral 61 represents a square base member. Reference numeral 62 through 69 represent prism pipe bodies. L shaped fastening plates 62*a* and 62*b* and at the same time, a curved fastening plate 62*c* are formed at one end of the prism pipe body 62.

The prism pipe body 62 is fastened and fixed to a corner of the square base member 61, for example, by a fastening member.

That is, after contacting the L shaped fastening plate 62*a* with one side 61*b*, contacting the L shaped fastening plate 62*b* with the other side 61*b*, contacting the curved fastening plate 62*c* with a upper surface 61*c*, they are fastened and fixed to the square base member 61 by a screw member (not shown).

Figure 87:
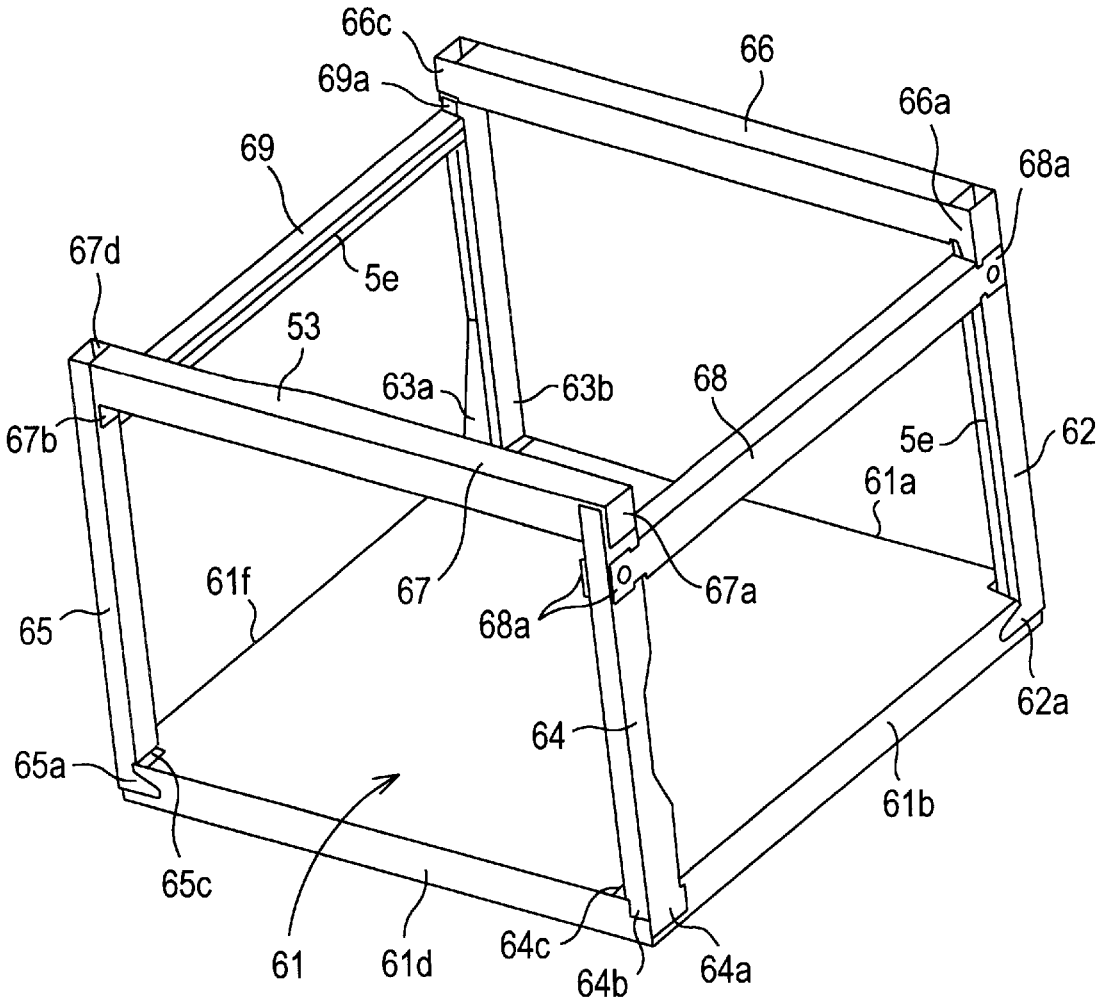
FIG. 87 is a perspective view showing a frame structure made of various prism pipe bodies having engaging portion and portion for tolerance view the prism pipe body with portion for tolerance from a direction where the bottom wall can be seen.

As shown in FIG. 87, the L shaped fastening plate 65*a* and 65*b* and the curved fastening plate 65*c* are formed at the prism pipe body 65. The curved fastening plate 65*c* is screwed to upper surface 61*c*, the L shaped fastening 65*a* is screwed to one side 61*d,* and the L shaped fastening plate 65*b* is screwed to the other side 61*f.*

A stretch fastening plate 63*a* and a curved fastening plate 63*b* are formed on one end of the prism pipe body 63. The stretch fastening plate 63*a* is screwed to one side 61*f* and the curved fastening plate 63*b* is screwed to the upper surface 61*c.*

Figure 88:
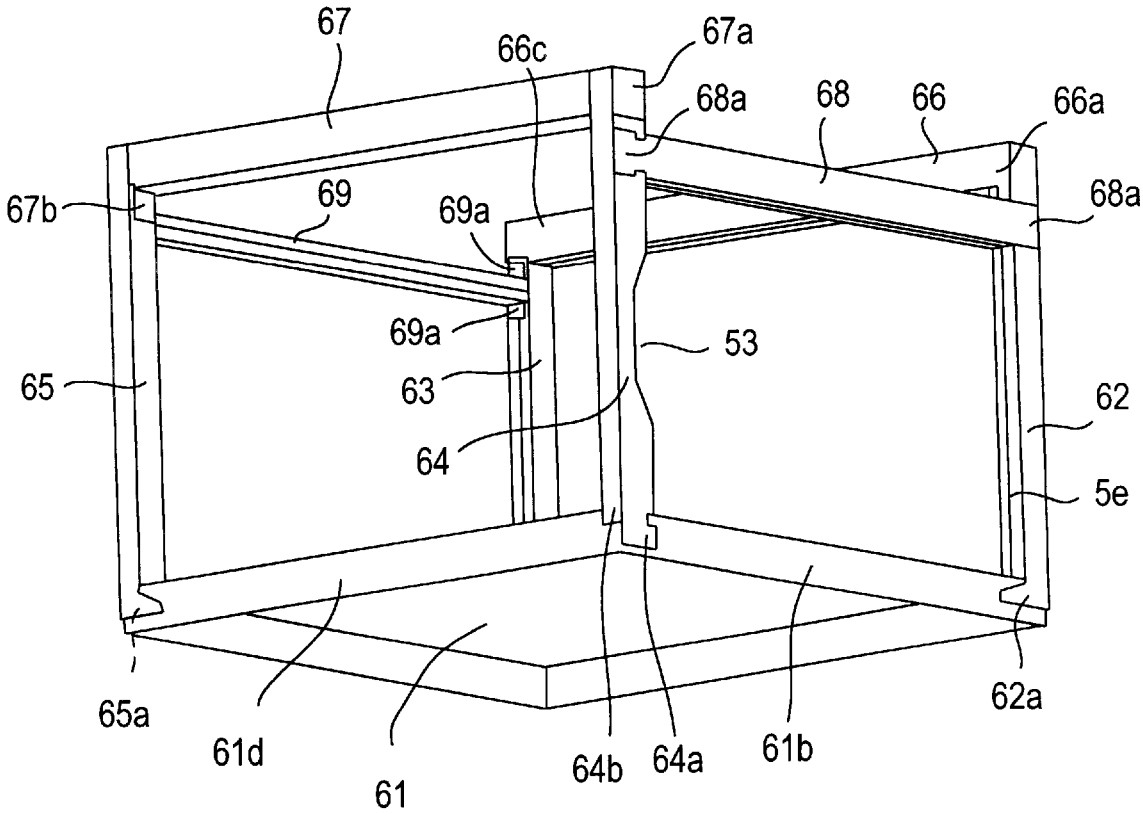
FIG. 88 is a perspective view of the frame structure depicted in FIG. 87 form its diagonally looking up direction.

As shown in FIG. 88, an interference preventing portion for tolerance 53 is formed at a longitudinal center of the prism pipe body 64. At the right angle fastening plate 64*a* and 64*b* and a curved fastening plate 64*c* are formed at one end of the prism pipe body 1.

Also, by screwing at the right angle fastening plate 64*a* to one side 61*b* of a prism pipe body 64, by screwing at the right angle fastening plate 61*d* to one side 61*b* of a prism pipe body 64, by screwing the curved fastening plate 64*c* to the upper surface 61*c,* the prism pipe body 64 is fixed to a corner of a rectangular base member 61.

Figure 89:
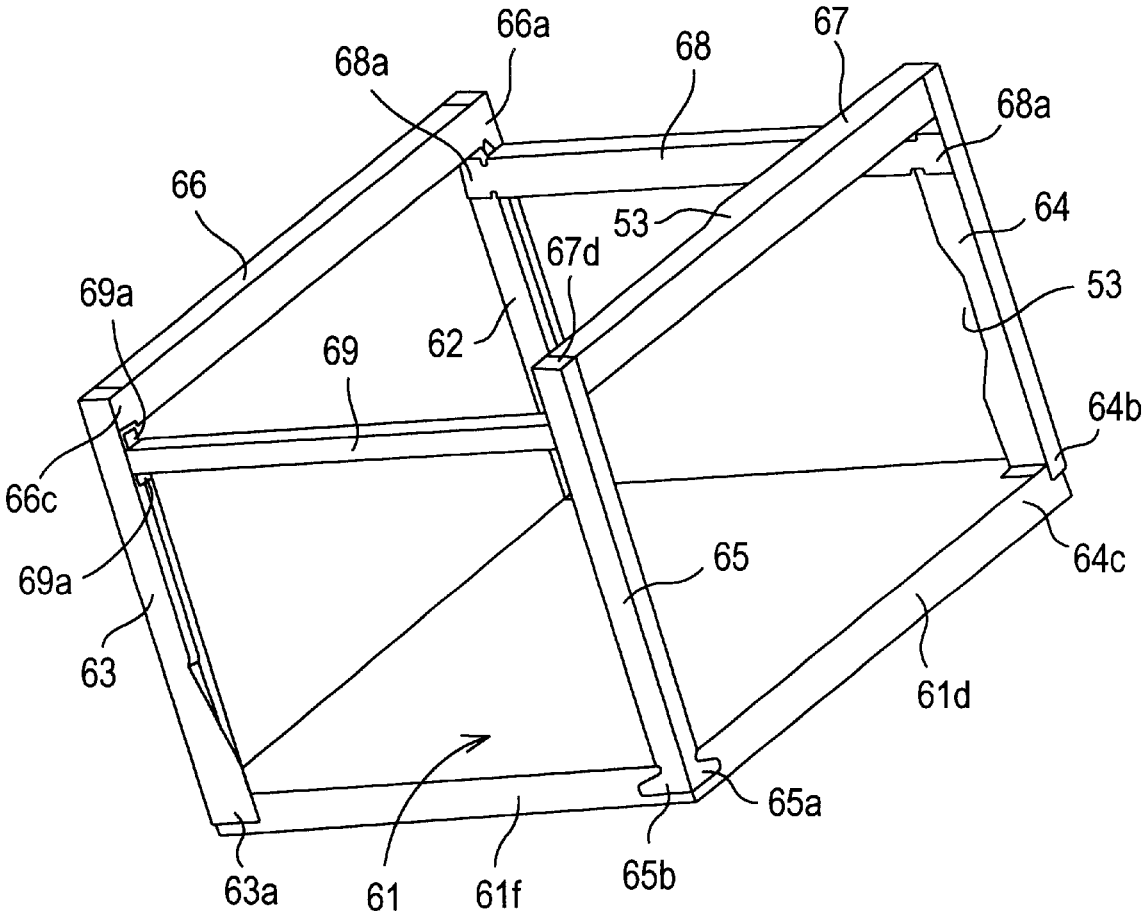
FIG. 89 is a view of the frame structure depicted in FIG. 87 after 90 degree of clock wise rotation.
Figure 90:
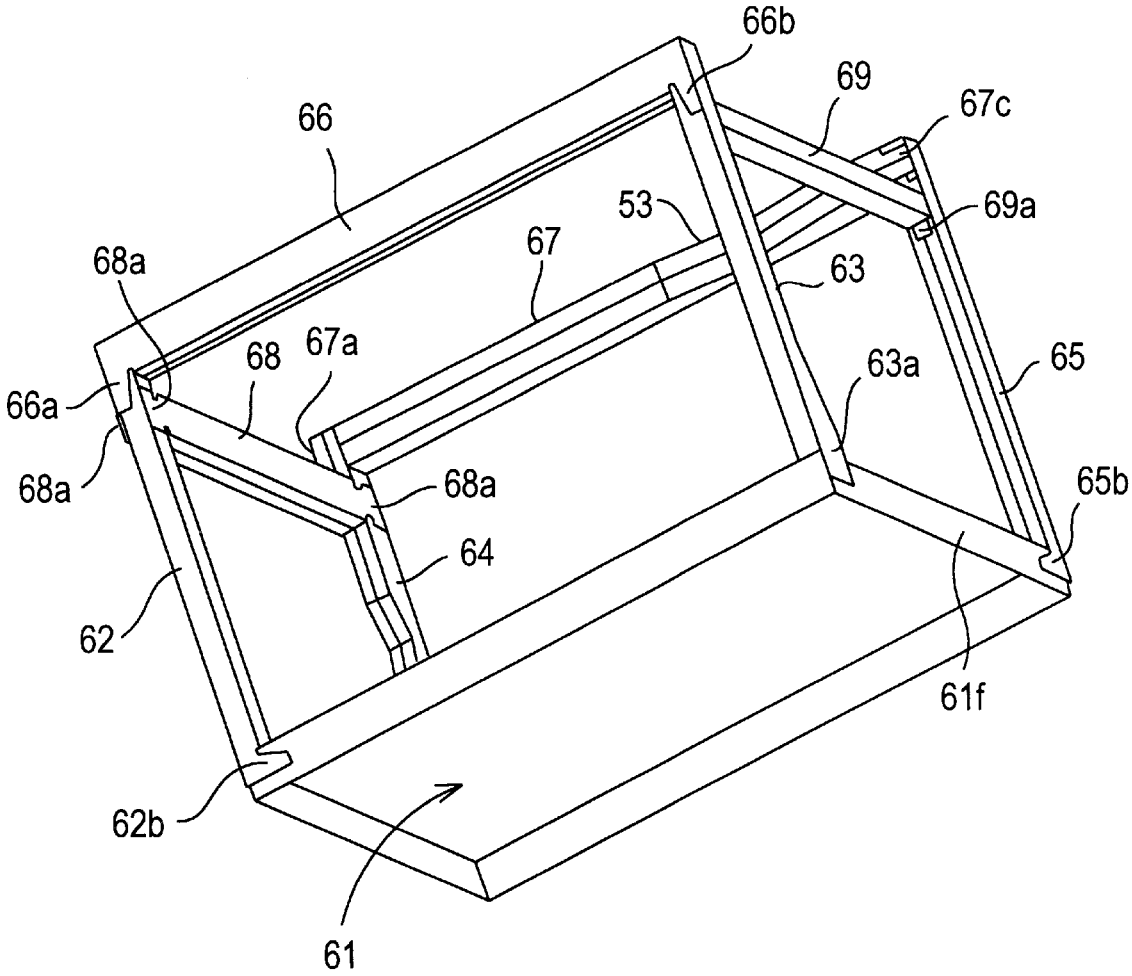
FIG. 90 is a perspective view of the frame structure depicted in FIG. 86 form its diagonally looking up direction.
Figure 92:
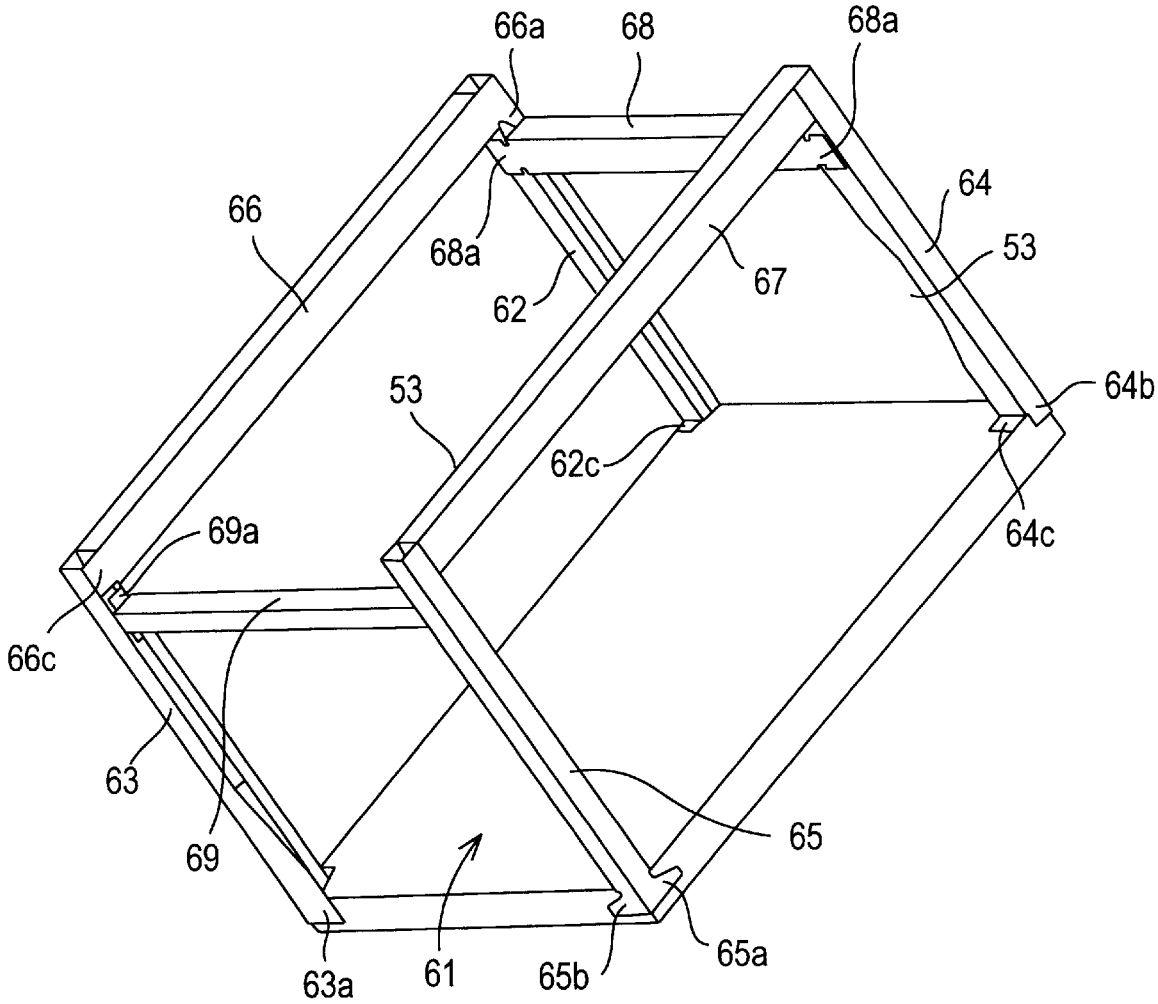
FIG. 92 is a view of the frame structure viewing from the same direction as FIG. 89.

As shown in FIGS. 89 and 90, an L shaped fastening plate 66*a* is formed at one end of the prism pipe body 66. An L shaped fastening plate 66*b* shown in FIG. 90 and a parallel fastening plate 66*c* shown in FIGS. 89 and 92 are formed at the other end of the prism pipe body 66. One end of prism pipe body 66 is fixed to the other end of the prism pipe body 62 and the other end of the prism pipe body 66 is fixed to the other end of the prism pipe body 63.

Figure 91:
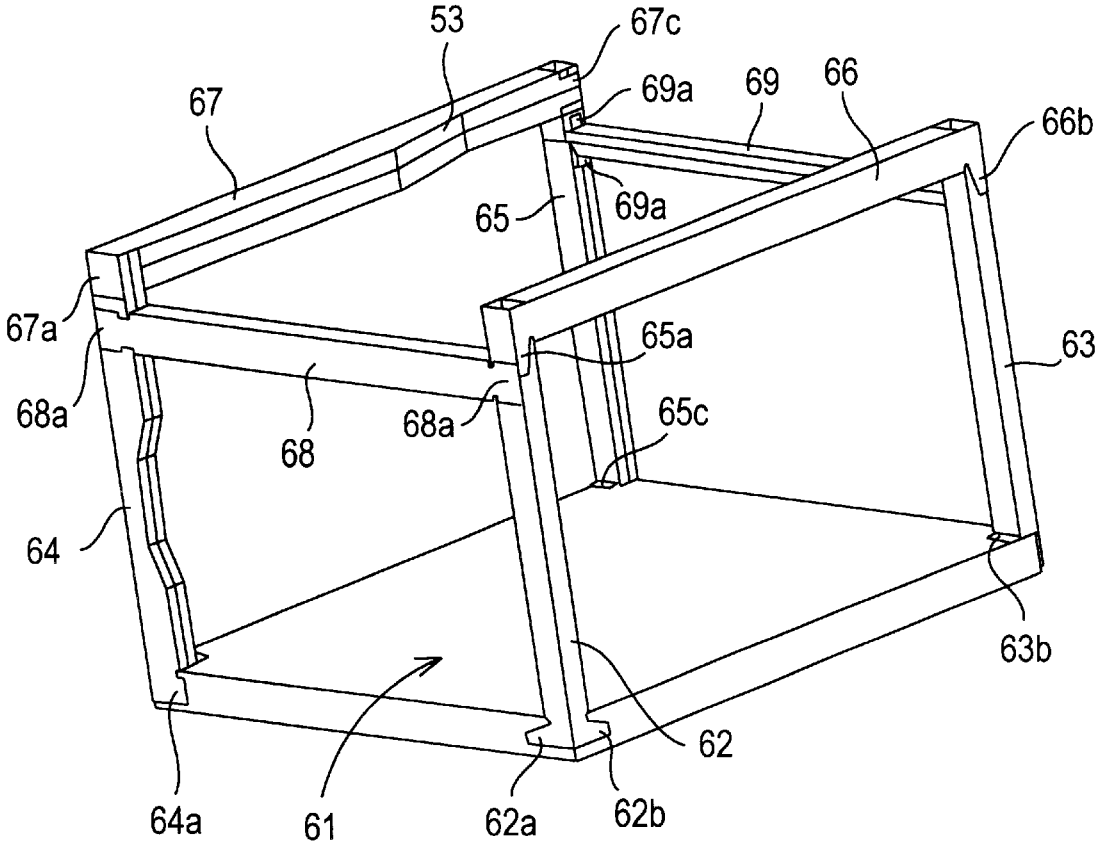
FIG. 91 is a view of the frame structure depicted in FIG. 90 after 90 degree of clock wise rotation.

A curved fastening plate 67*a* shown in FIG. 91 is formed at one end of the prism pipe body 67. A curved fastening plate 67*h* and a parallel fastening plate 67*c* are formed at the other end of the prism pipe body 67. Also a location determination engaging protrusion 67*d* is formed at a section of the prism pipe body 67. An interference preventing portion for tolerance 53 is formed at the other end of the prism pipe body 67. The location determination engaging protrusion 67*d* and engaging concave are formed at the other end of the prism pipe body 65. One end of the prism pipe body 67 is fixed to the other end of the prism pipe body 64. The other end of the prism pipe body 67 is fixed to the other end of the prism pipe body 65.

Figure 94:
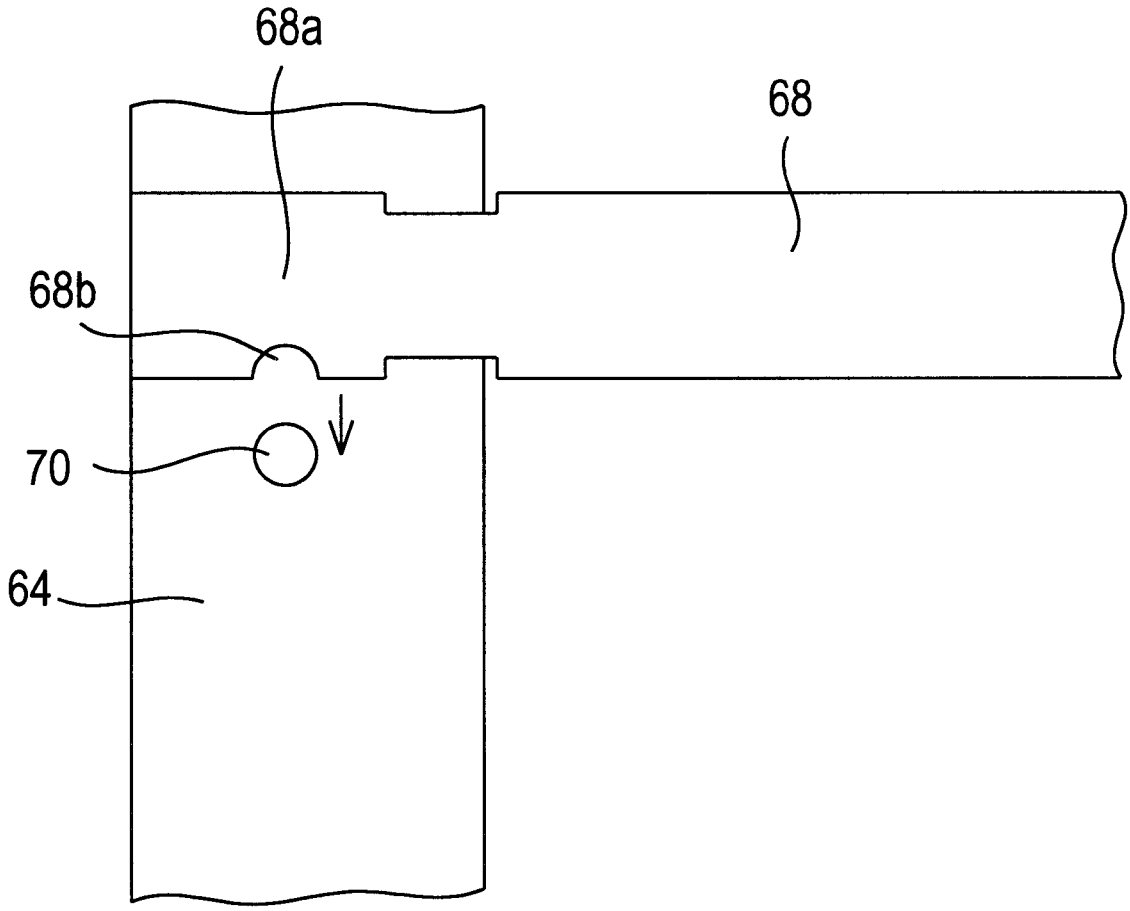
FIG. 94 is a partial enlarged view of a prism pipe body used for a frame structure.

As shown in FIG. 92, parallel fastening plates 68*a* and 68*a* are formed at both ends of the prism pipe body 68. A half circular concave portion 68*b* is formed on each of the parallel fastening plates 68*a* enlarged as shown in FIG. 94. A location determination support pin 70 is formed at the other ends of the prism pipe bodies 62 and 64. The location determination support pin 70 engages with the half circular concave portion 68*b* to determine and support a location of the prism pipe body 68.

By suspending one end of the prism pipe body 68 to a location determination support pin 70 of the prism pipe body 64, suspending the other end of the prism pipe body 68 to a location determination support pin 70 of the prism pipe body 62, and screwing parallel fastening plates 68*a* and 68*a* to other end of the prism pipe bodies 62 and 64, the prism pipe body 68 is fixed to a prism pipe body 62 and prism pipe body 64.

Figure 93:
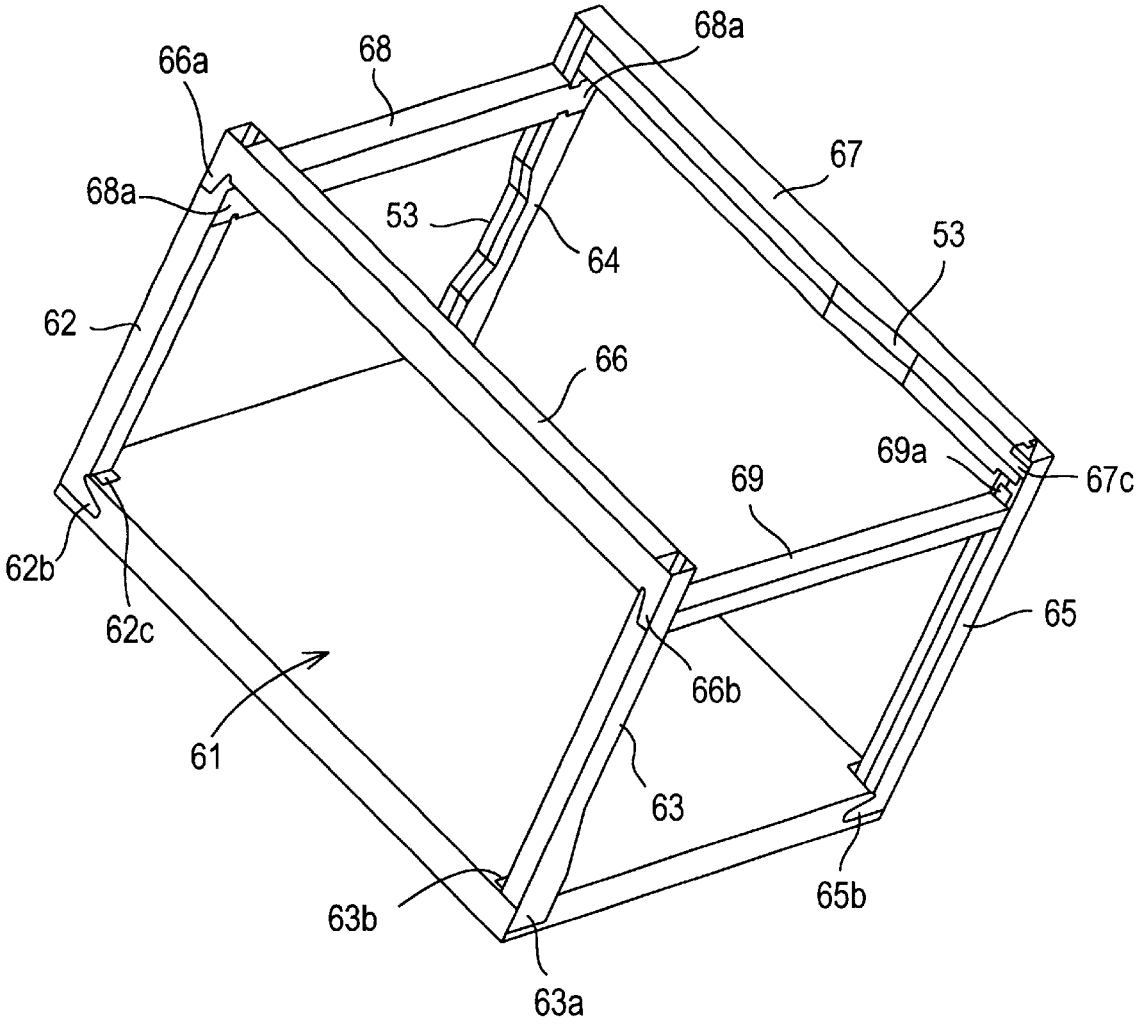
FIG. 93 is a view of the frame structure depicted in FIG. 87 after 180 degree of rotation.

As shown in FIGS. 89, 91, and 93, a curved fastening plates 69*a* are formed at both ends of the prism pipe body 69. The curved fastening plate 60*a* of the prism pipe body 69 is screwed and fixed to the other ends of the prism pipe bodies 63 and 65, so that the prism pipe body 69 is fastened and fixed between the prism pipe body 63 and prism pipe body 65.

Also, it is preferable when loading an image forming unit on a upper surface of the frame assembly, the prism pipe body 68, side surface walls 3 and 4 of which become a upper side is formed parallel. The reason is that a working stress of the side walls 3 and 4 during the process of the prism pipe body are smaller than the remainder wall. The flat degree thereof is guaranteed, so that the side walls 3 and 4 is suitable as a location determination base surface.

In accordance with a method of manufacturing pipe body and pipe body manufactured by the method, according to the present invention, when mass production them, a pipe body to which a seam is tightly contacted can be uniformly manufactured without deflections.

In any products, for example support member, a frame assembly, and an image forming device, in which the piping structure in accordance with present invention is utilized, a cost for structure maintaining materials for those products such as image forming device, can be decreased.

For easy notation, the powers of ten is described as "10 [k]" in the above description, since, 10 [3] means third power of 10 (=1000).

What is claimed is:

1. A method for producing a metal pipe rectangular in section by bending a metal plate having first and second edge portions parallel to each other along a plurality of bending lines parallel to said first and second edge portions and abutting said first and second edge portions, said pipe having a first flat surface including abutting portions of said first and second edge portions, a second flat surface perpendicular at a first corner to said first flat surface, a third flat surface perpendicular at a second corner to said second flat surface and opposite to said first flat surface, and a fourth flat surface perpendicular at a third corner to said third flat surface and at a fourth corner to said first flat surface and opposite to said second flat surface, said method comprising the steps of:

a first processing step for forming a processed product by bending said metal plate along said bending lines, said processed product having a first upper surface for partially constituting said first flat surface and including said first edge portion, a second upper surface for constituting said first flat surface together with said first upper surface and including said second edge portion, a first side surface for constituting said second flat surface, a lower surface for constituting said third flat surface, and a second side surface for constituting said fourth flat surface, said first and second edge portions being spaced apart; and a second processing step for generating and maintaining a spring back force which maintains a close-fitting of said first and second edge portions in at least one of said second, third and fourth flat surfaces, wherein said second processing step includes deforming at least a portion of said lower surface to project outwardly by applying a force and close-fitting said first and second edge portions and deforming said lower surface into a flat condition by applying a force on the projected portion of said lower surface to maintain said spring back force in said third flat surface.

2. A method for producing a metal pipe rectangular in section by bending a metal plate having first and second edge portions parallel to each other along a plurality of bending lines parallel to said first and second edge portions and abutting said first and second edge portions, said pipe having a first flat surface including abutting portions of said first and second edge portions, a second flat surface perpendicular at a first corner to said first flat surface, a third flat surface perpendicular at a second corner to said second flat surface and opposite to said first flat surface, and a fourth flat surface perpendicular at a third corner to said third flat surface and at a fourth corner to said first flat surface and opposite to said second flat surface, said method comprising the steps of:

a first processing step for forming a processed product by bending said metal plate along said bending lines, said processed product having a first upper surface for partially constituting said first flat surface and including said first edge portion, a second upper surface for constituting said first flat surface together with said first upper surface and including said second edge portion, a first side surface for constituting said second flat surface, a lower surface for constituting said third flat surface, and a second side surface for constituting said fourth flat surface, said first and second edge portions being spaced apart; and a second processing step for generating and maintaining a spring back force which maintains a close-fitting of said first and second edge portions in at least one of said second, third and fourth flat surfaces, wherein said second processing step includes close-fitting said first and second edge portions by applying a force on said first and second side surfaces and maintaining said spring back force in said third flat surface by restraining deformation of said lower surface which tends to project outwardly and holding said lower surface in a flat condition.

3. A method for producing a metal pipe rectangular in section by bending a metal plate having first and second edge portions parallel to each other along a plurality of bending lines parallel to said first and second edge portions and abutting said first and second edge portions, said pipe having a first flat surface including abutting portions of said first and second edge portions, a second flat surface perpendicular at a first corner to said first flat surface, a third flat surface perpendicular at a second corner to said second flat surface and opposite to said first flat surface, and a fourth flat surface perpendicular at a third corner to said third flat surface and at a fourth corner to said first flat surface and opposite to said second flat surface, said method comprising the steps of:

a first processing step for forming a processed product by bending said metal plate along said bending lines, said processed product having a first upper surface for partially constituting said first flat surface and including said first edge portion, a second upper surface for constituting said first flat surface together with said first upper surface and including said second edge portion, a first side surface for constituting said second flat surface, a lower surface for constituting said third flat surface, and a second side surface for constituting said fourth flat surface, said first and second edge portions being spaced apart; and a second processing step for generating and maintaining a spring back force which maintains a close-fitting of said first and second edge portions in at least one of said second, third and fourth flat surfaces, wherein said second processing step includes close-fitting said first and second edge portions by applying a force on said first and second side surfaces and deforming at least one of said first and second side surfaces and lower surface to project inwardly to maintain said spring back force in at least one of said second, third and fourth flat surfaces.

4. A metal pipe comprising:

a first flat surface including first and second edge portions which are parallel to and abutted to each other, a second flat surface perpendicular at a first corner to said first flat surface, a third flat surface perpendicular at a second corner to said second flat surface and opposite to said first flat surface; and a fourth flat surface perpendicular at a third corner to said third flat surface and at a fourth corner to said first flat surface and opposite to said second flat surface, wherein a portion for generation of spring back force for abutting said first and second edge portions is formed on said third flat surface opposite to said first and second edge portions.

5. A metal pipe according to claim 4, wherein said portion for generation of spring back force formed on said third flat surface is composed of a deformed portion formed by projection outward of said third flat surface by applying a force on said second and fourth flat surfaces and a flat portion formed by deformation of said deformed portion into a flat condition by applying a force on said third flat surface.

6. A metal pipe according to claim 4, wherein said portion for generation of spring back force is formed by restraining deformation of said third flat surface which tends to project outwardly with applying of a force on said second and fourth flat surfaces and holding said third flat surface in a flat condition.

7. Apparatus for producing a metal pipe rectangular in section formed by bending a metal plate having first and second edge portions parallel to each other along a plurality of bending lines parallel to said first and second edge portions and adapted to abut said and second edge portions, said pipe having a first flat surface including abutting portions of said first and second edge portions, a second flat surface perpendicular at a first corner to said first flat surface, a third flat surface perpendicular at a second corner to said second flat surface and opposite to said first flat surface, and a fourth flat surface perpendicular at a third corner to said third flat surface and at a fourth corner to said first flat surface and opposite to said second flat surface, said apparatus comprising:

a fixed plate for supporting a processed product which is formed by bending said metal plate along said bending lines and which has a first upper surface for partially constituting said first flat surface and including said first edge portion, a second upper surface for constituting said first flat surface together with said first upper surface and including said second edge portion, a first side surface for constituting said second flat surface, a lower surface constructing said third flat surface, and a second side surface for constituting said fourth flat surface, said first and second edge portions being spaced apart, wherein said processed product is disposed on said fixed plate to position downwardly said lower surface;

a pair of press punch members for pressing said first and second side surfaces of said processed product on said fixed plate to approach to each other and for abutting said first and second edge portions;

a drive member for driving said pair of press punch members; and a press punch member for pressing from above said first flat surface formed by said first and second upper surfaces to close-fit said first and second edge portions.

8. Apparatus for producing a metal pipe according to claim 7, wherein said pair of press punch members are provided with slip-resisting members for preventing said processed product from slipping on said pair of punch members in order to maintain said lower surface in a flat condition by restraining the deformation of said lower surface which tends to project outwardly at the time of pressing of said pair of press punch members, by means of said fixed plate.

9. Apparatus for producing a metal pipe according to claim 7, wherein said pair of press punch members are provided with convex forming members for forming convex portions which project inwardly on said first and second side surfaces of said processed product on said fixed plate in order to maintain a spring back force which maintains the close-fitting state of said first and second edge portions in said second and fourth flat surfaces of said metal pipe.

* * * * *